US008136930B2

(12) United States Patent
Anma et al.

(10) Patent No.: US 8,136,930 B2
(45) Date of Patent: Mar. 20, 2012

(54) LIQUID CONTAINER AND MANUFACTURING METHOD THEREFOR

(75) Inventors: Hiromasa Anma, Kanagawa (JP); Haruyuki Matsumoto, Kanagawa (JP); Kenjiro Watanabe, Tokyo (JP); Hajime Yamamoto, Tokyo (JP); Yukuo Yamaguchi, Tokyo (JP); Yasuo Kotaki, Kanagawa (JP); Keisuke Matsuo, Kanagawa (JP); Kenji Kitabatake, Kanagawa (JP); Eiichiro Shimizu, Hong Kong (CN)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 11/723,551

(22) Filed: Mar. 21, 2007

(65) Prior Publication Data

US 2007/0195141 A1 Aug. 23, 2007

Related U.S. Application Data

(62) Division of application No. 11/017,084, filed on Dec. 21, 2004, now Pat. No. 7,213,914.

(30) Foreign Application Priority Data

| | | |
|---|---|---|
| Dec. 26, 2003 | (JP) | 2003/435940 |
| Dec. 26, 2003 | (JP) | 2003/435942 |
| Oct. 20, 2004 | (JP) | 2004/306128 |
| Nov. 12, 2004 | (JP) | 2004/329699 |

(51) Int. Cl.
*B41J 2/175* (2006.01)
*B41J 2/14* (2006.01)

(52) U.S. Cl. ..... 347/86; 347/19; 347/49

(58) Field of Classification Search ..... 447/49; 347/85, 86, 87

See application file for complete search history.

(56) References Cited

U.S. PATENT DOCUMENTS

| | | | | |
|---|---|---|---|---|
| 5,245,361 | A | 9/1993 | Kashimura et al. | 346/140 R |
| 5,359,357 | A * | 10/1994 | Takagi et al. | 347/49 |
| 5,365,312 | A | 11/1994 | Hillmann et al. | 399/12 |

(Continued)

FOREIGN PATENT DOCUMENTS

| | | |
|---|---|---|
| EP | 1114726 | 7/2001 |

(Continued)

OTHER PUBLICATIONS

Singapore Search and Examination Report in corresponding Singapore Patent Application No. 200407931-5, dated Nov. 14, 2007.

(Continued)

*Primary Examiner* — Anh T. N. Vo

(74) *Attorney, Agent, or Firm* — Fitzpatrick, Cella, Harper & Scinto

(57) ABSTRACT

A liquid container detachably mountable to a mounting portion of an ink jet printer including an information storing portion for storing information relating to the liquid container; a controller controls light emission of a light emitting portion, based on individual information corresponding to the ink container, supplied through a container contact from a printer contact, and the discrimination information stored in the memory; a light guide member having a light incident portion and a light emergence portion, the light guide member configured to guide the light entered from the light incident portion to the light emergence portion so as to cause a light receptor to receive the light emerged from the light emergence portion to obtain light reception information used for discriminating properness of position of the ink container mounted in the mounting portion.

22 Claims, 42 Drawing Sheets

U.S. PATENT DOCUMENTS

| | | | | |
|---|---|---|---|---|
| 5,400,066 | A | 3/1995 | Matsumoto et al. | 347/86 |
| 5,583,549 | A | 12/1996 | Ujita et al. | 347/86 |
| 5,616,929 | A | 4/1997 | Hara | 250/573 |
| 5,619,237 | A | 4/1997 | Inoue et al. | 347/86 |
| 5,699,091 | A | 12/1997 | Bullock et al. | 347/19 |
| 5,940,102 | A | 8/1999 | Watanabe et al. | 347/86 |
| 6,055,406 | A | 4/2000 | Kawai et al. | 399/360 |
| 6,062,667 | A | 5/2000 | Matsui et al. | 347/19 |
| 6,097,405 | A | 8/2000 | Lo et al. | 347/6 |
| 6,151,051 | A | 11/2000 | Ikeda et al. | 347/86 |
| 6,155,678 | A * | 12/2000 | Komplin et al. | 347/86 |
| 6,250,746 | B1 | 6/2001 | Ito et al. | 347/86 |
| 6,302,535 | B1 | 10/2001 | Sturgeon et al. | 347/86 |
| 6,361,136 | B1 * | 3/2002 | Watanabe et al. | 347/7 |
| 6,402,310 | B1 | 6/2002 | Maeda et al. | 347/87 |
| 6,422,675 | B1 | 7/2002 | Tomomatsu | 347/7 |
| 6,431,681 | B2 | 8/2002 | Hatasa et al. | 347/19 |
| 6,547,363 | B1 | 4/2003 | Shinada et al. | 347/19 |
| 6,554,411 | B1 | 4/2003 | Hatasa et al. | 347/86 |
| 6,609,788 | B2 | 8/2003 | Hatasa et al. | 347/86 |
| 6,702,427 | B2 | 3/2004 | Shimizu et al. | 347/50 |
| 6,742,857 | B2 | 6/2004 | Koshikawa et al. | 347/19 |
| 6,742,872 | B2 | 6/2004 | Fukazawa et al. | 347/50 |
| 6,808,256 | B2 | 10/2004 | Umeyama et al. | 347/87 |
| 6,815,381 | B1 | 11/2004 | Yamamoto et al. | 442/187 |
| 6,824,258 | B2 | 11/2004 | Yamamoto et al. | 347/86 |
| 6,869,158 | B2 | 3/2005 | Kojima et al. | 347/19 |
| 7,213,914 | B2 * | 5/2007 | Anma et al. | 347/86 |
| 7,237,881 | B2 * | 7/2007 | Hayasaki et al. | 347/86 |
| 2002/0008722 | A1 | 1/2002 | Imanaka et al. | 347/14 |
| 2002/0008724 | A1 | 1/2002 | Kubota et al. | 347/19 |
| 2002/0149633 | A1 | 10/2002 | Murakami et al. | 347/7 |
| 2002/0175979 | A1 | 11/2002 | Morita et al. | 347/86 |
| 2003/0215280 | A1 | 11/2003 | Hatasa et al. | 401/132 |
| 2003/0227501 | A1 | 12/2003 | Hatasa et al. | 347/19 |
| 2003/0234844 | A1 | 12/2003 | Yamamoto et al. | 347/86 |
| 2004/0100540 | A1 | 5/2004 | Hatasa et al. | 347/86 |
| 2005/0007420 | A1 | 1/2005 | Ogawa et al. | 347/50 |
| 2005/0036016 | A1 | 2/2005 | Watanabe et al. | 347/86 |
| 2005/0151811 | A1 | 7/2005 | Shimizu et al. | 347/86 |
| 2005/0179750 | A1 | 8/2005 | Hayasaki et al. | 347/86 |
| 2005/0219303 | A1 | 10/2005 | Matsumoto et al. | 347/19 |

FOREIGN PATENT DOCUMENTS

| | | |
|---|---|---|
| GB | 2317589 | 4/1998 |
| JP | 60-032667 | 2/1985 |
| JP | 2-178050 | 7/1990 |
| JP | 4-275156 | 9/1992 |
| JP | 05-077441 | 3/1993 |
| JP | 06-238913 | 8/1994 |
| JP | 8-058107 | 3/1996 |
| JP | 2000-326604 | 11/2000 |
| JP | 2001-253087 | 9/2001 |
| JP | 2001-253090 | 9/2001 |
| JP | 2002-005724 | 1/2002 |
| JP | 2002-005818 | 1/2002 |
| JP | 2002-301829 | 10/2002 |
| JP | 2003-156983 | 5/2003 |
| JP | 2003-334964 | 11/2003 |

OTHER PUBLICATIONS

European Search Report in corresponding European Patent Application No. 04030456.0, dated Sep. 17, 2008.

European Examination Report from corresponding European Patent Application No. 04030456.0, dated Feb. 16, 2009.

Singapore Search and Examination Report in corresponding Singapore Patent Application No. 200801234-6, dated Oct. 26, 2007.

Extended European Search Report dated Apr. 20, 2011, from corresponding European Application No. 11154623.0.

Extended European Search Report dated Apr. 20, 2011, from corresponding European Application No. 11155008.3.

Japanese Office Action dated Oct. 5, 2007 in counterpart Application No. 2007-160709, with excerpted translation.

* cited by examiner (a)

(b)

STRT CODE + CLR INF | CTRL CODE

| | | | | | | |
|---|---|---|---|---|---|---|
| K-OFF | 0 | 0 | 0 | 0 | 0 | 0 |
| K-ON | 0 | 0 | 0 | 1 | 0 | 0 |
| ALL-OFF | 1 | 1 | 1 | 0 | 0 | 0 |
| ALL-ON | 1 | 1 | 1 | 1 | 0 | 0 |
| K-CALL | 0 | 0 | 0 | 0 | 0 | 1 |

COMMANDS TO CTLR ON CNTTNR 1K

| | | | | | | |
|---|---|---|---|---|---|---|
| C-OFF | 1 | 0 | 0 | 0 | 0 | 0 |
| C-ON | 1 | 0 | 0 | 1 | 0 | 0 |
| ALL-OFF | 1 | 1 | 1 | 0 | 0 | 0 |
| ALL-ON | 1 | 1 | 1 | 1 | 0 | 0 |
| C-CALL | 1 | 0 | 0 | 0 | 0 | 1 |

COMMANDS TO CTLR ON CNTTNR 1C

| | | | | | | |
|---|---|---|---|---|---|---|
| M-OFF | 0 | 1 | 0 | 0 | 0 | 0 |
| M-ON | 0 | 1 | 0 | 1 | 0 | 0 |
| ALL-OFF | 1 | 1 | 1 | 0 | 0 | 0 |
| ALL-ON | 1 | 1 | 1 | 1 | 0 | 0 |
| M-CALL | 0 | 1 | 0 | 0 | 0 | 1 |

COMMANDS TO CTLR ON CNTTNR 1M

| | | | | | | |
|---|---|---|---|---|---|---|
| Y-OFF | 1 | 1 | 0 | 0 | 0 | 0 |
| Y-ON | 1 | 1 | 0 | 1 | 0 | 0 |
| ALL-OFF | 1 | 1 | 1 | 0 | 0 | 0 |
| ALL-ON | 1 | 1 | 1 | 1 | 0 | 0 |
| Y-CALL | 1 | 1 | 0 | 0 | 0 | 1 |

COMMANDS TO CTLR ON CNTTNR 1Y

LIQUID CONTAINER AND MANUFACTURING METHOD THEREFOR

This application is a division of application Ser. No. 11/017,084, filed Dec. 21, 2004, the contents of which are incorporated herein by reference.

FIELD OF THE INVENTION AND RELATED ART

The present invention relates to a liquid container and a manufacturing method therefor, and more particularly to the liquid container and the manufacturing method for the container, wherein information of a state of the liquid container such as ink remaining amount of the ink container is notified by emitting means such as LED.

The present invention relates to a liquid container, in particular, a liquid container in the form of an ink container removably mountable in an ink jet recording unit or an ink jet recording apparatus, which records on recording medium by ejecting ink.

An ink jet recording apparatus which forms an image on recording medium by depositing ink in the form of liquid with the use of an ink jet recording head is widely used as an outputting means for such an information processing apparatus as a copying machine, a facsimileing machine, an electronic typewriter, a printer as an outputting peripheral device for a wordprocessor, a workstation, a personal or host computer, etc., or a portable printer to be connected to an optical disc apparatus, a video apparatus, a digital camera, etc.

As a system for supplying such an ink jet recording apparatus as those described above with ink, there is a system in which an ink container is inseparably or removably attached to a recording head mounted on a carriage or the like and reciprocally movable (in primary scanning direction), and ink is directly supplied to the recording head from this ink container. Whether an ink jet recording apparatus is structured so that an ink container is inseparably attached to a recording head, or it is structured so that an ink container is removably attached to a recording head, the positioning of an ink container relative to a recording head, or positioning of a recording head unit, that is, the integral combination of a recording head and an ink container, relative to a relevant member (for example, carriage of serial type recording apparatus, reciprocally movable in primary scanning direction) of the main assembly of a recording apparatus, is one of the most important issues related to recording quality. Further, it is very important, in particular, in the field of an ink jet recording apparatus for personal usage, to provide an ink supplying system for an ink jet recording apparatus which is small in size, simple in terms of the operation for mounting or dismounting an ink container or an ink jet recording head unit, and also, simple in terms of mechanism.

Thus, the inventors of the present invention have proposed a combination of an ink container and a structure for removably attaching an ink container, as an answer to the above described concerns. According to this proposal, an ink container is provided with a anchoring claw, which projects from one of the end surfaces, and a springy latching lever with an anchoring claw, which projects from the bottom portion of the opposite surface from the surface with the anchoring claw. Further, the holder to which an ink container is attached is provided with an anchoring hole into which the anchoring claw of an ink container fits, and an anchoring hole into which the anchoring claw of the springy latching lever of an ink container fits. The two anchoring holes of the holder are in the opposing two side walls of the holder, one for one. As for the mounting of the ink container, first, the ink container is to be positioned so that the anchoring claw projecting from one end of the ink container fits into the anchoring hole of the holder, and then, the ink container is to be pushed down into the predetermined position in the holder by the other end to cause the anchoring of the latching lever of the ink container to snap into the anchoring hole of the holder. With the two claws locked in the corresponding anchoring holes, the ink container is prevented from dislodging from the abovementioned predetermined position in the holder.

Such a removably mountable ink container as the one described above has been known to be provided with a storage means capable of electrically storing the information regarding the ink container itself (for example, color of ink therein), in order to make it possible to control the recording process of an ink jet recording apparatus, based on the information stored in the storage means. The information stored in the storage means is read as the ink container is mounted into the ink jet recording apparatus. In the case of an ink jet recording apparatus structured as described above, the ink container must be connected to the recording head so that not only is an ink passage established between the ink container and recording head, but also, an information exchange channel must be established between the two.

As one of the means for accomplishing the above described objects, Japanese Laid open Patent Application 2001 253087 discloses the following structural arrangement: The electrical contacts of an ink container and the electrical contacts of a holder are disposed on the same side so that as the ink container is mounted into the holder, the electrical contacts of both sides come into contact with each other, and also, so that once they are placed in contact with each other, they are kept in contact with each other by the engagements between the anchoring claw, such as the one described above, of the ink container, with the corresponding anchoring hole of the holder, and between the anchoring claw of the latching lever, such as the above described one, of the ink container, and the corresponding anchoring hole of the holder. In the case of this structural arrangement, the electrical contacts of the two sides are automatically connected as the ink container is mounted into the holder, eliminating the need for a mechanism dedicated to the connection, or the need for performing a procedure dedicated for the connection. Therefore, this structural arrangement is advantageous from the standpoint of operational efficiency.

On the other hand, with recent wider use of digital camera, the demand is increasing for printing with the digital camera being directly connected with a printer (recording device), that is, non-PC printing (the printing in which a digital camera is directly connected with a printer, is called "camera direct"). In addition, an information memory medium of a card type which is an information memory medium detachably mountable to a digital camera is directly mounted into a printer, and the data is transferred to the printer to effect print (non-PC print, called "card direct"). This type printing is also increasing. Furthermore, a so-called multi-function printer which has a printer function and a scanner function and which has a copying function without use of a PC (the direct printing function) is increasingly used.

When an ink jet printer is used, it is desirable in some cases that information relating to a state of individual ink container such as mounting state of the ink container, ink remaining amount in the ink container is given to the user. Or, the user desires to be given such information. For example, if the user is aware of the fact the ink remaining amount in the ink container is small, the ink container is replaced with a new one, by which the wasteful printing (only to half way to a recording material, for example) due to the shortage of the ink can be avoided beforehand.

Conventionally, such information is transmitted to the display to which the printer is connected, and the event appears on the display of the PC. In the case of non-PC recording, this is not possible, and therefore, it would be considered to provide the printer (main assembly) with a computer display in which the information can appear. However, the provision of such a display device increases cost of the printer and upsizes the printer, and in addition, design or the like of the printer is influenced, and therefore, the provision of the display device is not always desirable. Even if the display device is provided, it is not always assured that user immediately and clearly recognize the state of the ink container.

In another conventional example, a display element such as LED is used to notify the user of the state of the ink container. For example, Japanese Laid-open Patent Application Hei 4-275156 discloses that ink container which is integral with a recording head is provided with two LED elements, which are switched on depending on the ink remaining amount in two steps. More particularly, an ink cartridge integrally having an ink jet head and an ink container is provided with means for counting a number of electric power supplies to an ink jet head, means for storing the count, a LED for near end display for showing by light emittance thereof the event of approaching of the integrated count to the near end discrimination value, and an ink empty LED which is switched on when the integrated count reaches the ink empty discrimination value.

Similarly, Japanese Laid-open Patent Application 2002-301829 discloses provision, on the ink container or a carriage therefor, of a lamp which is switched on depending on ink remaining amount. The same also discloses that four ink containers used with one recording device are provided with said lamps, respectively.

In addition, in order to meet a demand for high image quality, light magenta ink, light cyan ink and so on become used in addition to the conventional four color (black, yellow, magenta and cyan) inks. Furthermore, use of special color inks such as red ink, green ink or blue ink are proposed. In such a case, seven-eight color ink containers are used individually in an ink jet printer. Then, a mechanism for preventing the ink containers from being mounted at erroneous positions is desired. Japanese Laid-open Patent Application 2001-253087 discloses that configurations of the engaging portion of ink containers engageable with carrying portion of the carriage are made different depending on the colors of the ink containers, so that mounting of ink containers on erroneous position are prevented.

In comparison, the structural arrangement disclosed in Japanese Laid open Patent Application 2001 253087 suffers from the following problems. That is, if the latching lever of the ink container and the electrical contacts of the holder are not equal in resiliency, for example, if the contact pressure of the electrical contacts is greater than the force generated by the resiliency of the latching lever, the latching lever is excessively deformed, failing thereby to keep the ink container in the predetermined position in terms of the direction in which the force generated by the latching lever acts on the ink container. Therefore, it is possible that the ink passage on the ink container side and the ink passage on the recording head side become misaligned at the joint, preventing thereby ink from being properly supplied, and/or allowing ink to leak from the joint. It is also possible that the contact pressure between the electrical contacts on the ink container side and holder side will become unstable, failing thereby to remain properly connected in terms of electrical conduction.

As the solution to the above described problems, it is possible to place the electrical contact portion on the bottom surface of the ink container in the same manner as the one disclosed in Japanese Laid open Patent Application 2 178050. According to Japanese Laid open Patent Application 2 178050, the ink jet recording head is integral with an ink container, and is removably mountable in the carriage of the ink jet recording apparatus. Its electrical contacts through which recording signals are transmitted to the recording head from the main assembly of the recording apparatus are attached to the bottom surface of the recording head, and the corresponding surface of the carriage. Thus, as the recording head is mounted into the carriage, the electrical contacts of the recording head come into contact with the electrical contact of the carriage, and then, keep sliding thereon while the recording head is moved (pivotally) into its final position on the carriage. Therefore, the electrical contacts of the recording head and the electrical contacts of the carriage are better connected in terms of electrical conductivity. Thus, it seems reasonable to the adopt the design of the electrical joint between the recording head and carriage disclosed in Japanese Laid open Patent Application 2 178050 to the design of the electrical joint between an ink container and a recording head, through which the ink container information is electrically transmitted.

However, electrical contacts are electrically conductive members formed of relatively rigid metallic substance, and therefore, applying a large amount of pressure to electrical contacts, and/or causing electrical contacts to slide on each other while applying a large amount of pressure, in order to ensure that the electrical contacts of an ink container and the electrical contacts of the main assembly remain satisfactorily connected in terms of electrical conductivity is unwise from the standpoint of the prevention of the damage to the electrical contacts and the durability of the electrical contacts. In other words, the amount of the pressure to be applied to the electrical contacts to ensure that the electrical contacts of the ink container are kept satisfactorily connected to the electrical contacts of the main assembly must be optimum, that is, the minimum to be effective. Thus, it is unwise to adopt the technologies disclosed in Japanese Laid open Patent Application 2 178050 without any modification. In particular, in the case that an ink container is removably attachable to a recording head, there is the possibility that when an ink container is attached or removed, the tip of the ink outlet of the ink container will come into contact with the electrical contacts of the main assembly, and wets them. Further, should ink leak from the joint between the ink outlet of the ink container and the ink inlet of the main assembly during the mounting of the ink container, it is very likely that the ink having leaked from the joint will reach the electrical contacts, because the electrical contacts are attached to the bottom surface of the ink container.

On the other hand, Japanese Laid-open Patent Application Hei 4-275156 discloses a structure of the ink cartridge wherein a LED for display is mounted on a print circuit board for electrical communication with the main assembly of the printer. However, with such a structure, in order to place the LED at a position allowing easy observation by the user, the PC plate has to be placed at the same to position. However, since the PC plate includes electrical connecting portion for electrical communication with the main assembly of the printer, the latitude of the arrangement is small. It would be considered the use a large area PC plate to cover the preferable position of the electrical connecting portion and the preferable portion of the LED. However, doing so increases the cost. If the structure disclosed in Japanese Laid-open Patent Application Hei 8-58107 is incorporated in a printer which carries a plurality of independent ink containers for the respective colors, the structure for mounting the ink container to the printer is limited, and therefore, the substantive capacity of the ink container has to be reduced, or the printer has to be upsized.

On the other hand, Japanese Laid-open Patent Application 2002-301829 simply discloses that ink warning lamp is provided at such a position that user easily recognizes it. However, it does not disclose a preferable structure for supplying the electric power or the signal to the ink warning lamp. From FIG. 6-FIG. 8, a lead wire connecting the ink jet recording apparatus and the ink warning lamp is suggested, but a number of wiring leads corresponding to the number of ink warning lamps are necessitated with the result of complicated wiring and therefore cost increase, and in addition, the wiring lead and the connecting portion will deteriorate the easy observation. In addition, Japanese Laid-open Patent Application 2002-301829 discloses in its FIG. 6 that ink warning lamp is provided on a fixed lever which is a movable member for fixing the ink container on the carriage for carrying the ink container, and discloses in its FIG. 7 a structure in which the ink warning lamp is provided on the ink container per se. However, there is no disclosure about the electric power supply method to the ink warning lamp.

These problems are more significant recently as a result of the downsizing and the multi-function tendency. Particularly in the case of a multi-function printer in which a scanner is placed at the top of the printer, the position for the display is more limited.

The display is used not only to notify the user of the information but also to permit proper control of the main assembly side of the apparatus.

Even when the ink container is provided with a lamp, as disclosed in Japanese Laid-open Patent Application 2002-301829, the main assembly side controller has to identify the ink container which is recognized as containing less ink. To do this, it is necessary to identify the ink container to which the signal for turning the right lamp on. If, for example, the ink container is mounted on a wrong position, there is a liability that small ink remaining amount is displayed for another ink container which contains a sufficient amount of the ink. Therefore, for the emission control of the displaying device such as a lamp or the like, it is a premise that mounted of the ink container is specified.

As for the structure for specified the mounted position of the ink container, Japanese Laid-open Patent Application 2001-253087 discloses that configurations of the engaging positions of ink containers are made different depending on the colors of the ink containers. However, in such a case, it is required that ink containers having configurations depending on the colors of the ink to contain with the result of disadvantage in the manufacturing cost which is more significant with the increase of the number of the colors of the ink.

It would be possible that light emission control is carried out for the respective LED of the ink containers, and the emitted light is received by a photoreceptor fixed in the printer, wherein on the basis of the state of the output, the position of the ink container is specified. With such a structure, the LED of the ink container has two functions, namely, to emit the light to notify the user of the state of the ink container and to emit the light to specify the position of the ink container.

Here, the user possibly looks at display portion of the ink container in the printer in various directions. In view of the fact, it is desirable to emit the light in a wide range.

As will be understood from the foregoing, there are contradictory desires, namely, (1) easiness of mounting to the mounting portion, (2) assuring the electrical connection with the mounting portion of the main assembly side of the printer while protecting the electrical connecting portion from the ink, and (3) assured transmission of the light from the emitting portion to the photoreceptor of the printer and to the user.

SUMMARY OF THE INVENTION

Accordingly, it is a principal object of the present invention to provide a liquid container and a manufacturing method therefor wherein a mounting mechanism and operation to the mounting portion is simple and easy, while assuring positioning and stable establishment of the electrical connection, and in addition, the light from a light emission device provided in the ink container is transmitted to the user and a photoreceptor of the printer with certainty.

According to an aspect of the present invention, there is provided a liquid container detachably mountable to a mounting portion of an ink jet recording apparatus, said liquid container comprising:

a casing defining a liquid containing chamber; a supply port, provided in said casing, for supplying liquid contained therein to an ink jet head; a first engaging portion engageable with a first locking portion provided in the mounting portion, said first engaging portion being disposed on one side of said casing; a second engaging portion engageable with a second locking portion provided in the mounting portion, said second engaging portion being disposed opposed to another side of said casing, said another side being opposite said one side; a supporting portion for displaceably supporting said second engaging portion; an information storing portion for storing information relating to said liquid container; a contact electrically connectable with a contact provided in said mounting portion; a light emitting portion; a display portion for directing the light emitted from said emitting portion to an outside of said liquid container, wherein said supply port is provided in a side of said casing which is between said one side and said another side, and said contact is disposed in a region of a corner portion between said another side and said side having said supply port, said display portion is disposed adjacent an upper, in use, portion in said another side of said liquid container.

As described above, the present invention makes it possible to make a liquid container, which has a liquid outlet and an information storage means having electrical contacts, simpler in the mechanism for mounting it into the liquid container mount of a device to which it is attached, simpler in the procedure for mounting it, more reliable and accurate in positioning, smaller in the amount of force necessary to mount it, and better in the state of connection between its liquid outlet and the liquid inlet of a device to which it is attached and the state of contact between the electrical contacts of its information storage means and the electrical contacts of the device to which it is attached.

Further, the present invention can structure a combination of a liquid container and the liquid container mount of a device to which the liquid container is to be attached, so that its electrical contacts are protected from the liquid leakage from the liquid container.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 32 is a circuit diagram showing the details of the substrate provided with controllers and so on.

DESCRIPTION OF THE PREFERRED EMBODIMENTS

The description will be made as to the preferred embodiment of the present invention in conjunction with the accompanying drawings.

1. First Embodiment

1.1 Description of First Embodiment

Figure 1:
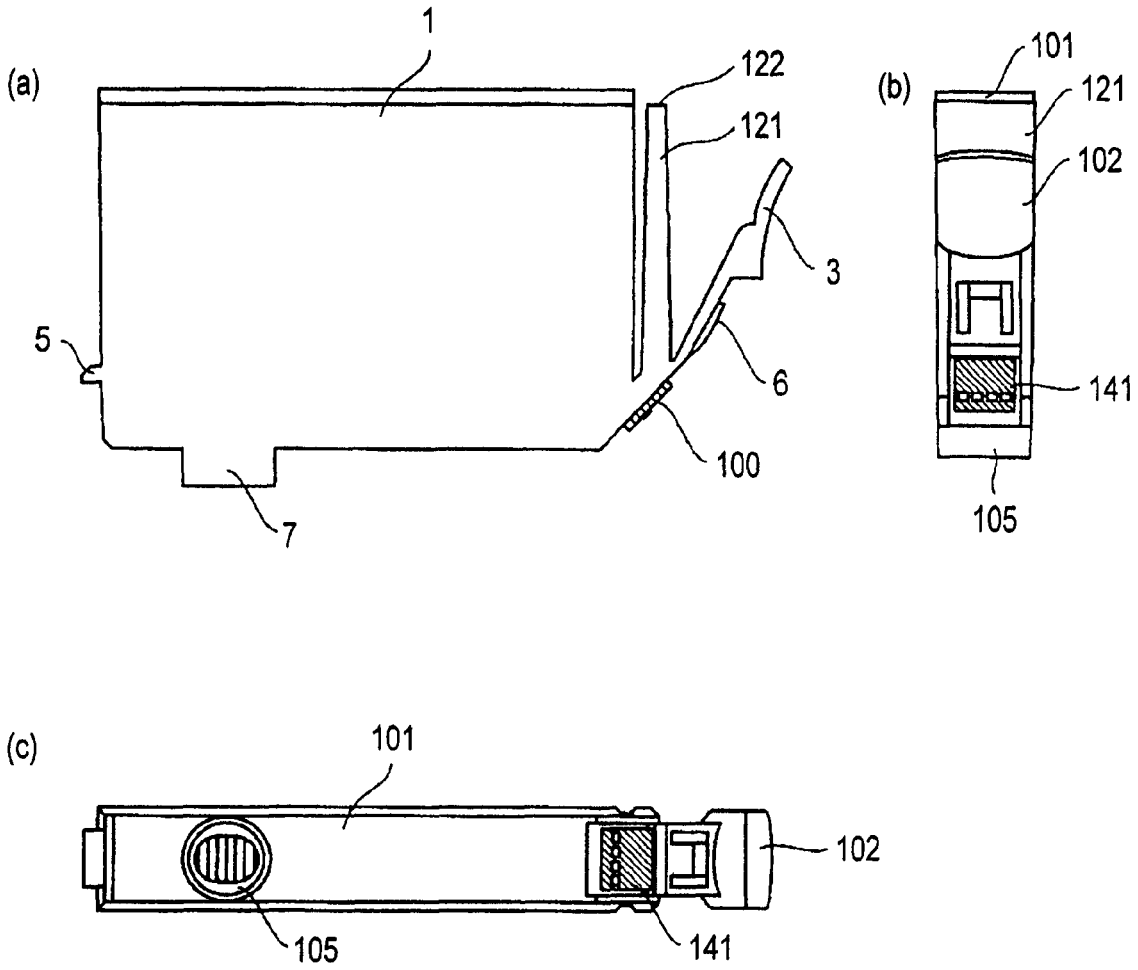
FIG. 1 is a side view (a), a front view (b) and a bottom view (c) of an ink container according to a first embodiment of the present invention.

FIG. 1 is a side view (a), a front view (b) and a bottom view (c) of an ink container according to a first embodiment of the present invention. In the following descriptions, the front side of the ink container is the side which is faced to the user who is manipulating the ink container (mounting and demounting operation of the ink container), which provides the user with information (by light emission from a display portion which will be described hereinafter).

In FIG. 1, the ink container 1 of this embodiment has a supporting member 3 supported on the lower portion at the front side thereof. The supporting member 3 is made of resin material integrally molded with an outer casing of the ink container 1, and the ink container 1 is displaceable about a portion of the ink container to be supported when the ink container 1 is mounted to the container holder. The ink container 1 is provided on its rear side and front side with a first engaging portion 5 and second engaging portion 6, respectively, which are engageable with locking portions provided in a container holder. In this embodiment, they are integral with the supporting member 3. By engagement of the engaging portion 5 and the engaging portion 6 with the locking portions, the ink container 1 is securedly mounted in the ink container 1. The operation during the mounting will be described hereinafter referring to FIG. 12, (a)-(d).

The bottom surface of the ink container 1 is provided with an ink supply port 7 for ink supply, which port is connectable with an ink introduction opening of the recording head which will be described hereinafter, by mounting of the ink container 1 to the container holder. A base member is provided on the bottom side of the supporting portion of the supporting member 3 at a position where the bottom side and the front side intersect with each other. The base member may be in the form of a chip or a plate. In the following description, it is called "substrate" 100.

Figure 2:
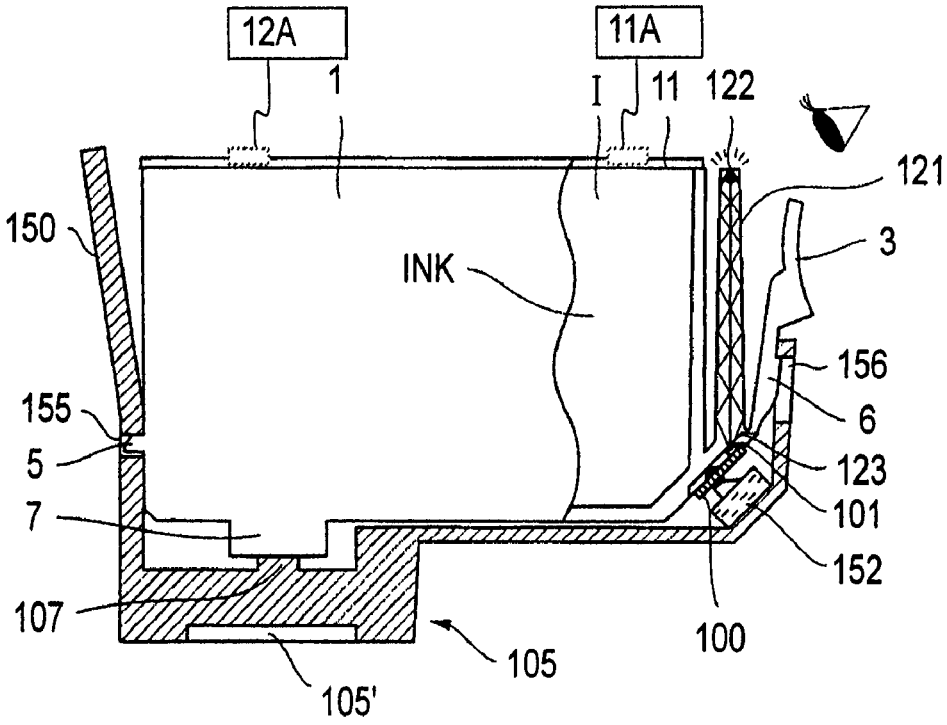
FIG. 2 is a schematic side view (a) and an enlarged view (b) of a major part thereof, illustrating functions of light guide portion and the like provided on the ink container according to the first embodiment of the present invention.
Figure 2:
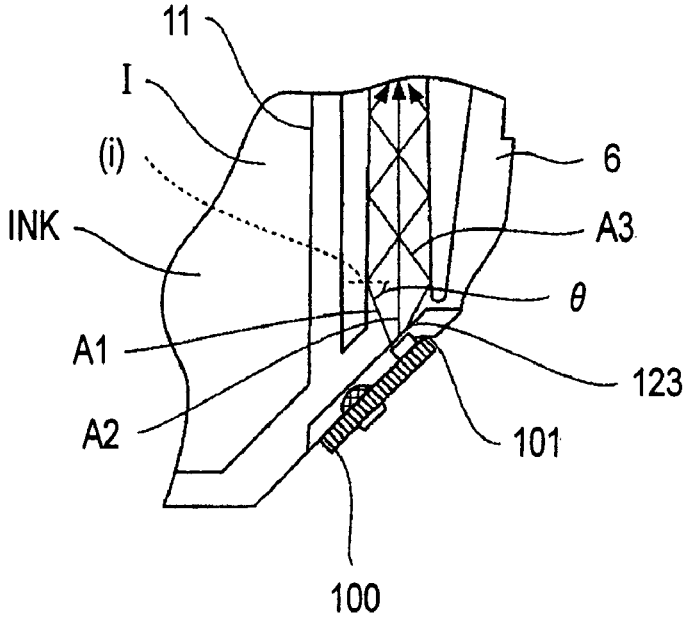
Figure 4:
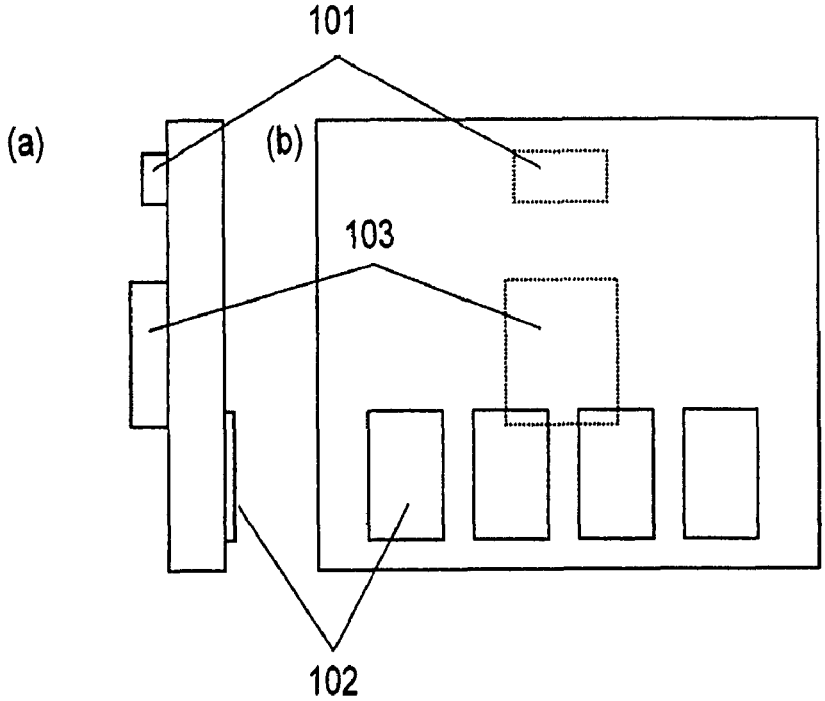
FIG. 4 is a side view (a) and a front view (b) of an example of a controller substrate mounted on the ink container of the first embodiment.

Referring to FIG. 2 and FIG. 4, the description will be made as to a structure and a function of a major part of this embodiment. FIG. 2 is a schematic side view (a) and an enlarged view (b) of a major part thereof, illustrating functions of light guide portion and the like provided on the ink container according to the first embodiment of the present invention. FIG. 4 is a side view (a) and a front view (b) of an example of a controller substrate mounted on the ink container of the first embodiment.

As shown by (a) in FIG. 2, the ink container 1 is securedly mounted in or to the holder 150 which is integral with the recording head unit 105 having the recording head 105, by engagements of the first engaging portion 5 and the second engaging portion 6 of the ink container 1 with a first locking portion 155 and a second locking portion 156 of the holder 150, respectively. At this time, a contact (connector) 152 provided in the holder 150, and a contact in the form of an electrode pad 102 ((b) of FIG. 4) provided on a surface of the substrate 100 facing to outside, are electrically contacted to establish electrical connection.

An inside of the ink container 1 is divided into an ink reservoir chamber 11 which is provided adjacent the front side c, and a negative pressure generating member accommodating chamber 12 which is provided adjacent the rear side and which is in fluid communication with an ink supply port 7. The ink reservoir chamber 11 and the negative pressure generating member accommodating chamber 12 are in fluid communication with each other through a communication port 13. The ink reservoir chamber 11 contains the ink alone in this embodiment, whereas the negative pressure generating member accommodating chamber 12 accommodates an ink absorbing material 15 (negative pressure generating member which is a porous member in this embodiment) made of sponge, fiber aggregate or the like for retaining the ink by impregnation. The porous member 15 functions to generate such a negative pressure as is sufficient to provide balance with the force of meniscus formed in the ink ejection nozzle of the recording head to prevent ink leakage from the ink ejection portion to the outside and to permits ink ejection by actuation of the recording head.

The internal structure of the ink container 1 is not limited to such a partitioned structure in which the inside is partitioned into the porous member accommodating chamber and the reservoir containing the ink alone. In another example, the porous member may occupy substantially all of the inside space of the ink container. The negative pressure generating means is not limited to the one using the porous member. In another example, the ink alone is contained in a bladder-like member made of elastic material such as rubber or the like which produces tension in the direction of expanding the volume thereof. In such a case, the negative pressure is generated by the tension in the bladder-like member to retain the ink. In a further example, at least a part of the ink accommodation space is constructed by a flexible In a further example, at least a part of the ink accommodation space is constructed by a flexible member, and the ink alone is accommodated in the space, wherein a spring force is applied to the flexible member, by which a negative pressure is generated. Member, and the ink alone is accommodated in the space, wherein a spring force is applied to the flexible member, by which a negative pressure is generated.

As shown in FIG. 4, (*a*) and (*b*), the surface of the substrate 100 facing toward the ink container 1, is provided with an emitting portion 101 for emitting visible light such as LED, and a control element 103 for controlling the emitting portion. The control element 103 controls emission of light of the emitting portion 101 in response to an electric signal supplied through a pad 102 from a connector 152.

As shown in, (a) and (b), a light guide portion 121 extends upwardly with a clearance from a front side wall of the outer casing of the ink container from a position where it is faced to the emitting portion 101, and is effective to guide the light. The free end portion thereof constitutes a display portion 122 which is easily seen by the user. The portion from which the light is emergent is called, "display portion" or "emergent portion" In order to suppress attenuation of a light quantity in the travel of light from the emitting portion 101 to the light guide portion 121, the emitting portion 101 is disposed on the substrate 100 so as to face a light incident surface 123 of the light guide portion 121 at a position close thereto (FIG. 2, (*b*)).

In this manner, the emitting portion and the display portion are separate from each other, so that display portion is disposed at the front side of the ink container, namely, the upper part of the side having a latch lever, thus facilitating observation of the user. As will be described hereinafter, when the light receiving portion is provided in the main assembly of the printer, the light can be assuredly received from the display portion by the light receiving portion. Since the light guide portion 121 for light connection between the emitting portion and the display portion is provided on the ink container 101, necessity for the wiring lead or the like for electric power supply and signal exchange can be eliminated, and therefore, the emitting portion 101 and the display portion 122 can be disposed at the respective optimum positions at low cost. Thus, the latitude is provided for the disposition of the display portion 122 to meet the user's conveniences, so that user can easily observe the light emission, by which the user can be given predetermined information relative to the ink container 1. By employing an integral molding of the light guide portion 121 with the outer casing of the ink container 1, the manufacturing cost is not increased significantly by the provision of the light guide portion 121.

In this embodiment, an air layer (space) exists between the light guide portion 121 and the front side wall of the outer casing of the ink container forming the ink reservoir chamber 11. It would be considered that light guide portion is fully integral with the front side wall of the outer casing of the ink container, in other words, the front side wall of the outer casing of the ink container is utilized as the light guide portion. However, the structure of this embodiment is advantageous in that light guide to the display portion 122 is efficient. The description will be made as to this point.

In this embodiment, as shown in FIG. 2, (*a*) and (*b*), the light guide portion 121 is integrally connected with the outer casing of the ink reservoir chamber 11, but is independent of the front side wall. Namely, with the structure of this embodiment, there is provided an air layer between the light guide portion 121 and the ink reservoir chamber 11. The outer casing of the ink container is made of polypropylene material. If the light guide portion 121 is completely integral with the outer casing of the ink reservoir chamber 11, the material of the light guide portion 121 has to be polypropylene.

As shown in FIG. 2, (*b*), in this embodiment, the light emitted by the emitting portion 101 is incident on the light incident surface 123 which is an end surface of the light guide portion 121, and the light travels through the light guide portion 121 to the display portion 122 for display to the user. The emitting portion 101, as described hereinbefore, emits visible light, and is scattering light. Therefore, there are a plurality of light rays as shown by arrows A1-A3.

Here, it is assumed that polypropylene has a refractive index of 1.49 (=n1) in the light guide portion 121. Since the air has a refractive index of 1.00 (=n2), the critical refraction angle from the polypropylene to the air is determined by the following Snell law of refraction:

$$n1 \sin È1 = n2 \sin È2.$$

That is, the critical refraction angle is approx. 43°.

Therefore, the light rays which are incident at the incident angle È which is 43° or larger at the point (i) in (b) of FIG. 2, are totally reflected by the interface between the polypropylene (light guide portion 121) and the air, and the light rays travel in the light guide portion 121 while repeating total reflection as indicated by arrow A1 or A3 to the display portion 122. When the incident angle È1 is not more than 43°, the light ray transmits to the air and does not reach the display portion 122.

The predetermined information of the ink container (liquid container) 1 mentioned in the foregoing, includes the information as to whether or not the mounting state of the ink container 1 is proper (whether or not the mounting is complete), the information as to the properness of the mounting position of the ink container (whether or not the ink container is mounted at a correct position on the holder determined on the basis of the color of the ink contained therein), and/or the information concerning the ink remaining amount (whether or not the ink remaining amount is enough). Such types of information can be displayed by presence or absence of the light emission, state of light emission (flickering or the like), and so on.

The description will be made as to a manufacturing method of the ink container. An inside of the ink container 1 is divided into an ink reservoir chamber 11 which is provided adjacent the front side, and a negative pressure generating member accommodating chamber 12 which is provided adjacent the rear side and which is in fluid communication with an ink supply port 7. The ink reservoir chamber 11 and the negative pressure generating member accommodating chamber 12 are in fluid communication with each other through a communication port 13. An upper surface of the generating member accommodating chamber is provided with an air vent 12A. The ink container 1 of FIG. 2 can be manufactured by preparing a main body of the ink container 1 provided with the substrate 100 having the contact, the controller and the emitting portion, and then injecting the ink into the inside. The ink injection port for this purpose, may be formed in the upper surface of the ink reservoir chamber, for example. After the ink injection through the ink injection port, the injection port is sealed by a sealing member 11A.

Alternatively, the sealing member 11A is dismounted or an injection hole is formed in an ink container casing, after the ink I in the ink container is consumed up, by which the ink can be reinjected into the ink container. As desired, the ink supply port 7 is sealed by a protection cap or a seal tape (unshown) or the like, by which the ink containers 1 can be transported.

1.2 Modified Example

Figure 3:
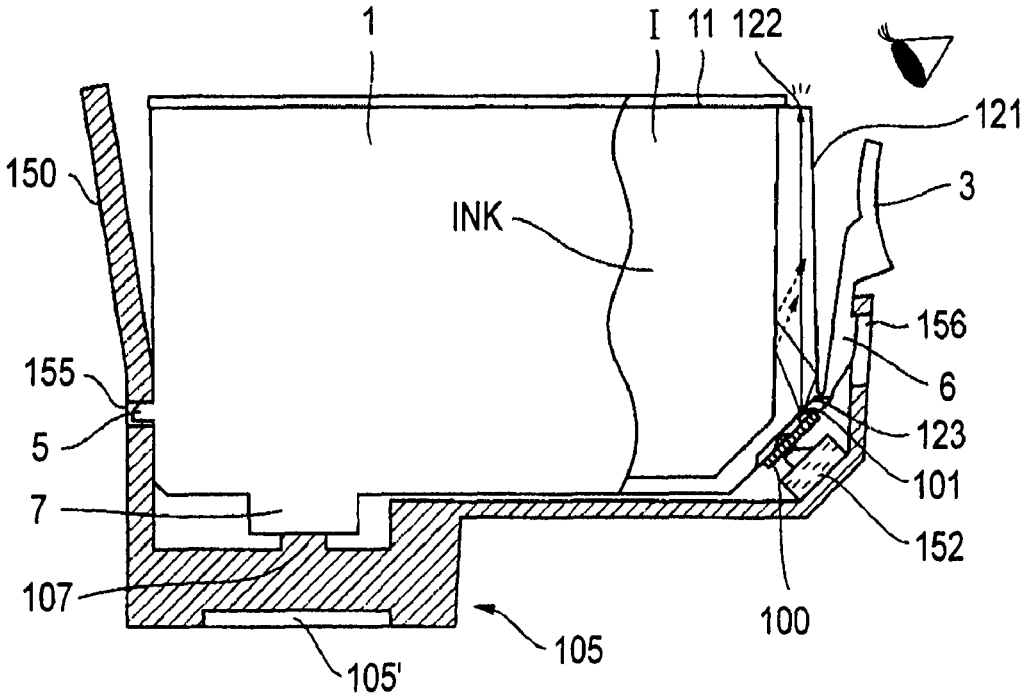
FIG. 3 is a schematic side view illustrating a modified example of the first embodiment.
Figure 5:
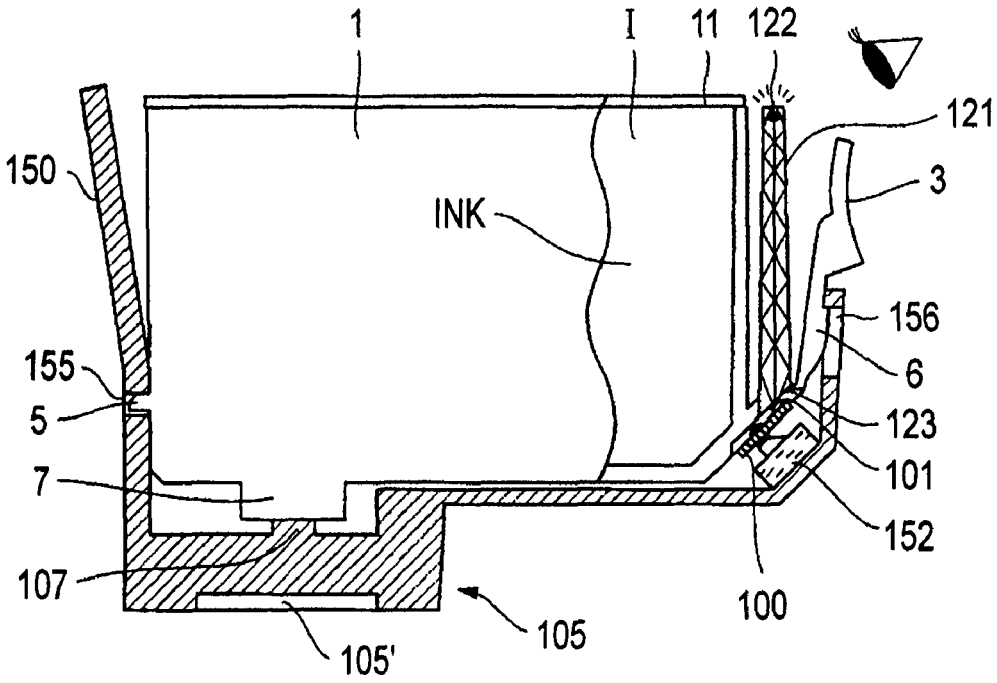
FIG. 5 is a schematic side view illustrating another modified example of the first embodiment.
Figure 8:
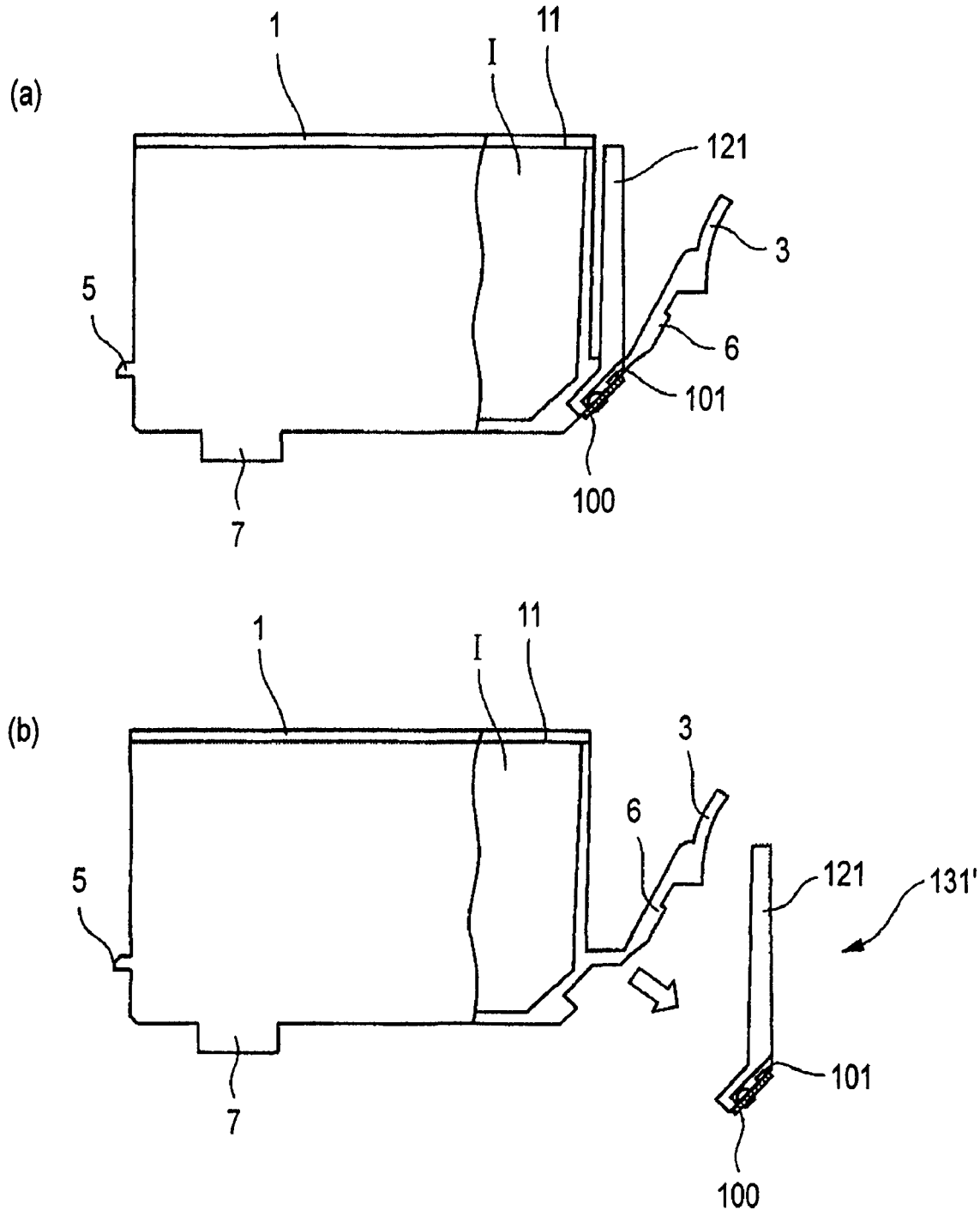
FIG. 8 is a schematic side view ((a) and (b)) illustrating a further modified example of the first embodiment.

FIGS. 3, 5 and 8

The structures described in the foregoing are examples, and proper modification is possible if the emitting portion 101 is used and is able to present the predetermined information relating to the ink container 1 to the recording device and the user. The description will be made as to some modified examples.

FIG. 3 is a schematic side view illustrating a modified example of the first embodiment. In this embodiment, the light guide portion 121' is integral with the front side wall forming the ink reservoir chamber 11. In this modified embodiment, the light quantity reaching the display portion 122 is smaller than in the first embodiment wherein the space is provided between the light guide portion 121 and the ink reservoir chamber 11, but this modified embodiment is usable, if the light quantity is raised. This modified embodiment, is preferable in that ink container is compact and that ink accommodating efficiency is improved.

FIG. 5 is a schematic side view illustrating another modified example of the first embodiment. In this example, the light guide portion 121 is formed by a member which is a separated member from the outer casing of the ink container 1, and then, they are unified. With such an example, proper materials can be selected, respectively. For example, the material of the light guide portion 121 may be polycarbonate material or acrylic material or the like which has refractive indices which are more greatly different from that of the air so that light emitted from the emitting portion can be efficiently guided. On the other hand, as for the material of the outer casing of the ink container 1, polypropylene material having a high suppression effect against evaporation of the ink I in the ink container can be selected. Since they can be produced from different materials, the material of the ink container 1 which is not necessarily transparent can be selected from wider choice.

Figure 6:
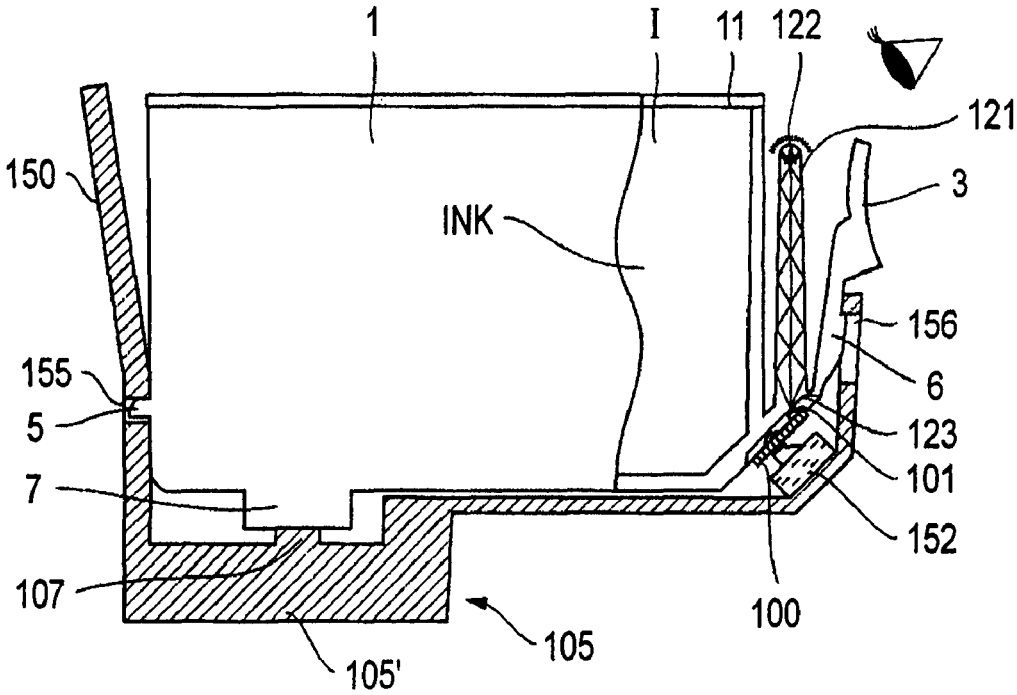
FIG. 6 is a schematic side view illustrating a further modified example of the first embodiment.

FIG. 6 is a schematic side view illustrating another modified example of the first embodiment. In this example, the display portion 122 at the free end of the light guide portion 121 has a substantially semi-spherical configuration, and the light is preferably scattered by surface roughening. With this example, the light ray guided by the light guide portion 121 is scattered by the display portion, and therefore, the light quantity attenuates, but the light can be presented in a wider angle from the display portion. By doing so, the visual angle (range) increases, thus further improving the visualization.

Figure 7:
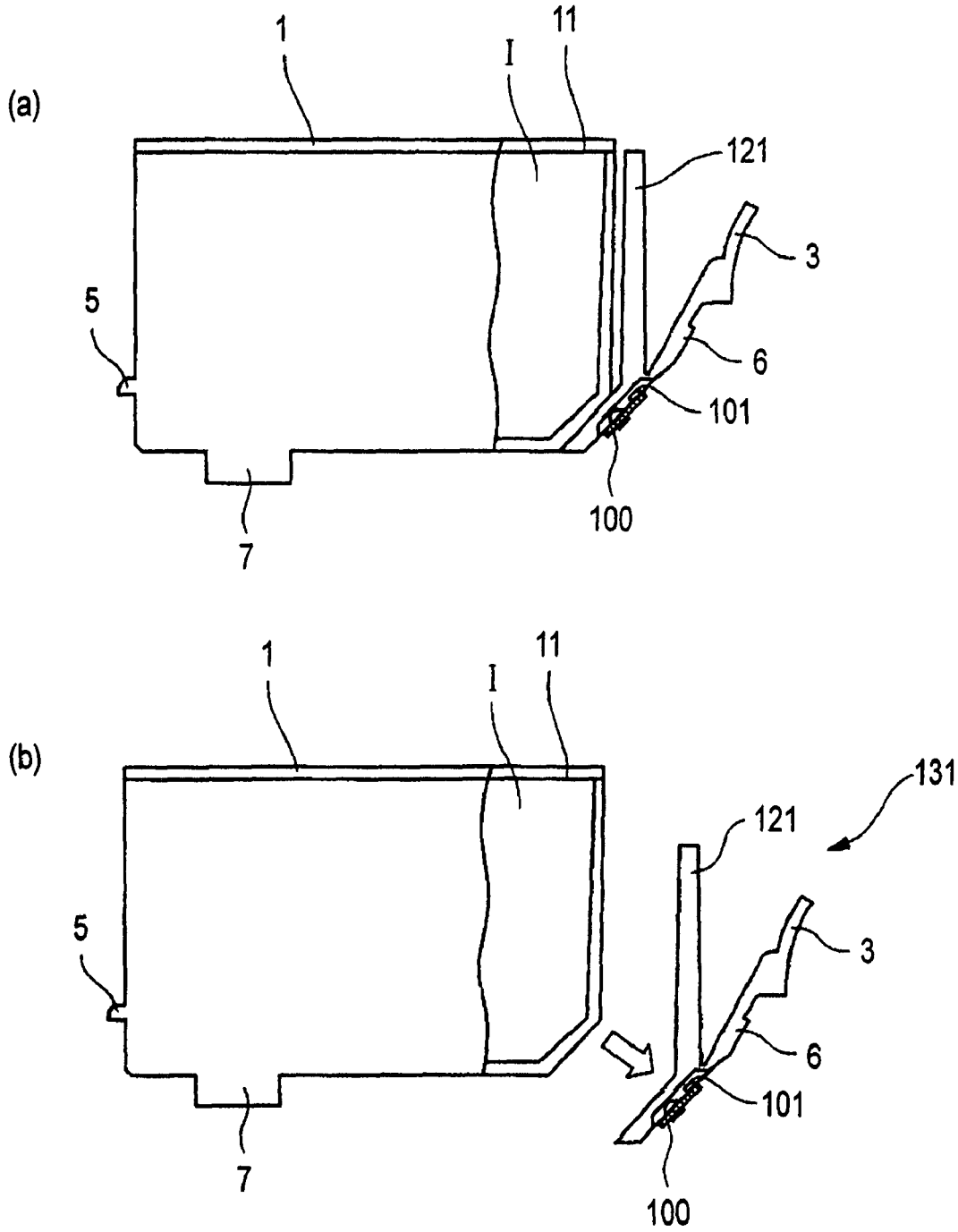
FIG. 7 is a schematic side view ((a) and (b)) illustrating a further modified example of the first embodiment.

FIG. 7 is a schematic side view ((a) and (b)) illustrating a further modified example of the first embodiment. In this example, the light guide portion 121, the supporting member 3 and a portion on which the substrate 100 is adhered are made of an integral member 131, which is a separated member from the member constituting the outer casing of the ink container 1. By doing so, similarly to the example of FIG. 5, suitable materials can be selected to meet the requirements of member constituting the outer casing of the ink container and the member constituting the light guide portion, respectively. As shown in FIG. 7, (*b*), the member 131 to which the substrate 100 is adhered is separable, so that after the ink I in the ink container 1 is all used up, the member 131 may be mounted to a new ink container, that is, it is reused. This reduces the running cost since the substrate 100 and/or the emitting portion 101 which are relatively expensive parts, can be reused.

FIG. 8 is a schematic side view ((a) and (b)) illustrating a further modified example of the first embodiment. In this example, the light guide portion 121 and the portion to which the substrate 100 is adhered are made of an integral member 131', and the member 131' constitutes the outer casing of the ink container 1 and is separate from the member constituting the supporting member 3. By doing so, similarly to the example of FIG. 5, the choices of the material are improved. In FIG. 8, (*b*), the member 131' which integrally has the light guide portion 121 and the portion to which the substrate 100 is adhered is separable, and therefore, they can be reused.

In the first embodiment and the modified example, the air layer is provided between the ink reservoir chamber 11 and the light guide portion 121, so that attenuation of the light incident on the emitting portion 101 is suppressed to accomplish improved visualization. This can be accomplished by interposing another member between the ink reservoir chamber 11 and the light guide portion 121.

Figure 9:
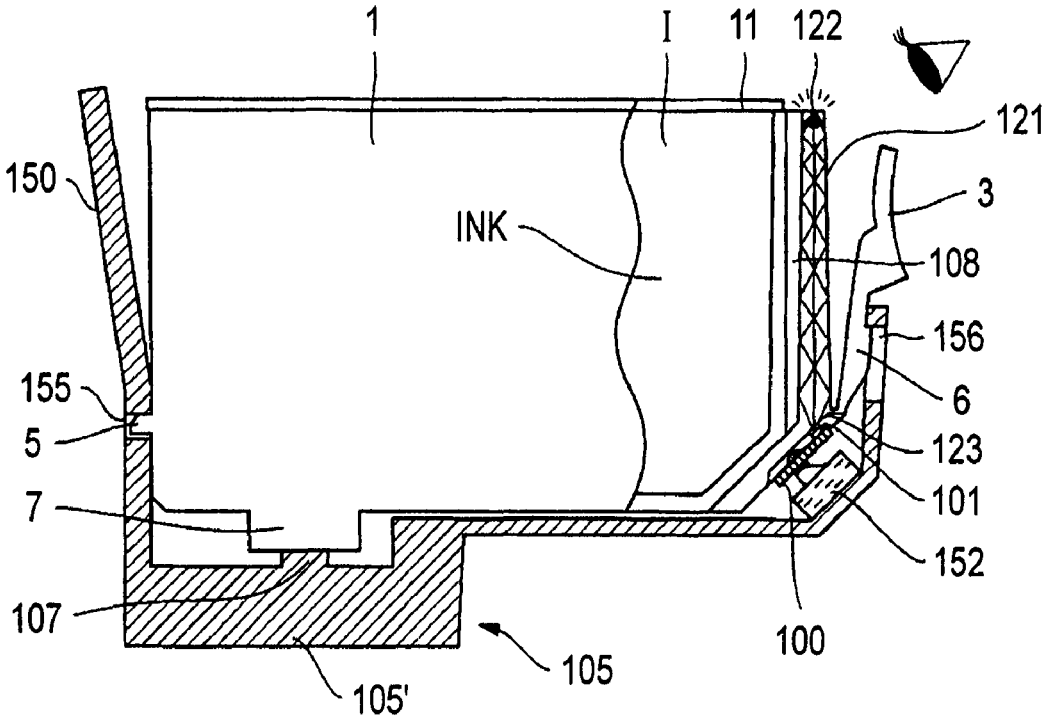
FIG. 9 is a schematic side view illustrating a further modified example of the first embodiment.

FIG. 9 is a schematic side view illustrating a further modified example of the first embodiment. In this example, a low refractive index member 108 having a refractive index which is smaller than that of the light guide portion 121 is interposed between the light guide portion 121 and the front side wall surface of the ink reservoir chamber 11 accommodating the ink I. The light guide portion 121 of this example is a separated member from the ink container 1 and is made of polycarbonate exhibiting high light transmissivity. The low refractive index member 108 is made of polytetrafluoroethylene material.

Here, the refractive index of the polycarbonate is 1.59, and the refractive index of the polytetrafluoroethylene is 1.35. From the Snell law of refraction, the critical refraction angle from the polycarbonate to the polytetrafluoroethylene is approx. 58°, and therefore, the light rays having the incident angles ranging from 58° to 90° reaches the display portion 122 among the light rays emitted from the emitting portion 101.

In this example, the low refractive index member 108 may be replaced with a reflection member made of metal. In the foregoing examples, wherein the use is made with the difference in the refractive index between the materials, the light rays not satisfying the condition of total reflection are transmitted, with the result that total light quantity attenuates more or less. By providing a reflection member, the light rays incident on the incident surface 123 and reaching the reflection member can be substantially completely reflected. By this, the light can be guided efficiently, and the visualization is improved.

Figure 10:
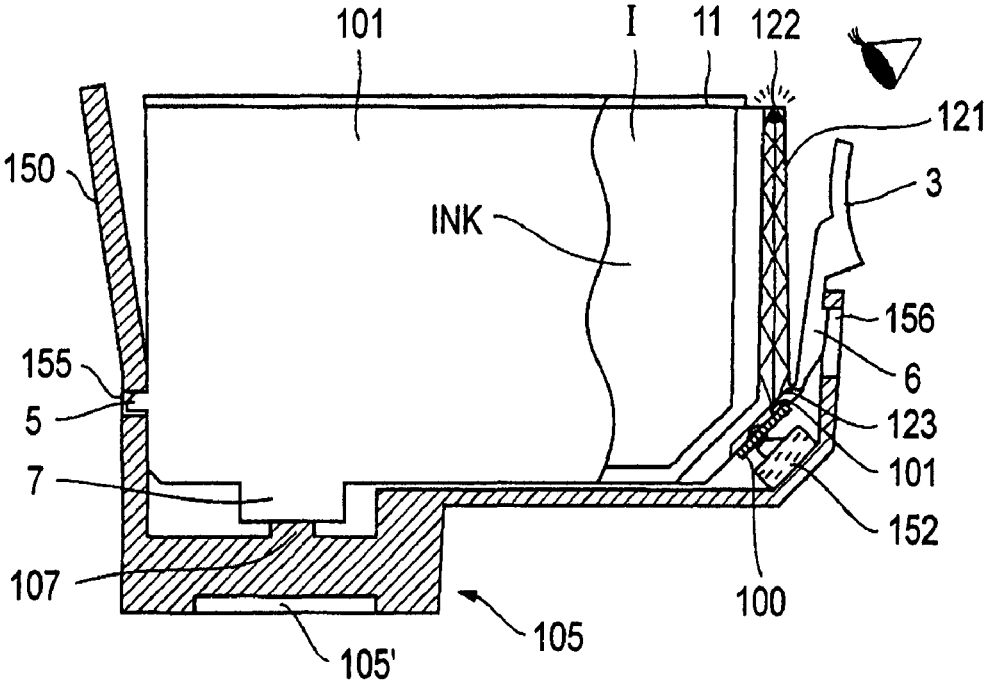
FIG. 10 is a schematic side view illustrating a further modified example of the first embodiment.

FIG. 10 is a schematic side view illustrating a further modified example of the first embodiment. In this example, there is no such member as low refractive index member 108 or the like (FIG. 9) between the light guide portion 121 and the front side wall of the ink reservoir chamber 11 containing the ink I, but they are contacted to each other. However, in this example, the ink reservoir chamber 11 is made of polytetrafluoroethylene material similarly to the low refractive index member 108, and the light guide portion 121 is made of polycarbonate. For this reason, similarly to the example of FIG. 9, the light emitted from the emitting portion 101 can be guided to the display portion 122 with high efficiency.

With such modified examples, the emitting portion and the display portion are separated, and the light guide portion 121 for optical connection between them is provided on the ink container 101, so that emitting portion 142 and the display portion 122 can be placed at respective optimum positions, at low cost and without necessity of wiring for the electric power supply and signal exchange which might deteriorate the operationality and observation. By doing so, thus, the latitude is provided for the disposition of the display portion 122 to meet the user's conveniences, so that user can easily observe the light emission, by which the user can be given predetermined information relative to the ink container 1.

The modified example of the first embodiment is not limited to those described above. The examples can be further modified within the spirit of the present invention by one skilled in the art. For example, in the foregoing examples, the light guide portion is made of resin material, and the difference in the refractive index between the material and the air contacted thereto is used to guide the light. But, an optical fiber comprising a core and a cladding is usable. In place of the solid light guide portion, a hollow member having an inner reflecting surface (stainless steel pipe) is usable.

Two or more of the foregoing examples may be combined. The surface treatment of the display portion 122 described in conjunction with FIG. 6 may be used in the first embodiment or modified examples thereof.

This applies to the second embodiment, the third embodiment and the modified examples thereof which will be described hereinafter.

Figure 11:
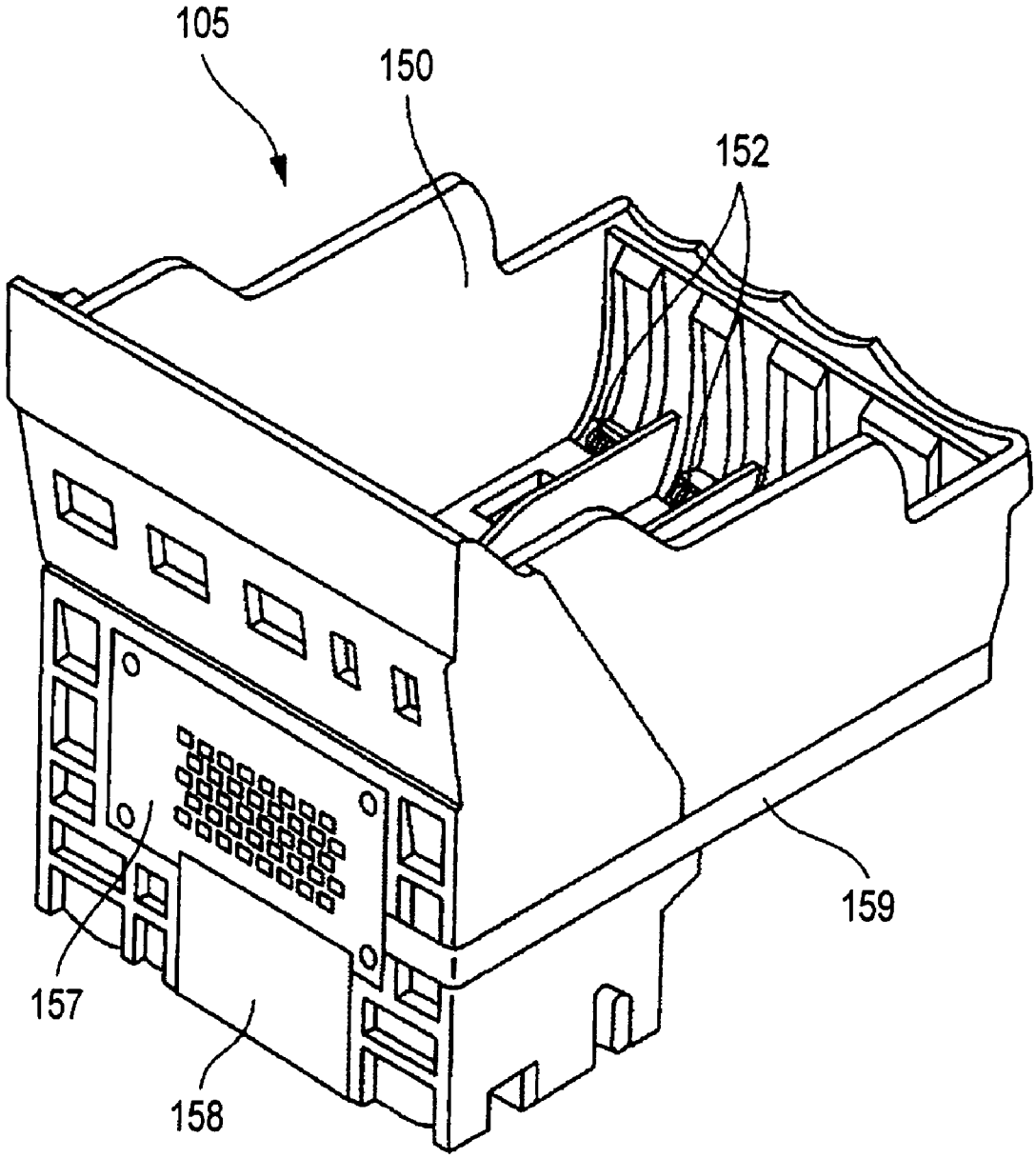
FIG. 11 is a perspective view of an example of a recording head unit to which the ink container according to the first embodiment is detachably mountable.
Figure 12:
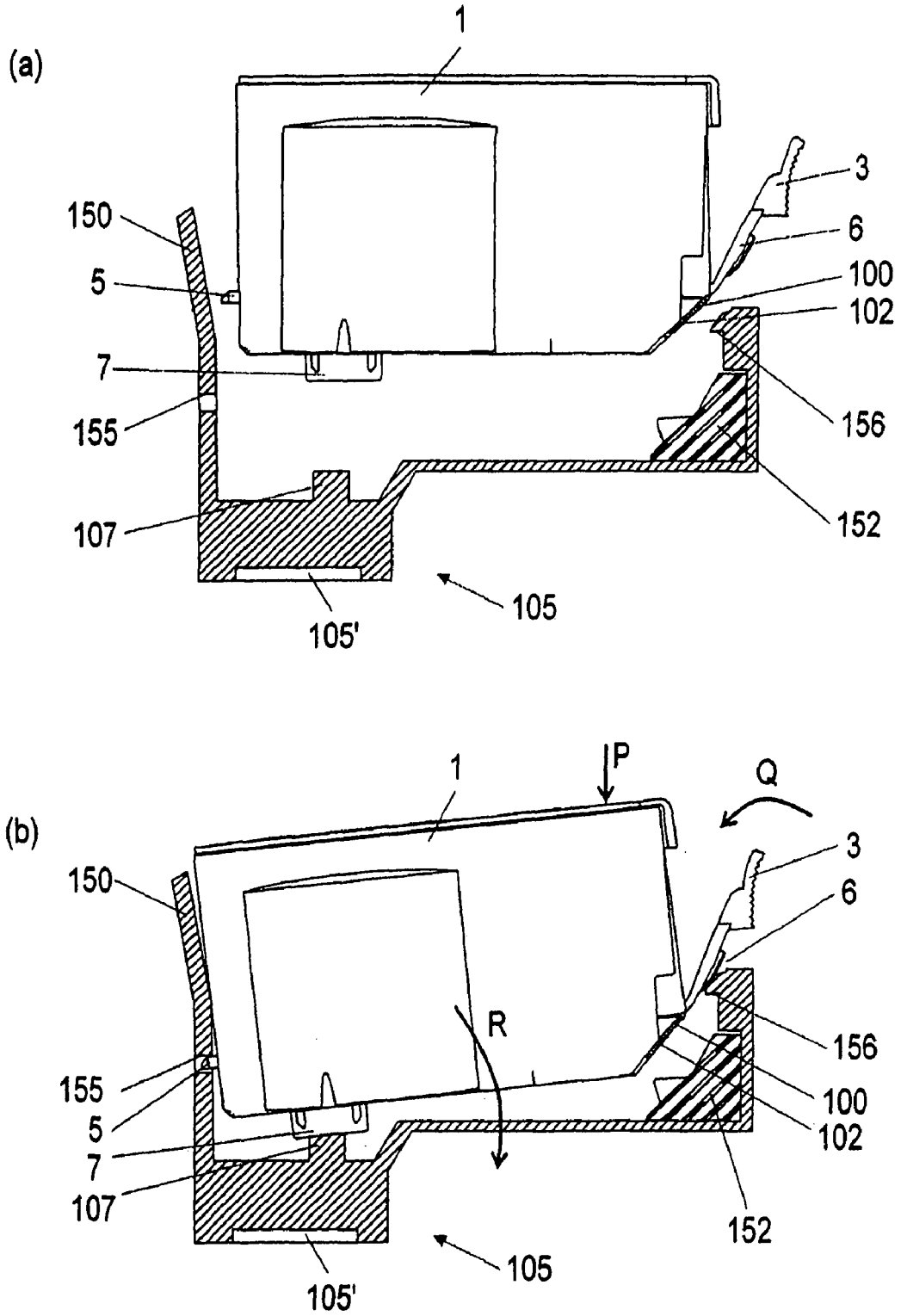
FIG. 12 illustrates mounting operations (a)-(d) of the ink container to the recording head unit.
Figure 12:
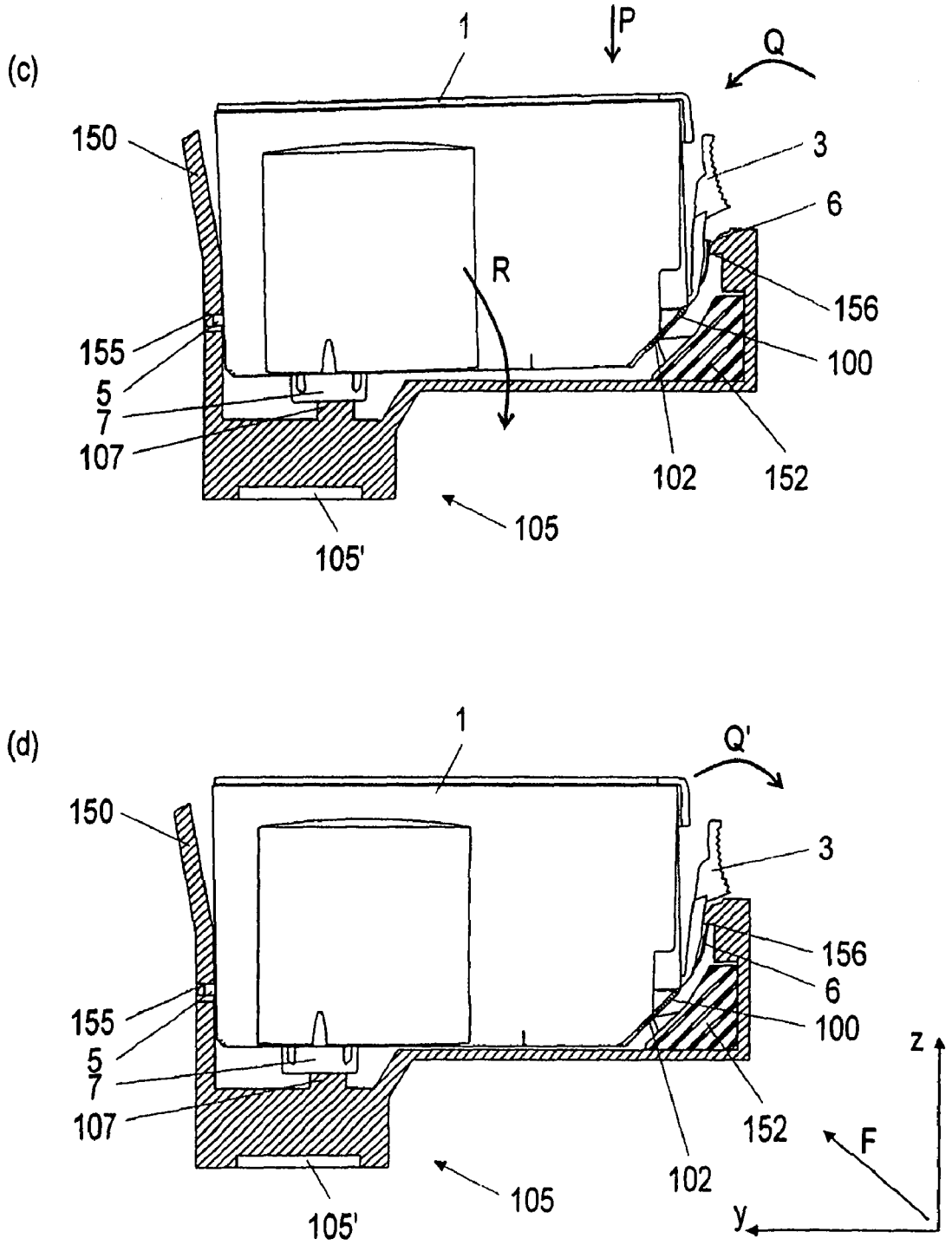
Figure 13:
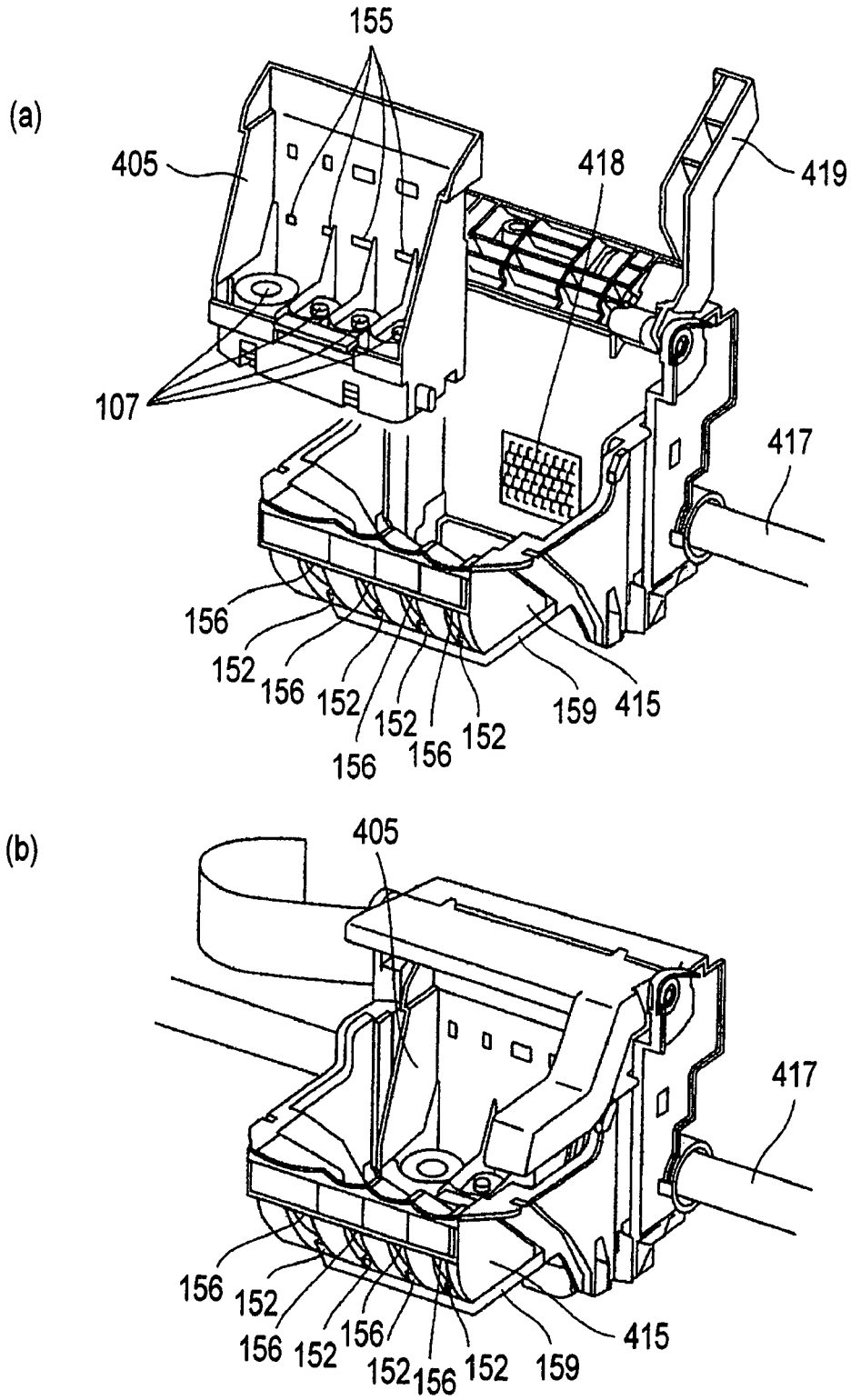
FIG. 13 is a perspective view (a) of a recording head unit for receiving ink from the ink container to effect a recording operation according to another example, and a perspective view of a carriage usable therewith, and a perspective view (b) showing a state in which they are connected with each other.

1.3 Mounting Portion of Ink Container (FIG. 11-FIG. 13)

FIG. 11 is a perspective view illustrating an example of a recording head unit having a holder to which the ink container according to the first embodiment is mountable.

FIG. 7 is a schematic side view illustrating an operation of mounting and demounting (a)-(c) of the ink container according to the first embodiment. The mounting portion described here is applicable to the embodiments which will be described below and modified examples thereof.

The recording head unit 105 is generally constituted by a holder 150 for detachably holding a plurality (four, in the example shown in the Figure) of ink containers, and a recording head 105 disposed adjacent the bottom side (unshown in FIG. 11). By mounting the ink container to the holder 150, an ink introduction opening 107 of the recording head disposed adjacent the bottom portion of the holder is connected with the ink supply port 7 of the ink container to establish an ink fluid communication path therebetween.

An example of usable recording head 105 comprises a liquid passage constituting a nozzle, an electrothermal transducer element provided in the liquid passage. The electrothermal transducer element is supplied with electrical pulses in accordance with recording signals, by which thermal energy is applied to the ink in the liquid passage. This causes a phase change of the ink resulting in bubble generation (boiling), and therefore, abrupt pressure rise, by which the ink is ejected from the nozzle. An electrical contact portion (unshown) for signal transmission provided on the carriage 203 which will be described hereinafter, and an electrical contact portion 157 of the recording head unit 105, are electrically contacted to each other, so that transmission of the recording signal is enabled to the electrothermal transducer element driving circuit of the recording head 105 through the wiring portion 158. From the electrical contact portion 157, a wiring portion 159 is extended to the connector 152.

When the ink container 1 is mounted to the recording head unit 105, the holder 150 is brought to above the holder 150 ((a) in FIG. 12), and a first engaging portion 5 in the form of a projection provided on an ink container rear side is inserted into a first locking portion 155 in the form of a through hole provided in a holder rear side, so that ink container 1 is placed on the inner bottom surface of the holder ((b) of FIG. 12). With this state kept, the front side upper end of the ink container 1 is pressed down as indicated by arrow P, by which the ink container 1 rotates in the direction indicated by the arrow R about the engaging portion between the first engaging portion 5 and the first locking portion 155, so that front side of the ink container displaces downwardly. In the process of this action, the supporting member 3 is displaced in the direction of an arrow Q, while a side surface of a second engaging portion 6 provided in the supporting member 3 on the ink container front side is being pressed to the second locking portion 156 (an upper end edge of the holder front side) provided on the holder front side ((c) of FIG. 12). At this time, the connector 152 of the main assembly side begins to contact the pad 102 provided in the ink container. If the user stops the mounting operation at this stage (that is, the user does not depress the container (in the P direction) any longer), the supporting member 3 is flexed at this time, and therefore, the elastic force of the supporting member 3 per se raises the ink container. By this, the electrical contact is prevented, and the user is notified of the incomplete mounting of the ink container. Thus, the printing operation with incomplete mounting of the ink container can be prevented.

When the upper surface of the second engaging portion 6 reaches below the second locking portion 156 provided below the upper end side edge portion by way of the upper end side edge portion of the holder front side, the supporting member 3 displaces in the direction Q' by the elastic force of the supporting member 3 per se, so that second engaging portion 6 is locked by the second locking portion 156. The structure of the second locking portion 156 is not limited to those described above. The locking portion may be established by providing a space at the upper end side edge portion of the holder front side, and the locking portion may be established by providing the stepped portion as in this embodiment. With this state ((c) in FIG. 15), the second locking portion 156 elastically urges the ink container 1 in a horizontal direction through the supporting member 3, so that rear side of the ink container 1 is abutted to the rear side of the holder 150. The ink container 1 receives a force in the direction z, in (d) of FIG. 12, by the contact between the ink introduction opening 107 of the holder and the absorbing material in the ink supply port 7 of the ink container 1. The upward displacement of the ink container 1 is suppressed by. The first locking portion 155 engaged with the first engaging portion 5 and by the second locking portion 156 engaged with the second engaging portion 6. At this time, the mounting of the ink container 1 in addition completed, wherein the ink supply port 7 is connected with the ink introduction opening 107, and the pad 102 is electrically connected with the connector 152.

The above-described uses the principle of "lever" during the mounting process shown in (c) of FIG. 12, wherein the engaging portion between the first engaging portion 5 and the first locking portion 155 is a fulcrum, and the front side of the ink container 1 is a power point where the force is applied. The connecting portion between the ink supply port 7 and the ink introduction opening 107 is a working point which is located between the power point and the fulcrum, preferably, closer to the fulcrum. Therefore, the ink supply port 7 is pressed against the ink introduction opening 107 with a large force by the rotation of the ink container 1. At the connecting portion, an elastic member such as a filter, an absorbing material, a packing or the like which has a relatively high flexibility is provided to assure an ink communication property to prevent ink leakage there.

Such structure, arrangement and mounting operation are therefore preferable in that such a member is elastically deformed by the relatively large force. When the mounting operation is completed, the first locking portion 155 engaged with the first engaging portion 5 and the second locking portion 156 engaged with the second engaging portion 6 are effective to prevent the ink container 1 from rising away from the holder, and therefore, the restoration of the elastic member is suppressed, so that member is kept in an appropriately deformed elastically.

On the other hand, the pad 102 and the connector 152 (electrical contacts) are made of a relatively rigidity electroconductive material such as metal to assuring satisfy electrical connection property therebetween. On the other hand, an excessive contact force therebetween is not preferable from the standpoint of damage prevention and sufficient durability. In this example, they are disposed at a position as remote as possible from the fulcrum, more particularly, in the neighborhood of the front side of the ink container, in this example, by which the contact force is minimized.

In this example of the embodiment, the substrate 100 is disposed on the inclined surface connecting the bottom side of the ink container 1 with the front side of the ink container 1, namely, at the corner portion therebetween. When the balance of forces only at the contact portion in the state that pad 102 is contacted to the connector 152 immediately before the completion of mounting, is considered, it is such that reaction force (a upward force in the vertical direction) applied by the connector 152 to the pad 102, balancing with the mounting force applied downwardly in the vertical direction, involves a component force of the actual contact pressure between the pad 102 and the connector 152. Therefore, when the user presses the ink container down toward the mounting completion position, an addition of ink container mounting force for electrical connection between the substrate and the connector is small, so that operativity may be quite low.

When the ink container 1 is pressed down toward the mounting completion position where the first engaging portion 5 is engaged with each other, the second engaging portion 6 and the second locking portion 156 are engaged with each other, and there arises a component force (a force sliding the pad 102 on the connector 152) parallel with a surface of the substrate 100 by the urging force. Therefore, a good electrical connection property is provided and assured upon the completion of the mounting of the ink container. In addition, the electrical connecting portion is at a position high from the bottom side of the ink container, and therefore, the liability of the leaked ink reaching there is small. In this embodiment, the ink introduction opening 107 is disposed in the bottom surface of the ink container adjacent the first engaging portion 5, and the pad 102 is disposed at the corner portion the front side away from the first engaging portion, so that user can be protected from the ink at the ink introduction opening 107 during the mounting and demounting manipulation of the ink container.

In this manner, the structure and arrangement of the electrical connecting portion described above is advantageous from the standpoint of the magnitude of the required ink container mounting force, assurance of the electrical contact state and the protection from contamination with the leaked ink.

As described in the foregoing, the ink container can be assuredly mounted at the correct position in the recording device with as simple structure, and the stable electrical connection is assured without influence to the operationality in the ink container mounting by the disposition of the contact pad at the position described above. In addition, the visualization to the user is improved by disposing the display portion which emits the light from the emitting portion to the outside, at the upper part of the front side (the side having the latch lever) of the ink container. Therefore, structure of the present invention is effective to provide various improvement.

The structure of the mounting portion for the ink container in the first embodiment or the modified example is not limited to that shown in FIG. 11.

Figure 16:
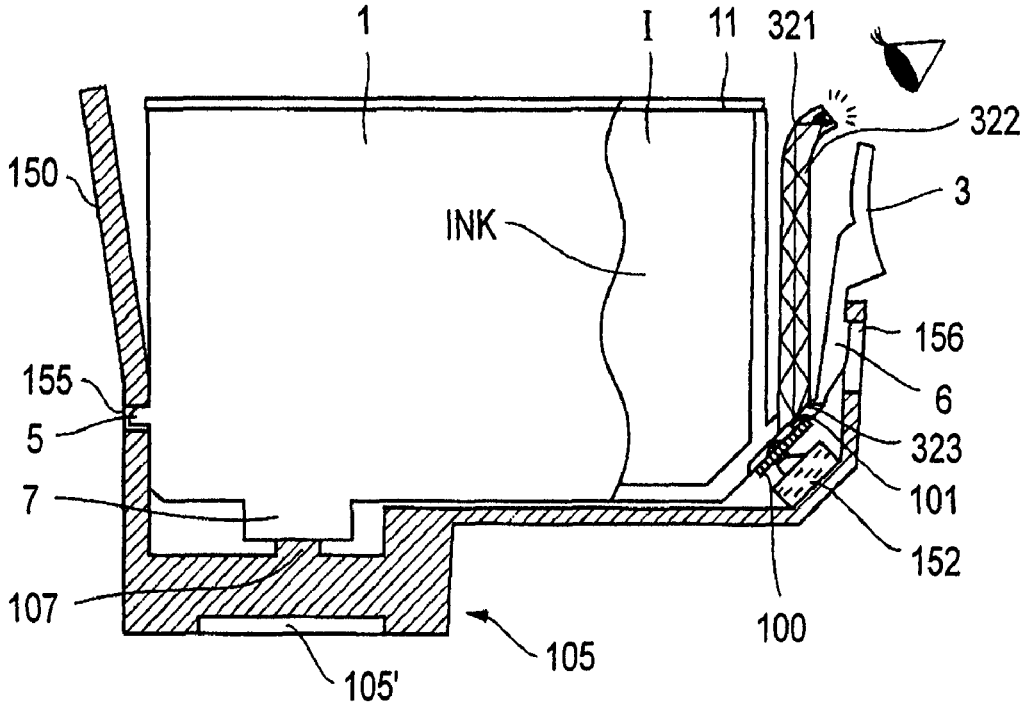
FIG. 16 is a schematic side view illustrating function of the light guide portion provided on the ink container according to the second embodiment of the present invention.

Referring to FIG. 16, the description will be made as to this point. FIG. 13 is a perspective view (a) of a recording head unit for receiving ink from the ink container to effect a recording operation according to another example, and a perspective view of a carriage usable therewith, and a perspective view (b) showing a state in which they are connected with each other.

As shown by (a) in FIG. 13, the recording head unit 405 of this example is different from those (holder 150) described hereinbefore in that it does not have the holder portion corresponding to the ink container front side, the second locking portion or the connector. The recording head unit 405 is similar to the foregoing one in the other respects, the bottom side thereof is provided with an ink introduction opening 107 to be connected with the ink supply port 7. The rear side thereof is provided with the first locking portion 155, and the back side is provided with an electrical contact portion (unshown) for signal transmission.

On the other hand, as shown by (b) in FIG. 13, the carriage 415 is movable along a shaft 417, and is provided with a lever 419 for fixing the recording head unit 405, and an electrical contact portion 418 connected with the electrical contact portion of the recording head. The carriage 415 is also provided with a holder portion corresponding to the structure of the ink container front side. The second locking portion 156, the connector 152 and the wiring portion 159 to the connector, are provided on the carriage side.

With this structure, when the recording head unit 405 is mounted on the carriage 415, as shown by (b) in FIG. 13, the mounting portion for the ink container is established. In this manner, through the mounting operation which is similar to the example of FIG. 15, the connection between the ink supply port 7 and the ink introduction opening 107, and the connection between the pad 102 and the connector 152, are established, and the mounting operation is completed.

Figure 14:
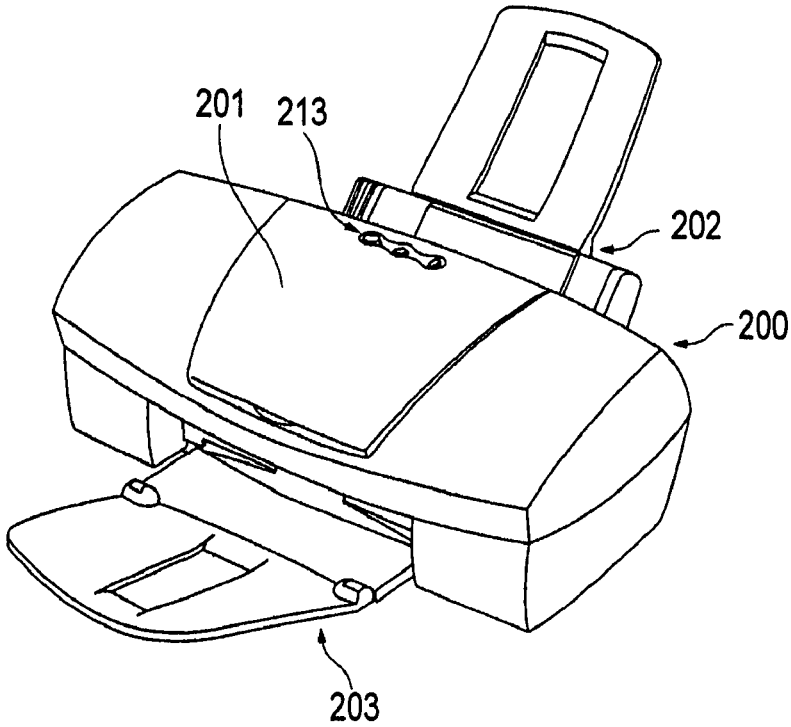
FIG. 14 is a perspective view of an outer appearance of an ink jet printer usable with the ink container.
Figure 15:
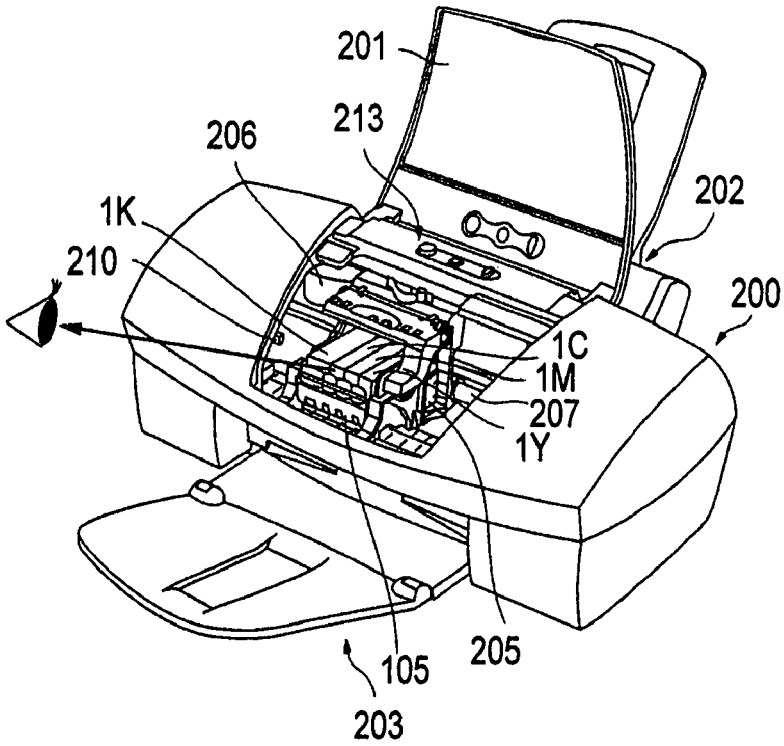
FIG. 15 is a perspective view of the recording device of FIG. 14 with the main assembly cover omitted.

1.4 Recording Apparatus (FIG. 14-FIG. 15)

FIG. 14 shows an outer appearance of an ink Jet printer 200 to which the ink container described in the foregoing. FIG. 15 is a perspective view of the printer in which the main assembly cover 201 of FIG. 14 is open. The recording device is applicable to the embodiments and modified examples which will be described below.

As shown in FIG. 14, the printer 200 of this embodiment comprises a main assembly, a sheet discharge tray 203 at the front side of the main assembly, an automatic sheet feeding device (ASF) 202 at the rear side thereof, a main assembly cover 201, and other case portions which cover major parts including a mechanism for scanningly moving the carriage carrying the recording heads and the ink containers and for effecting the recording during the movement of the carriage. There is also provided an operating panel portion 213 which includes a displaying device which in turn displays states of the printer irrespective of whether the main assembly cover is closed or opened, a main switch, and a reset switch.

As shown in FIG. 15, when the main assembly cover 201 is open, the user can see the movable range, the neighborhood thereof which carries the recording head unit 105 and the ink containers 1K, 1Y, 1M and 1C (the ink containers may be indicated by reference numeral "1" only hereinafter for simplicity). In this embodiment, when the main assembly cover 201 is opened. A sequence operation is carried out so that carriage 205 is automatically comes to the center position ("container exchanging position", shown in the Figure), where the user can do the ink container exchanging operation or the like.

In this embodiment, the recording head (unshown) is in the form of a chip mounted to the recording head unit 105, corresponding to the respective inks. The recording heads scan the recording material by the movement of the carriage 205, during which the recording heads eject the ink to effect the printing. The carriage 205 is capable of slidable engagement with the guiding shaft 207 extending in the moving direction of the carriage 205, and is movable as described above by the carriage motor and the transmission movement mechanism thereof. The recording heads corresponding to the K, Y, M and C (black, yellow, magenta and cyan) inks eject the inks on the basis of ejection data fed from a control circuit provided in the main assembly side through a flexible cable 206. There is provided a paper feeding mechanism including a paper feeding roller, a sheet discharging roller and so on to feed the recording material (unshown) fed from the automatic sheet feeding device 202 to the sheet discharge tray 203. The recording head unit 105 having an integral ink container holder is detachably mounted on the carriage 205, and the respective ink containers 1 are detachably mounted on the recording head unit 105.

During the recording or printing operation, the recording head scan the recording material by the above-described movement, during which the recording heads eject the inks onto the recording material to effect the recording on a width of the recording material corresponding to the range of the array of ejection outlets of the recording head. In a time period between a scanning operation and the next scanning operation, the paper feeding mechanism feeds the recording material through a predetermined distance corresponding to the width. In this manner, the recording is sequentially effected to cover the entire area of the recording material. An end portion of the movement range of the recording head by the movement of the carriage, there is provided an ejection refreshing unit including caps for capping the sides of the recording heads having the ejection outlets. Therefore, the recording heads move to the position of the refreshing unit at predetermined time intervals, and are subjected to the refreshing process including the preliminary ejections or the like.

The recording head unit 105 having a holder portion for each ink container 1, is provided with a connector corresponding to each of the ink containers, and the respective connectors are contacted to the pad of the substrate provided on the ink container 1. By doing so, turning-on and flickering of the respective emitting portions 101 can be controlled in accordance with the predetermined sequence executed by the recording device. Thus, the information relating to the state of the ink container can be notified.

More specifically, after the position of the container exchange, the emitting portion 101 of the ink container 1 containing small amount of the ink is turned on or flickered, and the event can be observed by the user through the light guide portion 121 and the display portion 122. This applies to the respective ink containers 1. In another example of control of the switching of the emitting portion, when the ink container 1 is mounted to the correct position, the emitting portion 101 of the container is lighted on, by which the user can observe the event through the light guide portion 121 and the display portion 122. These controls are executed, similarly to the control for the ink ejection of the recording head, by supplying control data (control signal) to the respective ink containers form the main assembly side control circuit through the flexible cable 206.

The light receiving portion 210 having the light receiving element can be disposed adjacent the end portion which is opposite the position where the above-described refreshing unit is provided. By doing so, the emitting portion 101 is actuated when the display portion 122 of the ink container 1 passes by the light receiving portion while the carriage 205 is moving, and the emitted light can be received by the light receiving portion through the light guide portion 121 and the display portion 122. On the basis of the provision of the carriage 205 when the light is received, it can be discriminated as to whether or not an ink container 1 is mounted and/or whether or not the ink container 1 is mounted at the correct position on the carriage 205. Thus, the display portion 122 not only functions to present the information to the user but also functions to contribute to the detecting operation and the control operation of the recording device. A further preferable Embodiment to accomplish both of them will be described hereinafter in conjunction with a third Embodiment.

2. Second Embodiment

FIG. 16-FIG. 20

In the foregoing Embodiments and classification is, the light guide portion 121 is extended upwardly from the neighborhood of the emitting portion 101 to the display portion 122 which is located at the top end. The description will be made as to examples in which the display portion is located at a position which is more convenient to the user. The same reference numerals as with the foregoing embodiment are assigned to the elements having the corresponding functions, and the detailed descriptions for such elements are omitted for simplicity.

FIG. 16 is a schematic side view illustrating function of the light guide portion provided on the ink container according to the second embodiment of the present invention. In this embodiment, the light is guided from the emitting portion 101 to the display portion 322, and a light guide portion 321 for observation of the user is extended upwardly with an air space provided between the light guide portion 321 and the front side wall surface of the ink reservoir chamber 11 for containing the ink I, and the free end portion is curved so that display portion 322 is directed in an upper-right direction. In this example, the display portion is disposed at the top of the front side of the ink container, that is, the side having the latch lever, as with the foregoing Embodiments, so that it can be easily observed by the user.

With this structure, similarly to the first Embodiment, the light can be extended to the display portion 322 while suppressing the attenuation all the light incident from the emitting portion 101. Moreover, the light guide portion 321 is curved so as to direct the display portion 322 toward upper right in the Figure, the display portion 322 can be easily observed by the user.

Figure 17:
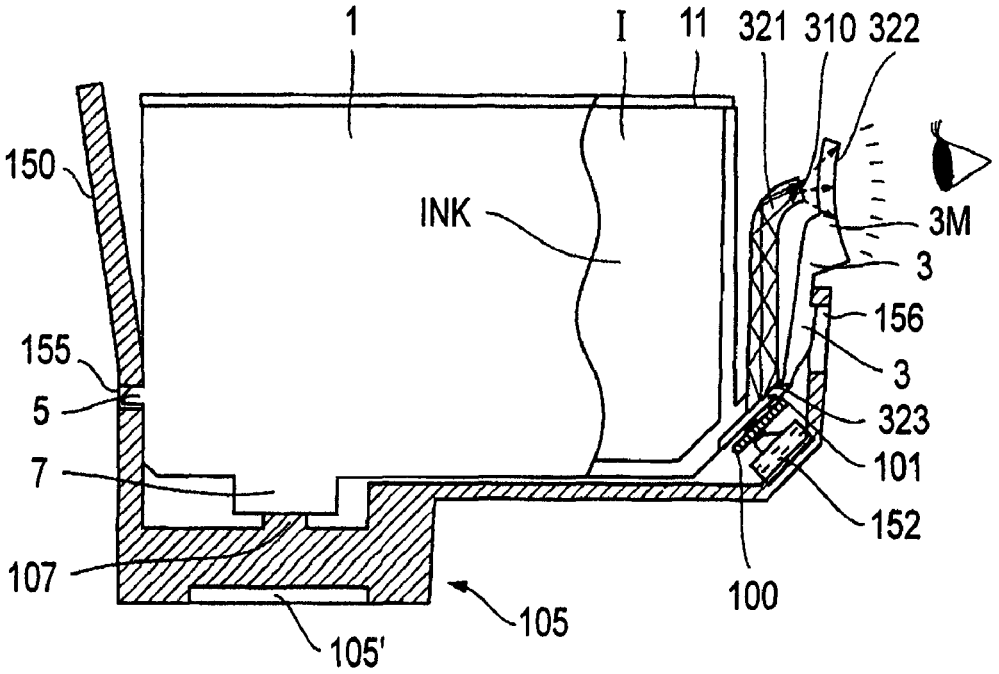
FIG. 17 is a schematic side view of a modified example of FIG. 16.

FIG. 17 is a schematic side view of a modified example of the structure of FIG. 16. In this embodiment, too, the light guide portion 321 is curved, but the high is lower than in FIG. 16, such that end surface 310 is opposed to the back side of the supporting member 3, more particularly, of the operating portion 3M which is the portion to be manipulated by the user. At least the operating portion 3M of the supporting member 3 in this embodiment is constituted by a light transmitting member in this example.

As shown in FIG. 17, in this example, the light emitted from the emitting portion 101 is guided to the end surface 310 by the light guide portion 321, and then the light is directed to the operating portion 3M. By doing so, the operating portion 3M of the supporting member 3 constituted by the light transmitting member is lighted up. In other words, the operating portion 3M per se functions as the display portion for providing user with the information.

This example provides the same advantageous effects as with the first Embodiment. In addition, according to these features example, the operating portion 3M which is to be manipulated by the user is lighted up, therefore, when the user is to be prompted for exchange of the ink container, the object ink container can be to directly recognized, and the portion to be manipulated for the mounting or dismounting of the ink containers can be directly recognized, too. In the order to make the light more visible at the operating portion 3M, the operating portion 3M may be provided with a portion for scattering a proper amount of light.

The structure of bending the optical axis in order to locate the display portion is not limited to curving the light guide portion. The description will be made as to this point.

Figure 18:
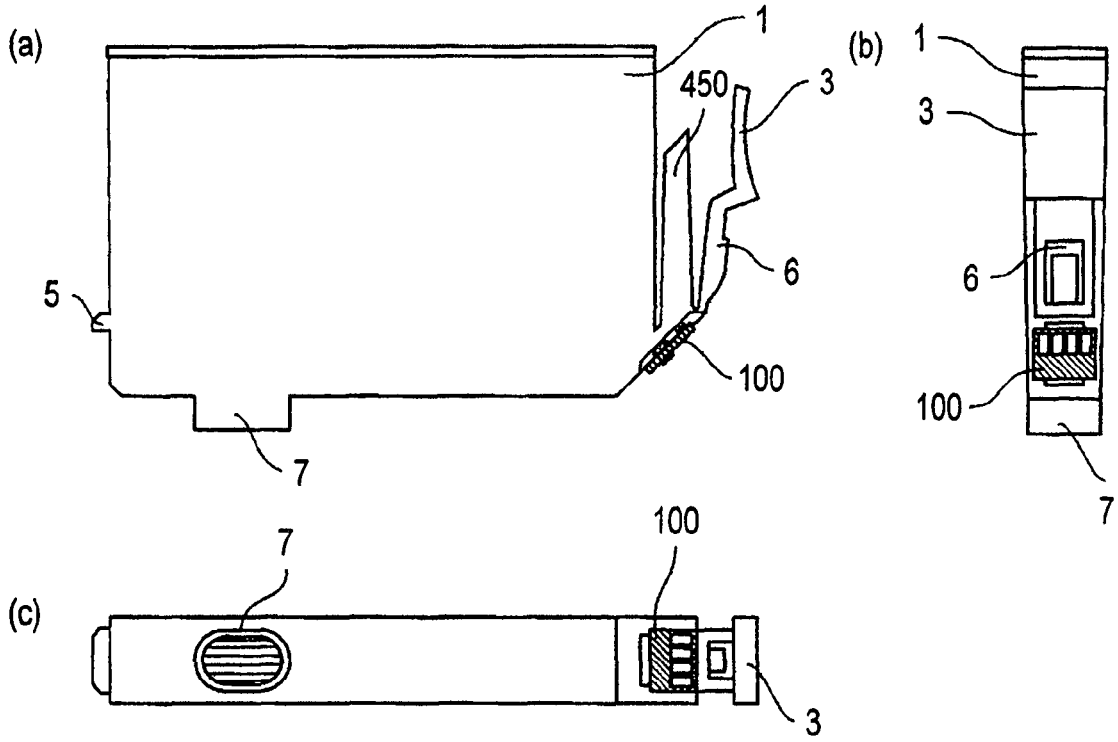
FIG. 18 a side view (a), a front view (b) and a bottom view (c) of an ink container which is a liquid container according to another example of the second embodiment.

FIG. 18 a side view (a), a front view (b) and a bottom view (c) of an ink container which is a liquid container according to another example of the second embodiment. The position from which the light guide portion 450 extends upwardly is substantially the same as with the foregoing examples, but the light guide portion 450 of this example is not curved but is substantially extended straight. An inclined surface 451 is provided at the top end portion. The position of the inclined surface 451 is at the back side of the operating portion 3M of the supporting member 3, and the portion oppose to the back side of the operating portion 3M is high, and the portion opposed to the front side of the ink reservoir chamber 11 is low. Between the light guide portion 450 and the surface of the front side wall of the ink container 1, there is air space. When the light guide portion 450 is integrally molded with the outer casing of the ink container 1, the whole member is constituted by a light transmitting material.

Figure 19:
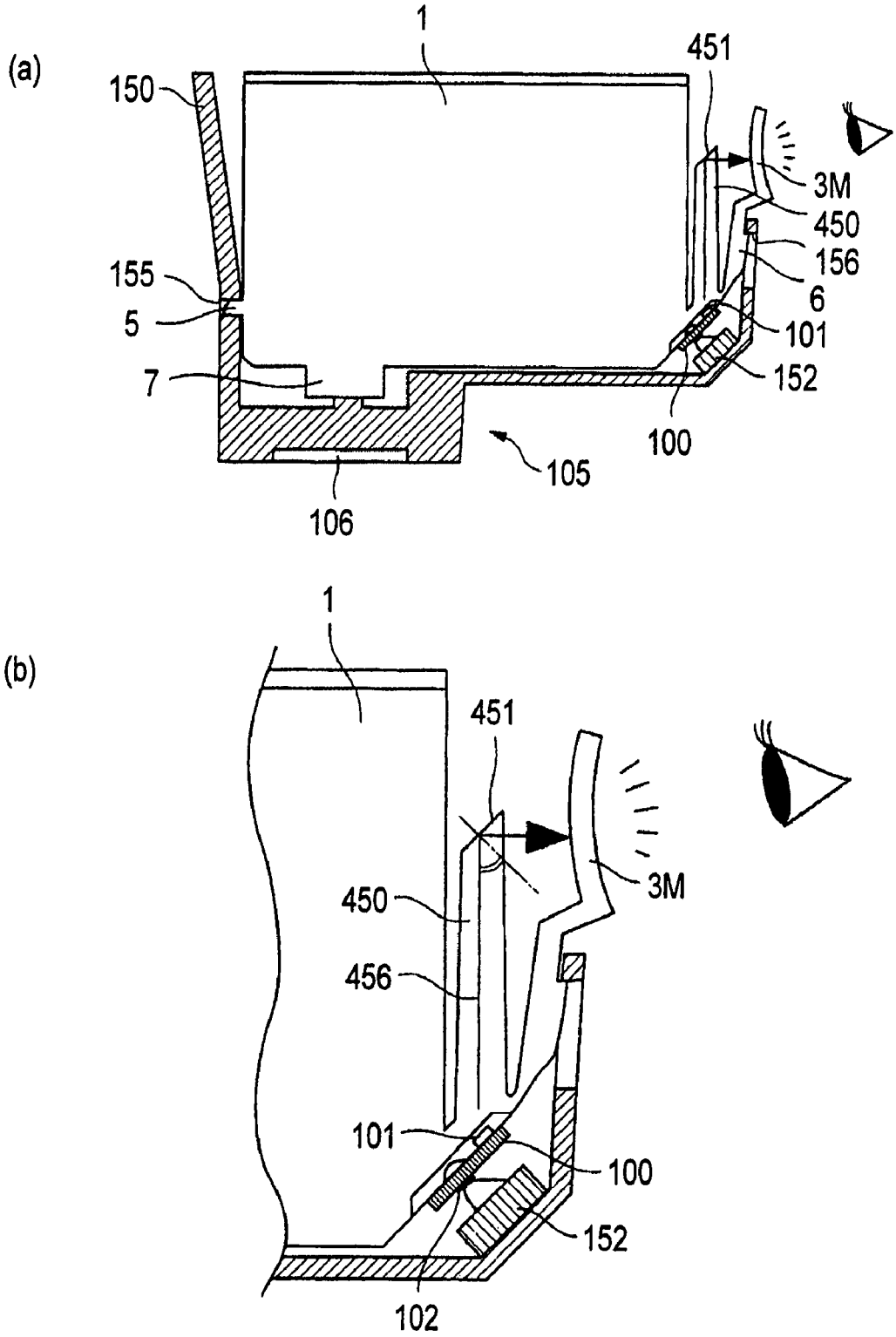
FIG. 19 is a schematic side view (a) and an enlarged view (b) of a major part of the light guide portion to illustrate the function of the light guide portion.

The description will be made as to the structure and the function off the light guide portion 450 of this example. FIG. 19 is a schematic side view (a) and an enlarged view (b) of a major part of the light guide portion to illustrate the function of the light guide portion.

As shown in these Figures, the light guide portion 450 each extended up from the position where the bottom side end surface is opposed to the emitting portion 101. Therefore, when the emitting portion 101 emits the light, the light is guided from the end surface of the bottom side of the light guide portion 450 to the inclined surface 451 at the top end portion, and is reflected by an inclined surface 451 to reach an operating portion 3M. Similarly to the example of FIG. 17, the structure of this example is such that light from the emitting portion 101 disposed at the bottom side of the ink container 1 is guided to the operating portion 3M through the light guide portion 450, and therefore, the user manipulating the operating portion 3M naturally recognizes the predetermined information relating to the ink container 1.

The preferable positional relation among the light guide portion 450, the inclined surface 451 and the emitting portion 101 are as follows. It is preferable from the standpoint of supplying a large amount of light that in order for the light emitted by the emitting portion 101 to be guided to the inclined surface 451 by the light guide portion 450, the emitting portion 101 is opposed to the end surface of the bottom side of the light guide portion 450 and on the projected plane of a cross-section of the light guide portion 450 (perpendicular to the optical axis 456 of the light guide portion 450).

In order for the light reflected by the inclined surface 451 to smoothly reach the operating portion 3M, it is preferable that inclination angle of the inclined surface 451 relative to the optical axis 456 is not less than the critical angle so as to totally reflect the light. For example, the light guide portion 450 which is integrally molded with the ink container 1 is made of polypropylene having a refractive index of 1.49, the total reflection condition is determined by Snell law of refraction as follows (refractive index of the air is 1):

$$1.49 \sin È=1.$$

$$\sin È=1/1.49.$$

È is nearly equal to 43°.

Thus, the inclination angle relative to the optical axis (=incident angle) is not less than 43°. In this embodiment, the inclination angle is 45° to satisfy the condition of the total reflection. By doing so, the light guided by the light guide portion 450 is totally reflected by the inclined surface 451 and is directed to the operating portion 3M, so that visibility is improved.

Figure 20:
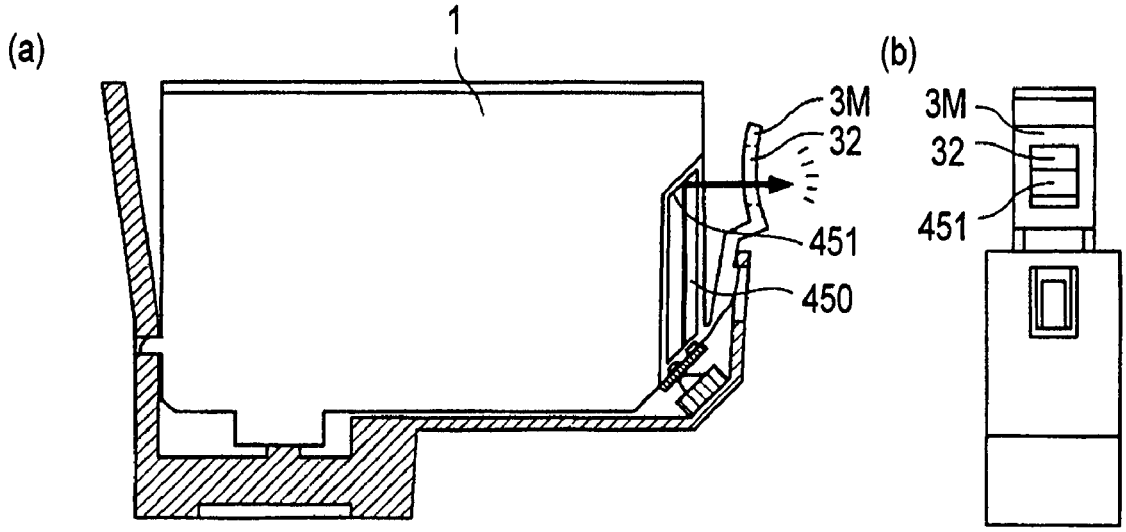
FIG. 20 is a side view (a) and a front view (b) of the side view according to a modified example of the structure of FIG. 18.

FIG. 20 is a side view (a) and a front view (b) of the side view according to a modified example of the structure of FIG. 18. In this example, the light guide portion 450 is provided by a member separate from the ink container 1. According to this example, the ink container 1 and the light guide portion 450 can be made of suitable materials, respectively. In the case that ink container 1 is not made of a light transmitting material, an opening 32 is formed in a part of the operating portion 3M. Through t opening 32, the reflected light from the inclined surface 451 of the light guide portion 450 is received by the users eyes.

In the examples of FIG. 18 and FIG. 20, the inclined surface is so set that angle (incident angle) relative to t optical axis guided by the light guide portion 450 is equal to the angle (reflection angle) of reflection toward the operating portion 3M. Depending on the materials or the like used, they are properly set so as to satisfy t total reflection condition.

In order to efficiently reflect the light, the inclined surface may be constituted by a material exhibiting a high refractive index or a high reflectance, for example, metal foil or the like may be stuck.

Moreover, in another alternative, the operating portion 3M of the supporting member does not function as the display portion, but the light guide portion 450 is extended to a position higher than t operating portion similarly to FIG. 16 example, in which the display portion is provided by the top front portion of the light guide portion 450 adjacent the inclined surface portion.

3. Third Embodiment

FIG. 21-FIG. 27

The user possibly looks at the display portion in various directions depending on the position of the printer or the like, and therefore, it is desirable to emit the light in a wider range from t display portion. On the other hand, the display portion is not only for the user observation but also for the ink container detecting operation the control of the operation of the recording device, and therefore, a light receiving portion 210 is provided in the recording device as shown in FIG. 15.

For example, when the carriage 205 scans relative to t light receiving portion 210, the ink containers and/or the display portion passes by the light receiving portion 210 sequentially. During the passage, it can be checked whether the ink containers are mounted at the correct positions, respectively. More particularly, at the timing when a certain ink container is faced to the light receiving portion 210, the emitting portion of the ink container containing the ink of the color, which container is supposed to be placed at the position facing to the light receiving portion 210, is actuated to light the emitting portion on to emit the light from the display portion. If the light receiving portion 210 receives the light, it is discriminated that ink container is mounted at the correct position, if not, the container is mounted at a wrong position. If the latter is the case, the recording operation is prevented, for example, and prompt the user to open the main assembly cover 201 and remount the ink container at the wrong position by flickering the emitting portion or display portion of the wrongly mounted ink container. By doing so, the inconveniences that color reproduction is not proper because of the erroneous mounting of the ink container or containers, and the inconveniences that no warning is provided for the ink container in which the ink is short, and a warning is erroneously provided for the ink container containing a sufficient amount of the ink.

The light receiving portion 210 used for such ink container detection or control is fixed in the apparatus, while the ink container is carried on the carriage and reciprocated, and therefore, the positional relation relative to the display portion of the ink container is constant during the detecting operation. For this reason, it is preferable that display portion emits the light within a small range as long as the mounting tolerance of the light receiving portion in the recording device permitted, so that density of the light quantity directed to the light receiving portion is maintained sufficiently high, as contrasted to the standpoint of observation by the user.

Thus, the display portion is required to satisfy the contradictory functions. The description will be made as to the embodiment which is intended to meet the contradictory requirements.

Figure 21:
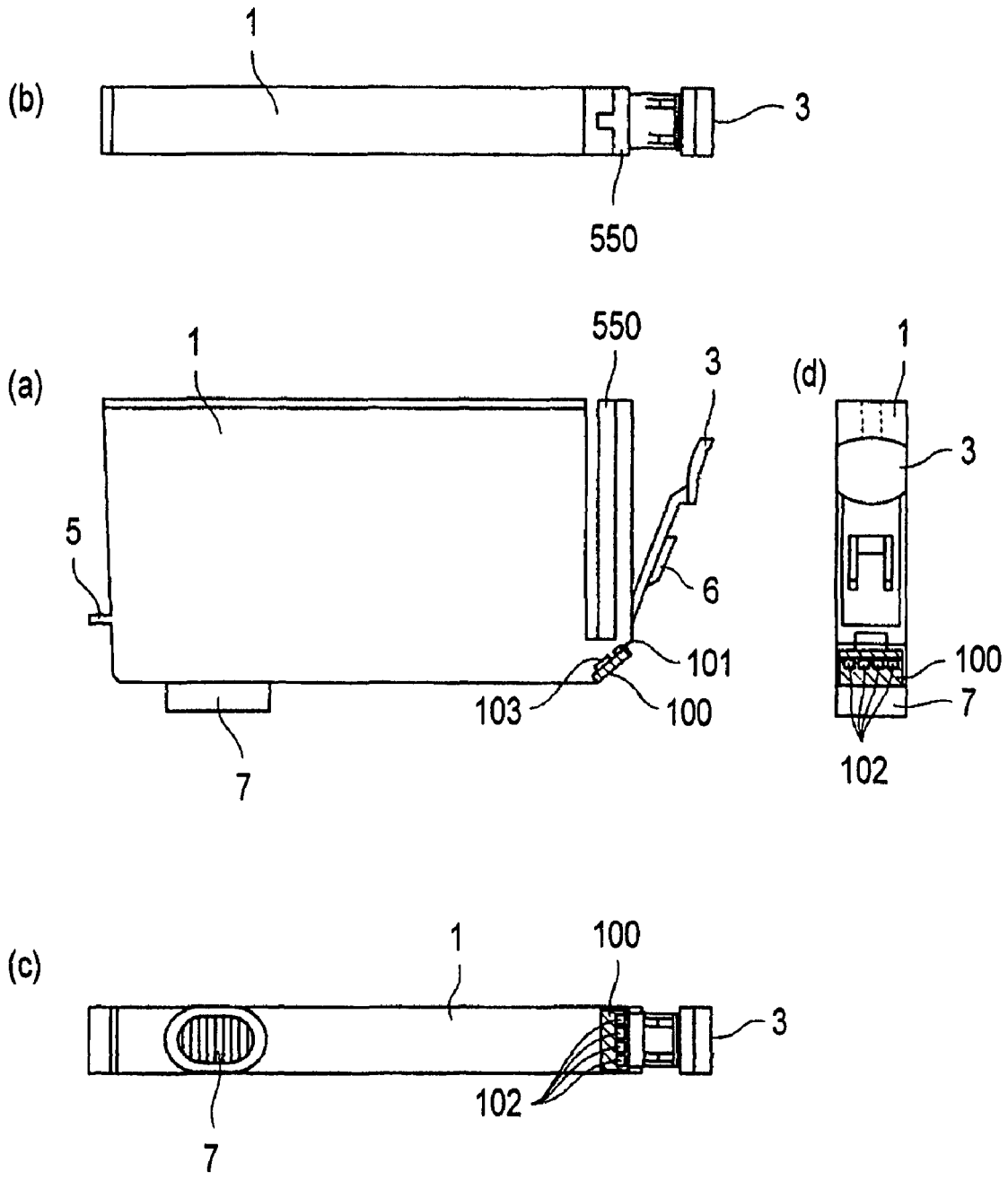
FIG. 21 is a side view (a), a top plan view (b), a bottom view (c) and a front view (d) of an ink container which is a liquid container according to a third embodiment of the present invention.

FIG. 21 is a side view (a), a top plan view (b), a bottom view (c) and a front view (d) of an ink container which is a liquid container according to a third embodiment of the present invention. In these Figures, designated by 550 is a light guide portion (light guide rib). Similarly to the foregoing embodiment, an end surface of the bottom side is erected from a position facing the emitting portion 101.

Figure 22:
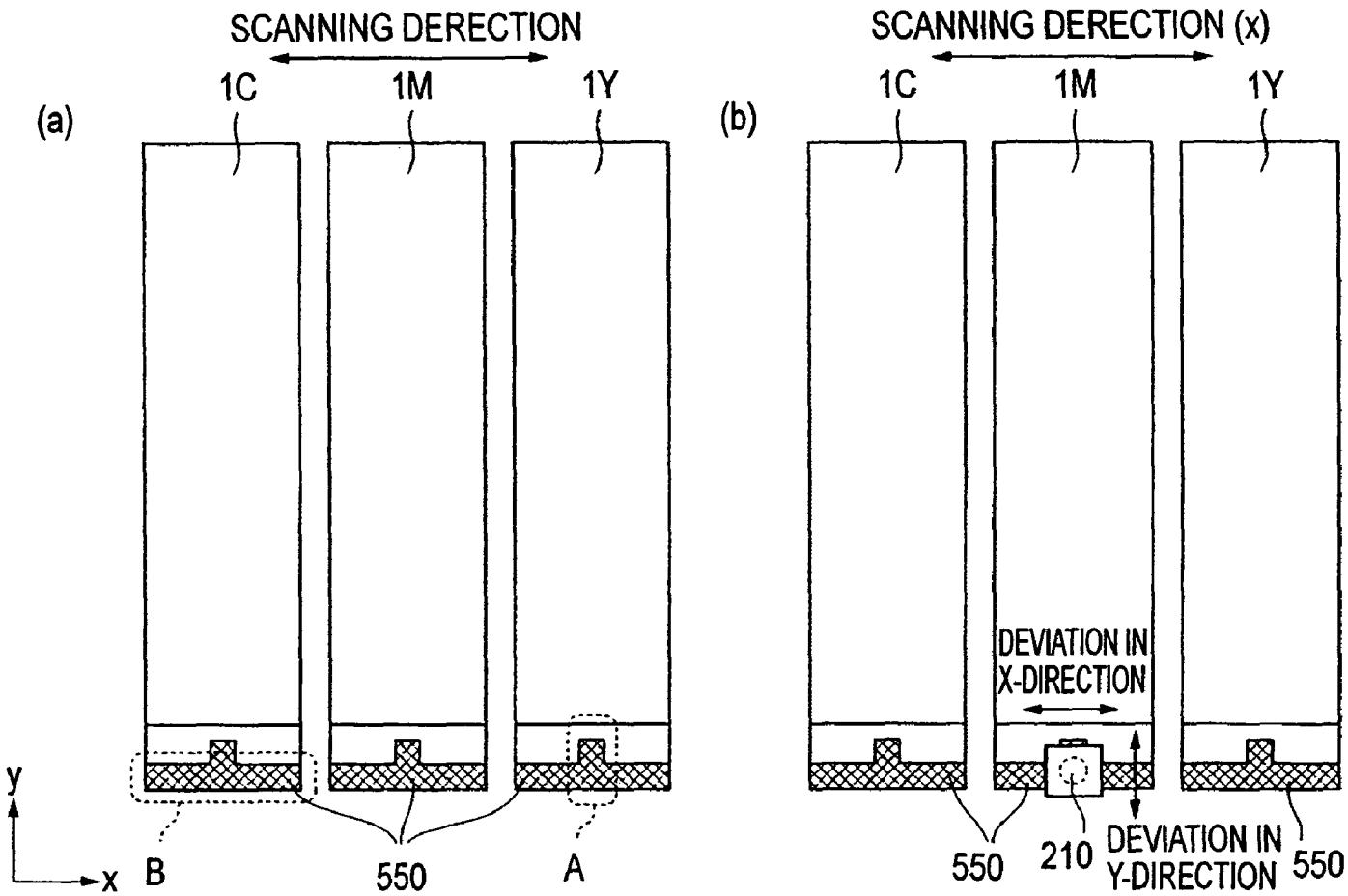
FIG. 22 is a schematic top plan view (a) of a recording device on which a plurality of ink container 1 shown in FIG. 21 are carried, and a schematic view (b) illustrating the ink containers facing the light receiving portion provided at a lower position of the printer, while the carriage is moving.
Figure 23:
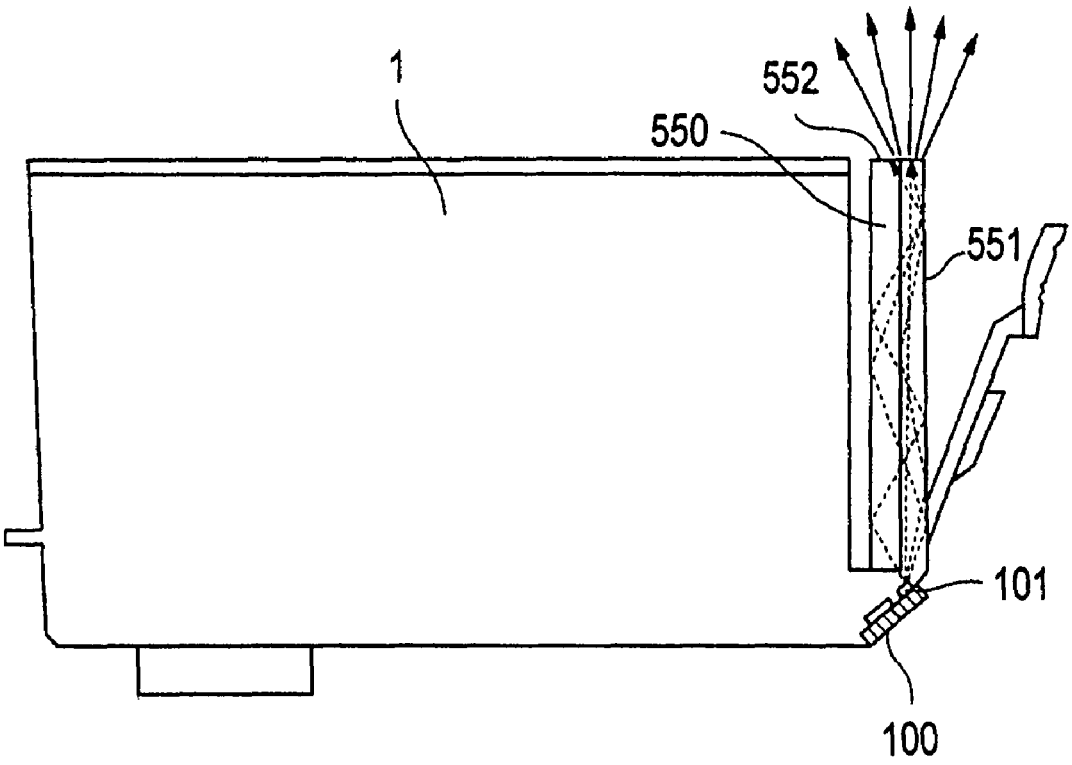
FIG. 23 a schematic side view illustrating functions of a light guide portion of an ink container described in FIG. 22.

Referring to FIG. 22 and FIG. 23, the configuration and the function of the light guide member of the embodiment will be described.

FIG. 22 is a schematic top plan view (a) of a recording device on which a plurality of ink container 1 shown in FIG. 21 are carried, and a schematic view (b) illustrating the ink containers facing the light receiving portion provided at a lower position of the printer, while the carriage is moving, wherein a cyan container 1C, a magenta container 1M and a yellow container 1Y are particularly noted. The ink containers are juxtaposed in t widthwise direction of the ink container, namely, in the moving direction (scanning direction) of the moving direction or the carriage 205. In (b) of FIG. 22, the plurality of ink containers are faced to the bottom of the light receiving portion 210 (FIG. 15) disposed in the printer, by movement of the carriage. The light guide portion 550 has a substantially T-shaped cross-section as seen from the top (perpendicular to the sheet of the drawing), wherein the T-shaped portion includes a portion (portion B) extending in the scanning direction (left-right direction, x direction in the Figure), and a portion (portion A) projected from a central portion of the portion B in a direction perpendicular to the scanning direction (vertical direction, y direction in the Figure). The light guide portion of this example is in the form of a rod having a T-shaped cross-section.

FIG. 23 a schematic side view illustrating functions of a light guide portion of an ink container described in FIG. 22. This Figure shows the state in which the light emitted by the emitting portion 101 is incident on the light guide portion 550, and guided in the light guide portion 550 to reach the top end portion 552 of the light guide portion, where the light is emergent to the outside, as indicated by arrows 511. In this example, emitting portion 101 is disposed at a position facing to an intersection between the portion An and the portion B of the T-shaped cross-section at the end of the bottom side of the light guide portion 550, and t light emitted by the emitting portion 101 is directed to the portion An and the portion B of the light guide portion 550.

Here, a relative positional relation of the light receiving portion 210 fixed in the recording device relative to the ink container may vary due to the assembling tolerance of the mounting of the light receiving portion 210. More particularly, referring to FIG. 22, (*b*), the deviations may arise in the carriage scanning direction (x direction), a perpendicular direction (y direction) perpendicular thereto, and the direction perpendicular to the sheet of the drawing of this Figure (z direction). According to this embodiment, the configuration of the light guide portion 550 permits the deviations in such directions and still permits correct ink container detecting operation for discriminating the properness of the state of the mounting of the ink containers and the properness of the mounting positions thereto.

The deviation in the z direction is influential to the change in the distance from the top end portion 552 to the light receiving portion 210 and therefore influential to the detected intensity of the light from the top end portion 552. However, an appropriate threshold setting can be set to permit the change in the light quantity within the range of the tolerance, so that deviation of the light receiving portion 210 in the z direction is not a problem in the ink container detecting operation.

The deviation in the x direction is acceptable by the light receiving portion 210 continuously receiving the light emergent at the top end portion 552 while scanning the carriage with the emitting portion 101 of the ink container 1 emitting the light. More particularly, even if there is a deviation of the light receiving portion in the x direction, the light emission and the light reception are carried out within the range into which the deviation is taken into account, by which the ink container detecting operation can be properly carried out. The portion An is effective to provide a maximum value (peak value) in a curve of change of the received light quantity of the light receiving portion 210. Therefore, it is possible that in consideration of the point of time of the detection of the peak, the subsequent light emission timing of the emitting portion 101 for the detecting operation may be adjusted, by which the deviation in the x direction is compensated for, in effect.

Furthermore, if the portion A has a length in the y direction, which is not less than the position tolerance range of the light receiving portion 210 mounting in the y direction, the light from the top end portion 552 can be received. By doing so, the deviation of the light receiving portion 210 in the y direction is accepted to such an extent that ink container detecting operation can be carried out correctly. With the decrease of the length of the portion A, the density of the light emergent from the end of the light guide portion 550 increases, so that light quantity received by the light receiving portion 210 increases. By this, the influence of external disturbance is minimized to assure the ink container detecting operation. Thus, the length of the portion A can be properly selected in consideration of the mounting position tolerance of the light receiving portion 210 and the preferable light quantity received by the light receiving portion 210.

On the other hand, top end portion 552 of the light guide portion (display portion) is lighted on or flickered upon shortage of the ink container, for example, and is observed by the user. Therefore, the emergent region is desirably so wide that user can look at it from various positions at various angles. The above-described portion An is effective to permit proper detecting operation of the light receiving portion by selecting the dimension and the configuration. On the other hand, the portion B can provide a sufficiently wide emergent region of the light by selecting the dimension and the configuration. The top end portion 552 of the light guide portion 550 extends also in the widthwise direction of the ink container 1 so that light can be emergent widely in the widthwise direction. By this, the visible area is increased.

In this example, the light guide portion has a T-shaped cross-section. But, this is not limiting, and the configuration of the light guide portion may be different if the configuration and the dimension are so selected that emergent light at t top end portion 552 is enough. The top end portion may be other than the T-shaped.

Figure 24:
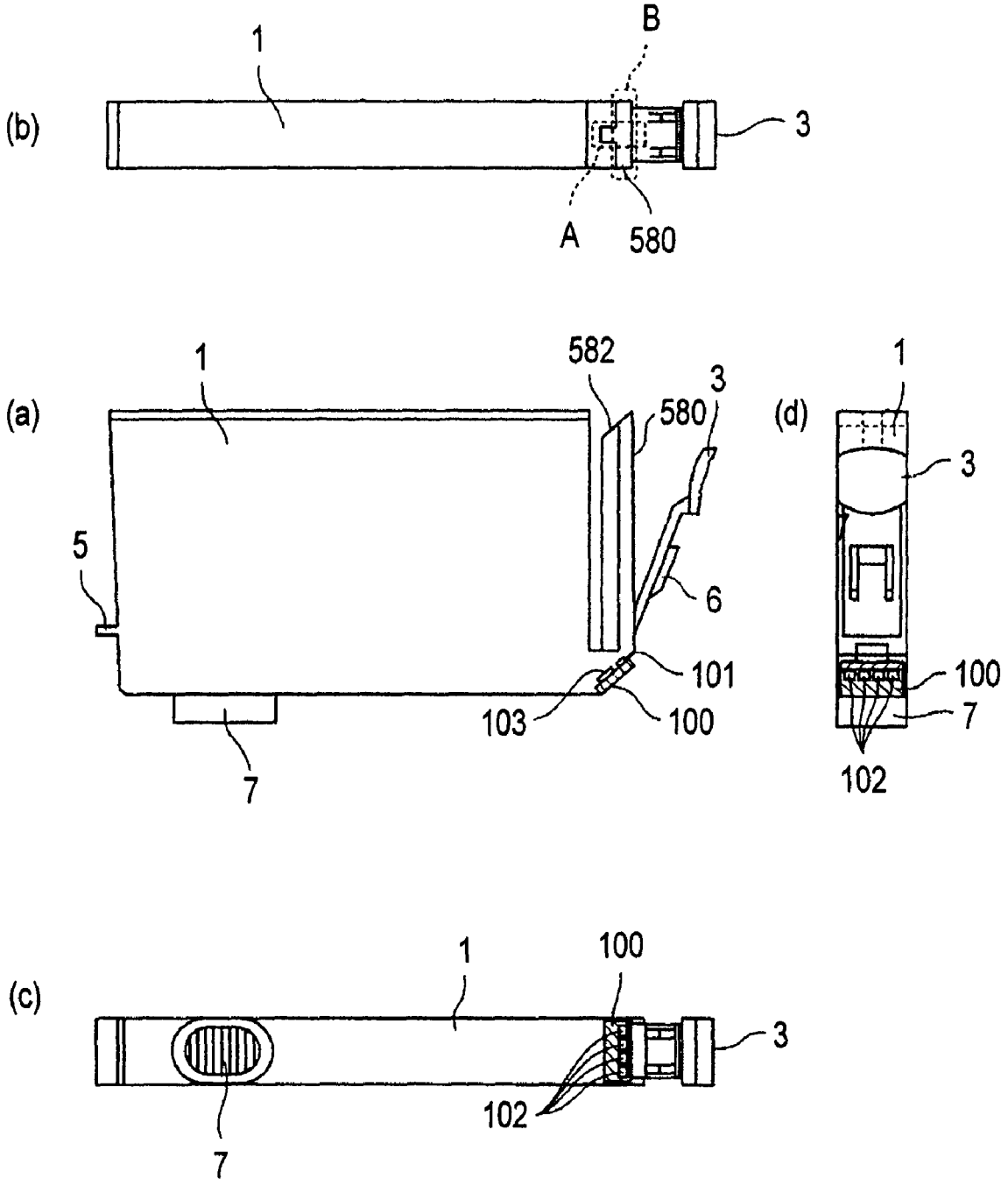
FIG. 24 is a side view (a), a top plan view (b), a bottom view (c) and a front view (d) of an ink container which is a modified example of the embodiment of FIG. 21.
Figure 25:
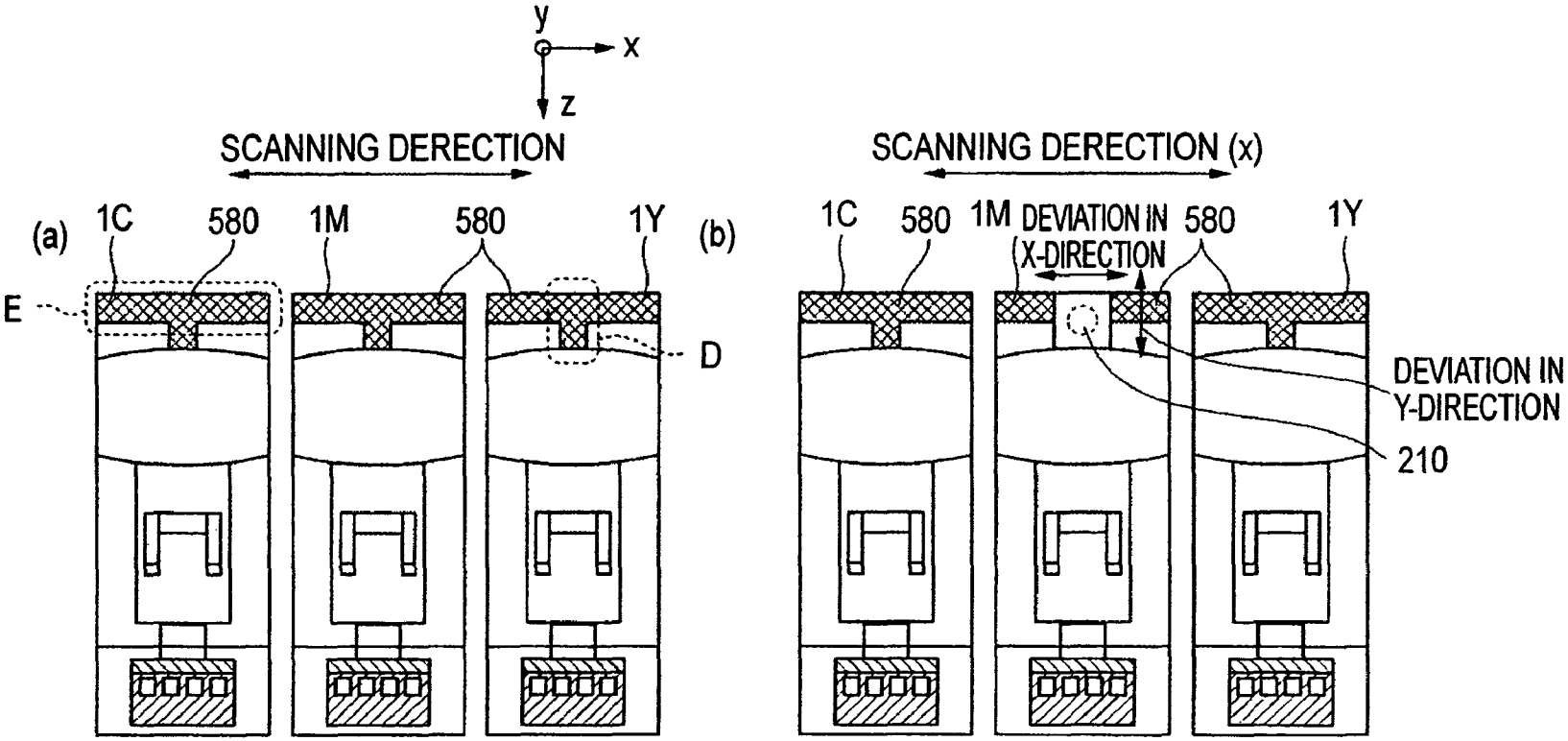
FIG. 25 is a schematic front view (a) of a recording device which carries a plurality of ink containers 1 shown in FIG. 24, and a schematic view (b) illustrating the ink containers facing the light receiving portion provided at a lower position of the printer, while the carriage is moving.
Figure 26:
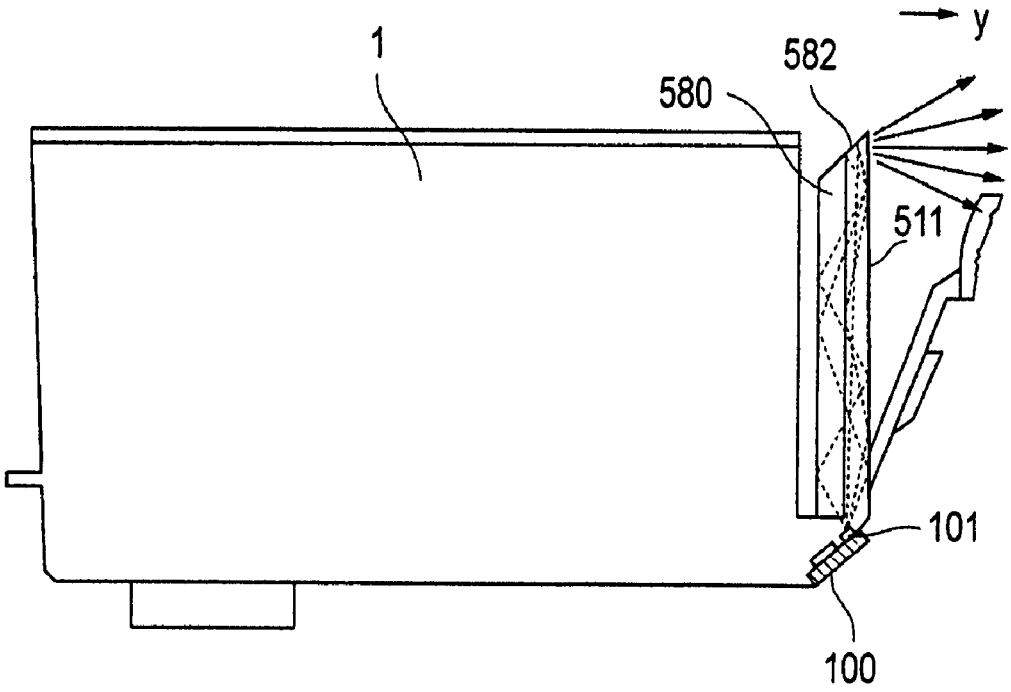
FIG. 26 is a schematic side view illustrating behavior of the beam from the incidence onto the light guide portion to the emergence from the light guide portion shown in FIG. 24, (*a*).

FIG. 24 is a schematic top plan view illustrating another example of a configuration of the light guide portion. FIG. 25 is a schematic front view (a) of a recording device which carries a plurality of ink containers 1 shown in FIG. 24, and a schematic view (b) illustrating the ink containers facing the light receiving portion provided at a lower position of the printer, while the carriage is moving. FIG. 26 is a schematic side view illustrating behavior of the beam for incidence onto the light guide portion to the emergence with the light guide portion shown in FIG. 24, (*a*).

The configuration of the light guide portion 580, similarly to FIG. 22, has a substantially T-shaped cross-section as seen from the top, wherein the T-shaped portion includes a portion (portion B) extending in the scanning direction and a portion (portion A) projected from a central portion of the portion B in a direction perpendicular to the scanning direction. The light guide portion 580 has an inclined surface 582 similar to example of FIG. 18, and in FIG. 25, (*a*), the light guide portion 580 is cut by the inclined surface 582. The configuration is substantially T-shaped constituted by a portion E extending in the scanning direction (x direction) as seen from the front, and a portion D extending therefrom in a direction perpendicular thereto (vertical direction in (a) of FIG. 25, z direction).

In FIG. 26, the light emitted by the emitting portion 101 is incident on the light guide portion 580, is guided in t light guide portion 580, is reflected by the inclined surface 582, and is emergent at the front of the front side of the ink container (righthand side in FIG. 26). The inclination angle of the inclined surface 582, similarly to the foregoing, is set not less than critical angle to provide the total reflection of the light guided by the light guide portion 580. If the light guide portion 580 is formed by polypropylene material, for example, it may be approximately 45°. As an alternative, in order to efficiently reflect the light, the inclined surface may be constituted by a member exhibiting a high refractive index or a high reflectance. For example, metal foil or the like may be stuck on the inclined surface 582.

In this example, the light receiving portion 210 is disposed such that emergent light is received at the front side (y direction) not at the upper part (z direction) of the ink container. In such a case, the deviations of the light receiving portion 210 arise in the x, y and z directions, similarly to the foregoing. According to this example, too, the configuration of the light guide portion 550 permits the deviations in such directions and still permits correct ink container detecting operation for discriminating the properness of the state of the mounting of the ink containers and the properness of the mounting positions thereto.

Here, the deviation in the y direction corresponds to the deviation in the z direction in the foregoing example, and is influential to the change in the distance from the emergent position of the light to the light receiving portion 210, but the deviation is acceptable by an appropriate threshold setting to permit the change in the light quantity so that correct ink container detecting operation is accomplished.

The deviation in the x direction is the same as the deviation in the x direction, and can be accepted by the light receiving portion 210 continuously receiving the light of the top end portion 552 while scanningly moving the carriage with the emitting portion 101 of the ink container 1 emitting the light.

Furthermore, the deviation in the z direction corresponds the deviation in the y direction in the foregoing example. If the length of the portion D measured in the z direction as seen from t front side, is not less than the mounting position tolerance range of the light receiving portion 210 in the z direction, the light from the top end portion 582 can be received, so that mounting of the light receiving portion 210 in the z direction is acceptable, and the positive ink container detecting operation is accomplished.

Similarly to the foregoing example, the dimension, configuration and or the like of the respective portions D, E can be determined in consideration of the operation of the light receiving portion and the user's observation.

Figure 27:
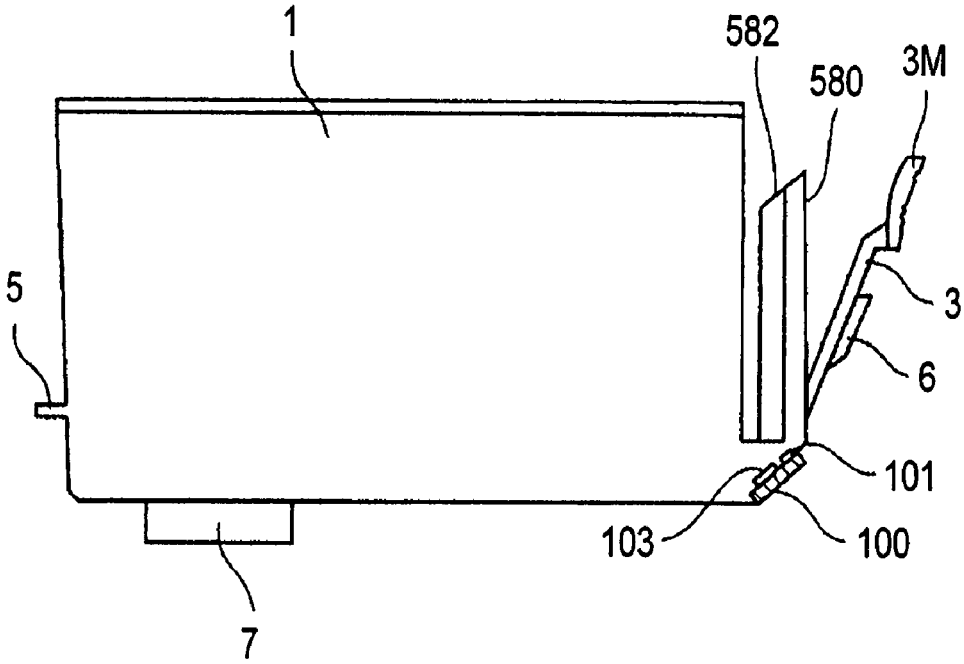
FIG. 27 is a schematic side view of a modified example of an ink container shown in FIG. 24, (*a*).

In place of providing the display portion by the top front side position of the light guide portion 580 where t light is emergent, the inclined surface 582 is disposed behind t operating portion 3M of the supporting member 3, as shown in FIG. 27, so that the operating portion 3M functions as a display portion similarly to the example of FIG. 19. Similarly to the example of FIG. 20, the operating portion 3M may be provided with an opening, through which the reflected light from the inclined surface 582 of the light guide portion 580 can be observed.

4. Fourth Embodiment

Figure 28:
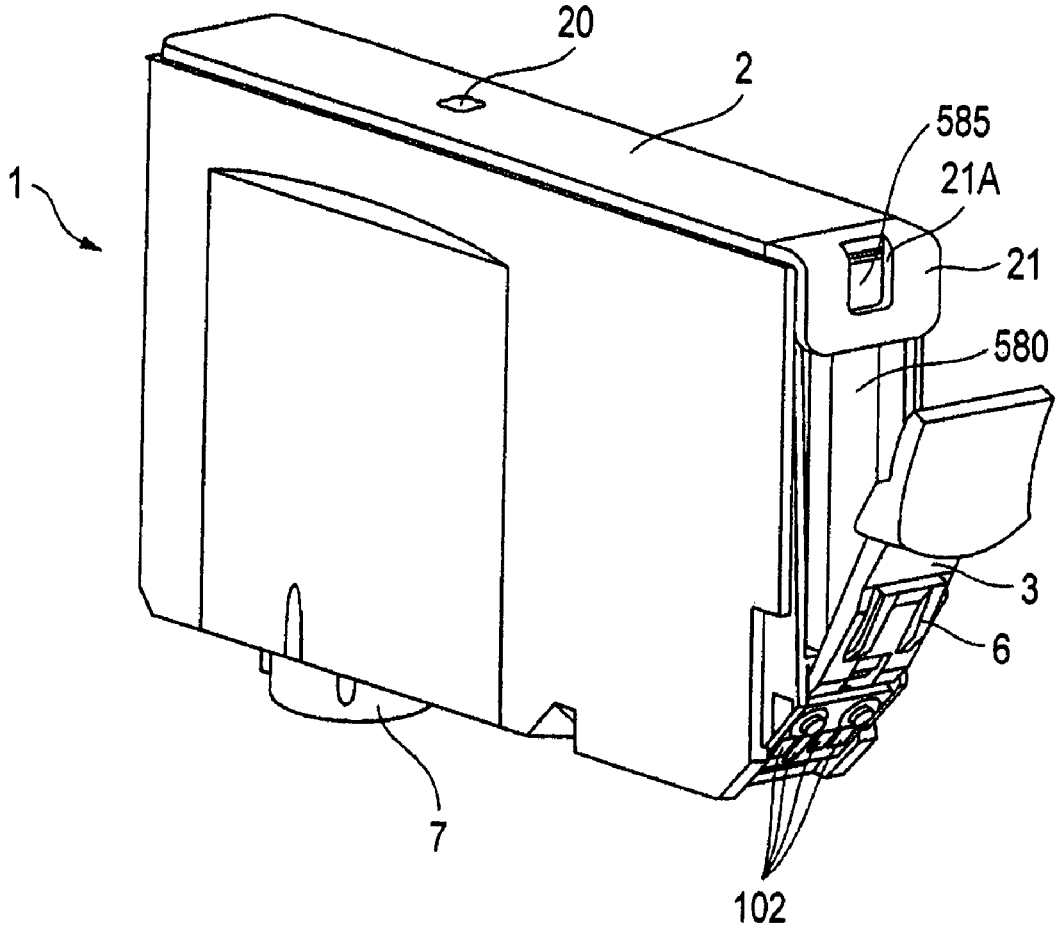
FIG. 28 is a perspective view of the ink container which is a liquid container according to an embodiment of the present invention.
Figure 29:
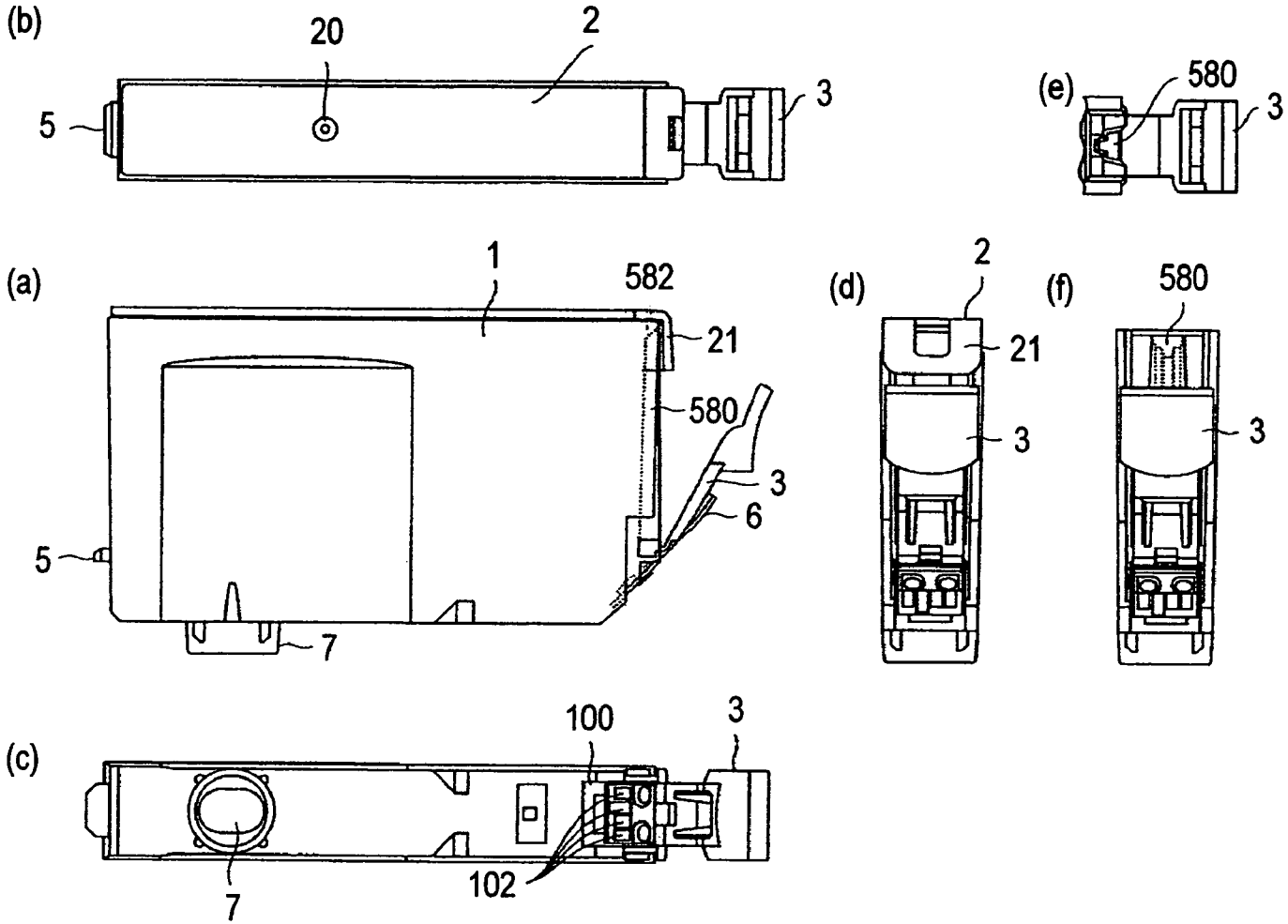
FIG. 29 is a side view (a), a top plan view (b), a bottom view (c) and a front view (d) of the ink container shown in FIG. 28, and a top plan view (e) and a front view (f) of the ink container with the cap member omitted.

FIG. 28 and FIG. 29

It is desirable that user can correctly determine the ink container from the display portion of which the light is emitted. If the emergent light quantity is too low, it is not easy for the user to detect the light. If, on the other hand, the emergent light quantity is too large, the distinction between adjacent liquid containers is difficult. The same applies to the light receiving portion. More particularly, the light receiving portion might receive the light from an adjacent ink container not the intended ink container.

The description will be made as to an embodiment in which the emergent light from the display portion is properly received by the user and also by the light receiving portion.

FIG. 28 in addition a perspective view of the ink container which is a liquid container according to an embodiment of the present invention. FIG. 29 is a side view (a), a top plan view (b), a bottom view (c) and a front view (d) of the ink container shown in FIG. 28, and a top plan view (e) and a front view (f) of the ink container with the cap member omitted.

The structure of this example is basically the same as with FIG. 24. The light guide portion 580 has a substantially T-shaped cross-section and has an inclined surface 582, and is extended up for a position opposed to the emitting portion 101, so that light is emergent from the portion (the portion corresponding to portions D, E in FIG. 25) which is at the front top side and which provides the display portion 585. In this example, a predetermined opening 21A is formed opposed to the display portion 585, and the periphery portion of the display portion 585 is covered so as to limit the emergent direction of the light by an emergent light limitation member 21.

Designated by reference numeral 2 is a cap member which is mounted to the upper surface of the ink container 1 to cover the inside and which has an air vent 20 for fluid communication between the inside and the ambience. In this example, the emergent light limitation member 21 is made of thermoplastic elastomer, for example, by which it can be welded on the cap member 2 to provide an integral member. Since the thermoplastic elastomer is transparent, it may be colored so as to reduce the emergent light at the periphery portion to stabilize the receiving operation of the light receiving portion 210 and improvement in the user visibility. Or, a material other than elastomer is usable, and it may be integrally molded with the cap member 2 by the same material. When the cap member 2 is made of a transparent, the emergent light may be limited by providing unsmoothness configuration on at least one of the front and back surfaces of the portion constituting the emergent light limitation member 21, or the surface may be subjected to a blast treatment.

According to this embodiment, the emergent light from the display portion is appropriately limited, by which the light quantity can be made preferable for both of the user visibility and operation stabilization of the light receiving portion. The light guide portion is not limited to those described hereinbefore, and the configuration may be different from that of FIG. 24. The display portion may be formed at the upper end surface of the light guide portion.

Figure 30:
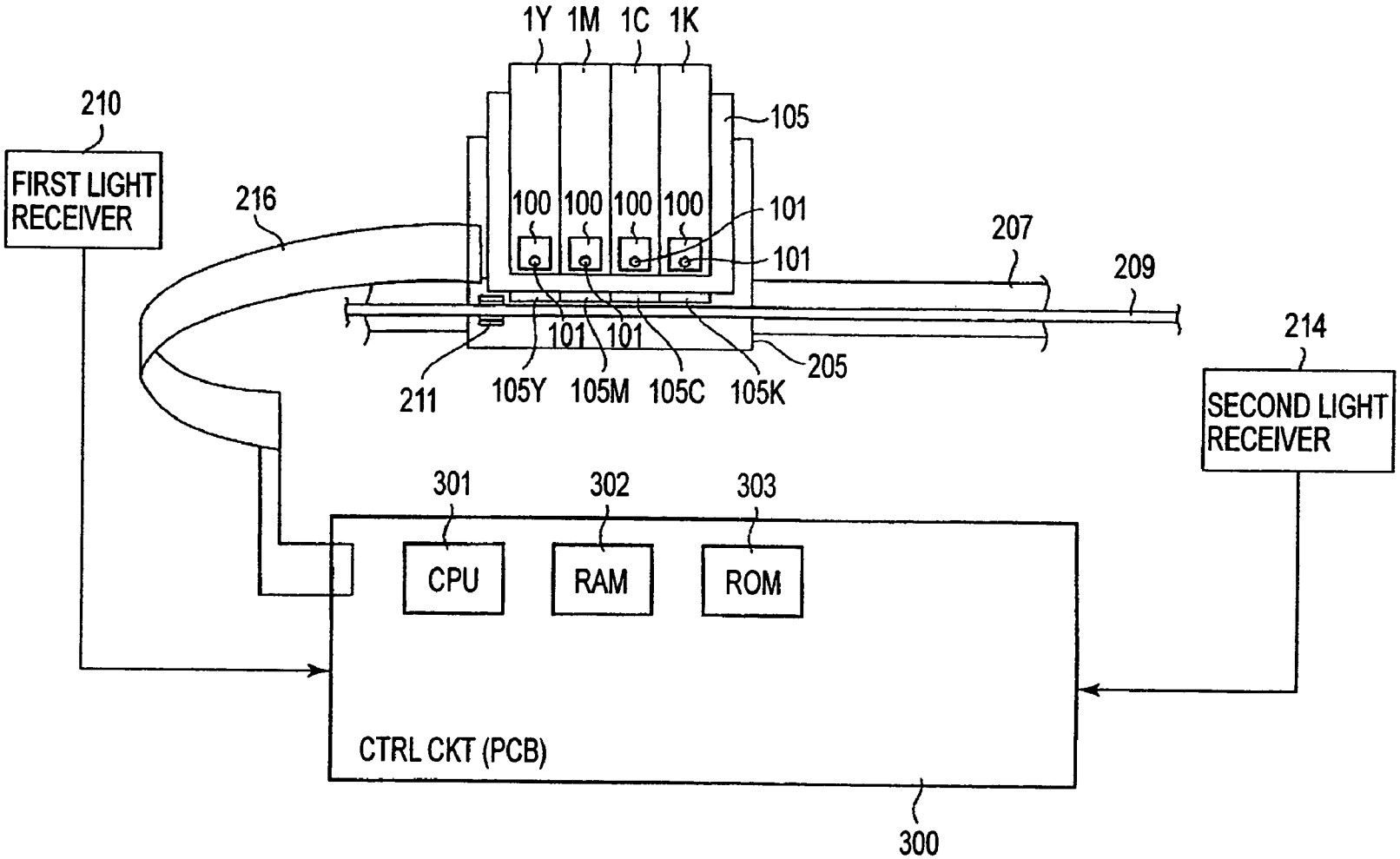
FIG. 30 is a block diagram showing a structure of a control system of the ink jet printer.

5. Control System 5.1 General Arrangement (FIG. 30):

FIG. 30 is a block diagram showing an example of a structure of a control system of the ink jet printer. The control system mainly comprises a control circuit (PCB (printed-wiring board)) in the main assembly of the printer, and the structure for the light emission of the LED of the ink container to be controlled by the control circuit.

In FIG. 30, the control circuit 300 executes data processing relating to the printer and operation control. More particularly, a CPU 301 carried out processes which will be described hereinafter in conjunction with FIG. 36-FIG. 39 in accordance with a program stored in ROM 303. RAM 302 is used as a work area in the process execution of the CPU 301.

As schematically shown in FIG. 30, the recording head unit 105 carried on the carriage 205 has recording heads 105K, 105Y, 105M and 105C which have a plurality of ejection outlets for ejecting black (K), yellow (Y), magenta (M) and cyan (C) inks, respectively. On the holder of the recording head unit 105, ink containers 1K, 1Y, 1M and 1C are detachably mounted corresponding to the respective recording heads.

Each of the ink container 1, as described hereinbefore, is provided with the substrate 100 provided with the LED 101, the display control circuit therefor and the pad (electric contact) or the like. When the ink container 1 is correctly mounted on the recording head unit 105, the pad on the substrate 100 is contacted to the connector provided corresponding to each of ink containers 1 in the recording head unit 105. The connector (unshown) provided in the carriage 205, the control circuit 300 provided in the main assembly side, are electrically connected for transmission of signals through the flexible cable 206. Furthermore, by the mounting of the recording head unit 105 on the carriage 205, the connector of the carriage 205 and the connector of the recording head unit 105 are electrically contacted with each other for signal transmission. With such a structure, the signals can be transmitted between the control circuit 300 of the main assembly side and the respective ink containers 1. Thus, the control circuit 300 can perform the control for turn-on and -off of LED in accordance with the sequence which will be described hereinafter in conjunction with FIG. 36-FIG. 38.

The control of ink ejections of the recording heads 105K, 105Y, 105M and 105C, is carried out similarly through the flexible cable 206, the connector of the carriage 205, the connector of the recording head unit with the signal connection between the driving circuit and so on provided in the recording head, and the control circuit 300 in the main assembly side. Thus, the control circuit 300 controls the ink ejections and so on for the respective recording heads.

The first light receiving portion 210 disposed adjacent one of the end portions of the movement range of the carriage 205 receives light from the LED 101 of the ink container 1, and a signal indicative of the event is supplied to the control circuit 300. The control circuit 300, as will be described hereinafter, responds to the signal to discriminate the position of the ink container 1 in the carriage 205. In addition, an encoder scale 209 is provided along the movement path of the carriage 205, and the carriage 205 is correspondingly provided with an encoder sensor 211. The detection signal of the sensor is supplied to the control circuit 300 through the flexible cable 206, by which the movement position of the carriage 205 is obtained. The position information is used for the respective recording head ejection controls, and is used also for light validation process in which the positions of the ink containers are detected, which will be described hereinafter in conjunction with FIG. 36. A second light emission/receiving portion 214 is provided in the neighborhood of the predetermined position in the movement range of the carriage 205, includes a light emitting element and a light receiving element, and it functions to output to the control circuit 300 a signal relating to an ink remaining amount of each of the ink container 1 carried on the carriage 205. The control circuit 300 can detect the ink remaining amount on the basis of the signal.

Figure 31:
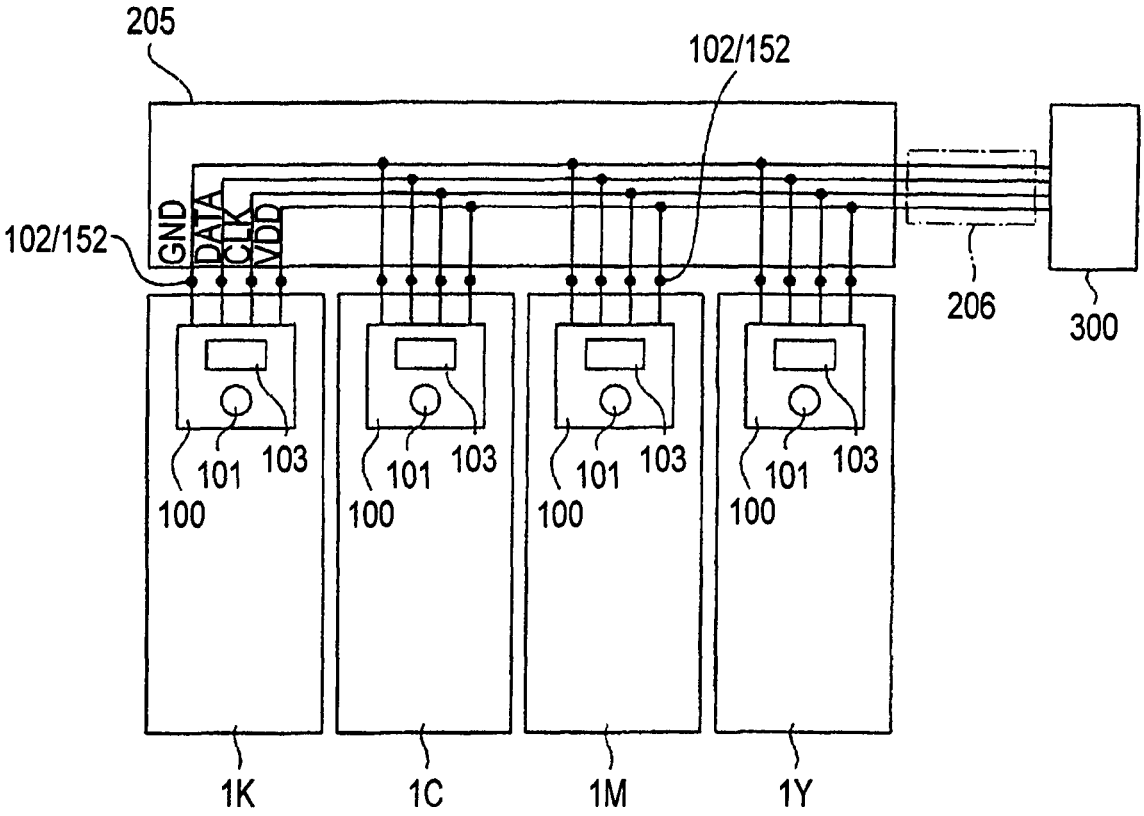
FIG. 31 shows structure of signal line wiring for signal transmission between the ink container and the flexible cable of the ink jet printer in terms of the substrate of the ink container.

5.2 Connecting Portion (FIG. 31-FIG. 35):

FIG. 31 shows a structure of signal line wiring for signal transmission between the ink container 1 and the flexible cable 206 of the ink jet printer in terms of the substrate 100 of the ink container 1.

As shown in FIG. 31, the signal line wiring for the ink container 1 comprises four signal lines in this embodiment, each of them is common for all of four ink containers 1 (bus connection). The signal line wiring for the ink containers 1 include four signal lines, namely, a voltage source signal line VDD relating to electric power supply such as for an operation of a group of function elements for effecting light emission, actuation of the LED 101 in the ink container; a ground signal line GND; a signal line DATA for supplying control signal (control data), the like relating to the process such as turning-on and -off of the LED 101 from the control circuit 300; and a clock signal line CLK therefor. In this embodiment, four signal lines are employed, but the present invention is not limited to this case. For example, the ground signal may be supplied through another structure, and in such a case, the line GND can be omitted in the above-described structure. On the other hand, the line CLK and the line DATA may be made one common line.

Each of the substrates 100 of the ink containers 1 has a controller 103 which is responsive to the signal supplied through the four signal lines, and a LED 101 actuatable in response to the output of the controller 103.

Figure 32:
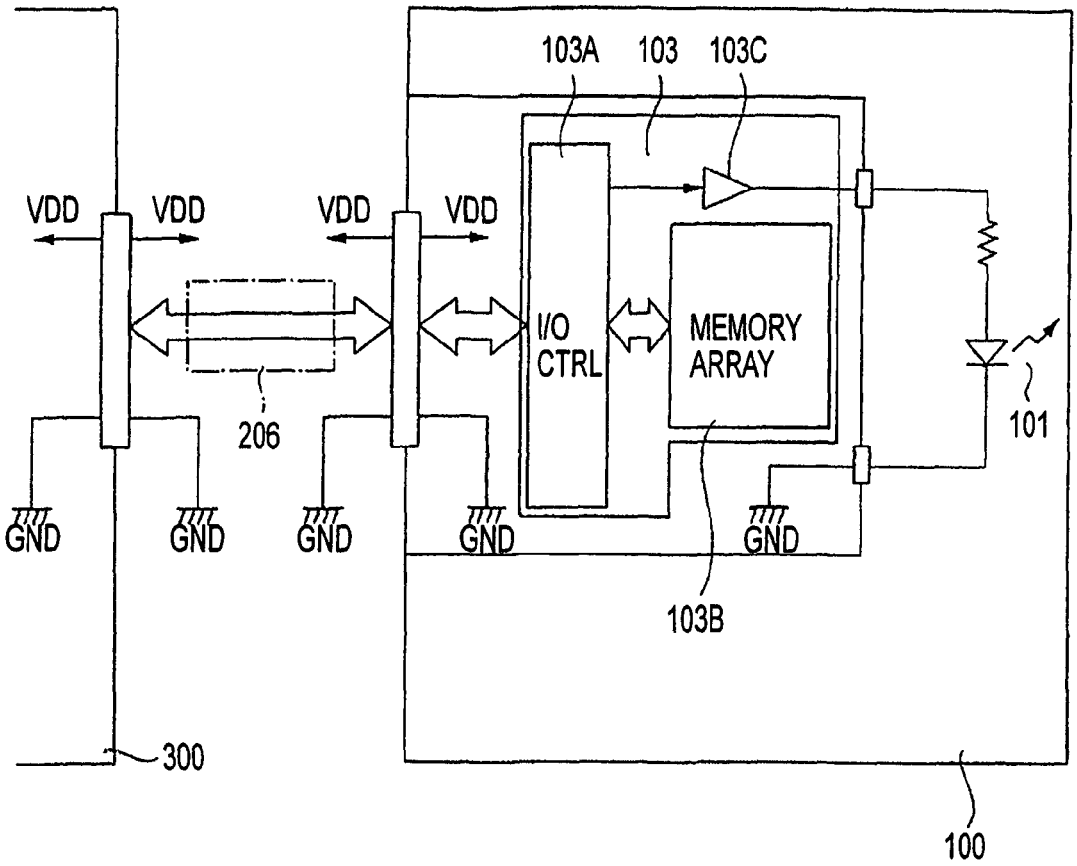

FIG. 32 is a detailed circuit diagram of the substrate having such a controller or the like. As shown in the Figure, the controller 103 comprises an I/O control circuit (I/O-CTRL) 103A, a memory array 103B and a LED driver 103C. The I/O control circuit 103A is responsive to control data fed through the flexible cable 206 from the control circuit 300 of the main assembly side to control the display driving of the LED 101, the writing of the data in the memory array 103B and the reading of the data. The memory array 103B is in the form of an EEPROM in this embodiment, and is able to store individual information of the ink container, such as information relating to the ink remaining amount in the ink container, the color information of the ink therein, and in addition, manufacturing information such as a number of the ink container, production lot number or the like. The color information is written in a predetermined address of the memory array 103B corresponding to the color of the ink stored in the ink container. For example, the color information is used as ink container discrimination information (individual information) which will be described hereinafter in conjunction with FIGS. 34 and 35 to identify the ink container when the data is written in the memory array 103B and is read out therefrom, or when the actuation and deactuation of the LED 101 is controlled for the particular ink container. The data written in the memory array 103B or read out of it include, for example, the data indicative of the ink remaining amount. The ink container of this embodiment, as described hereinbefore, is provided in the bottom portion with a prism, and when the remaining amount of the ink becomes small, the event can be optically detected by means of the prism. In addition to that, the control circuit 300 of this embodiment counts the number of ejections for each of the recording heads on the basis of the ejection data. The remaining amount information is written in the memory array 103B of the corresponding ink container, and the information is read out. By doing so, the memory array 103B stores the information of the ink remaining amount in real time. The information represents the ink remaining amount with high accuracy since the information is provided with the aid of the prism, too. Also, it is possible to use it to discriminate whether the mounted ink container is a fresh one, or used and then remounted one.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

Figure 33:
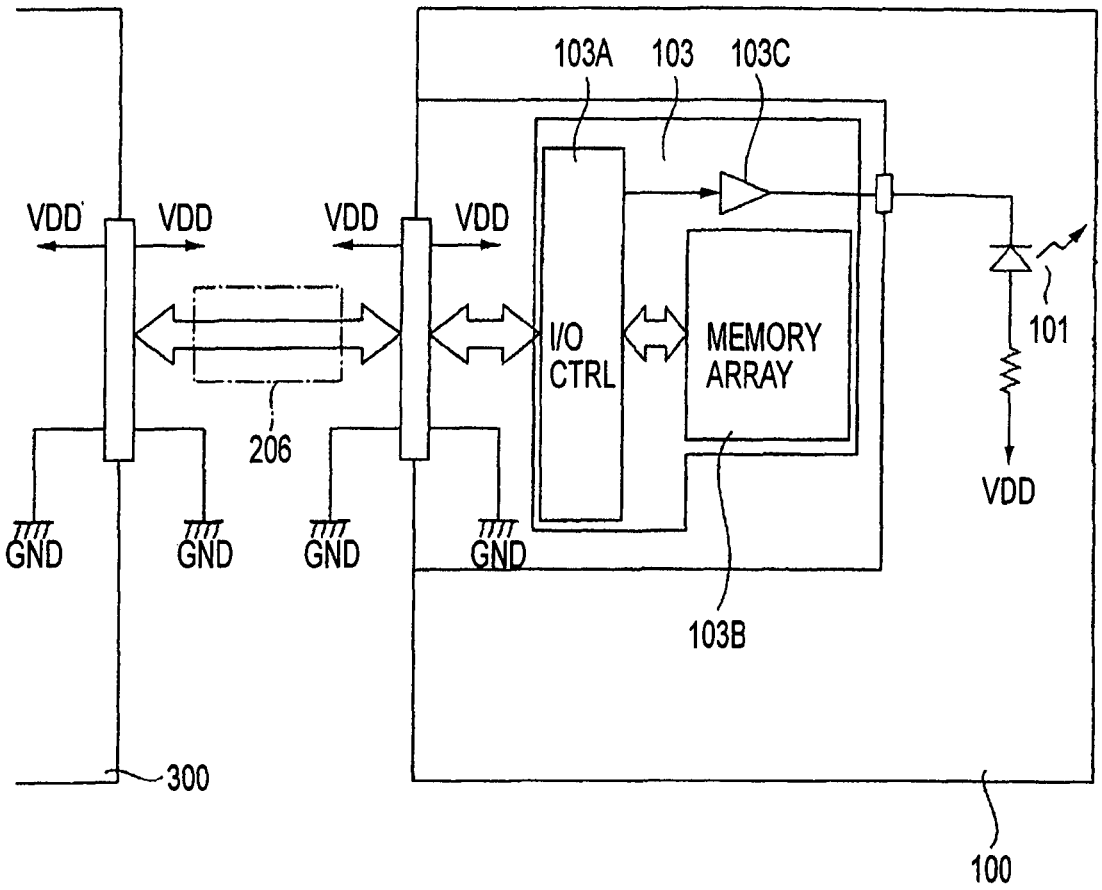
FIG. 33 is a circuit diagram of a modified example of the substrate of FIG. 32.

FIG. 33 is a circuit diagram of a modified example of the substrate of FIG. 32. This modified example is different from the example of FIG. 21 in the structure for applying the power source voltage to the LED 101, more particularly, the voltage source voltage is supplied from the VDD voltage source pattern provided inside the substrate 100 of the ink container. Ordinarily, the controller 103 is built in a semiconductor substrate, and in this example, the connecting contact on the semiconductor substrate is only for the LED connecting contact. Reduction of the number of the connecting contacts is significantly influential to the area occupied by the semiconductor substrate, and in this sense, the modified example in addition advantageous in terms of cost reduction of the semiconductor substrate.

Figure 34:
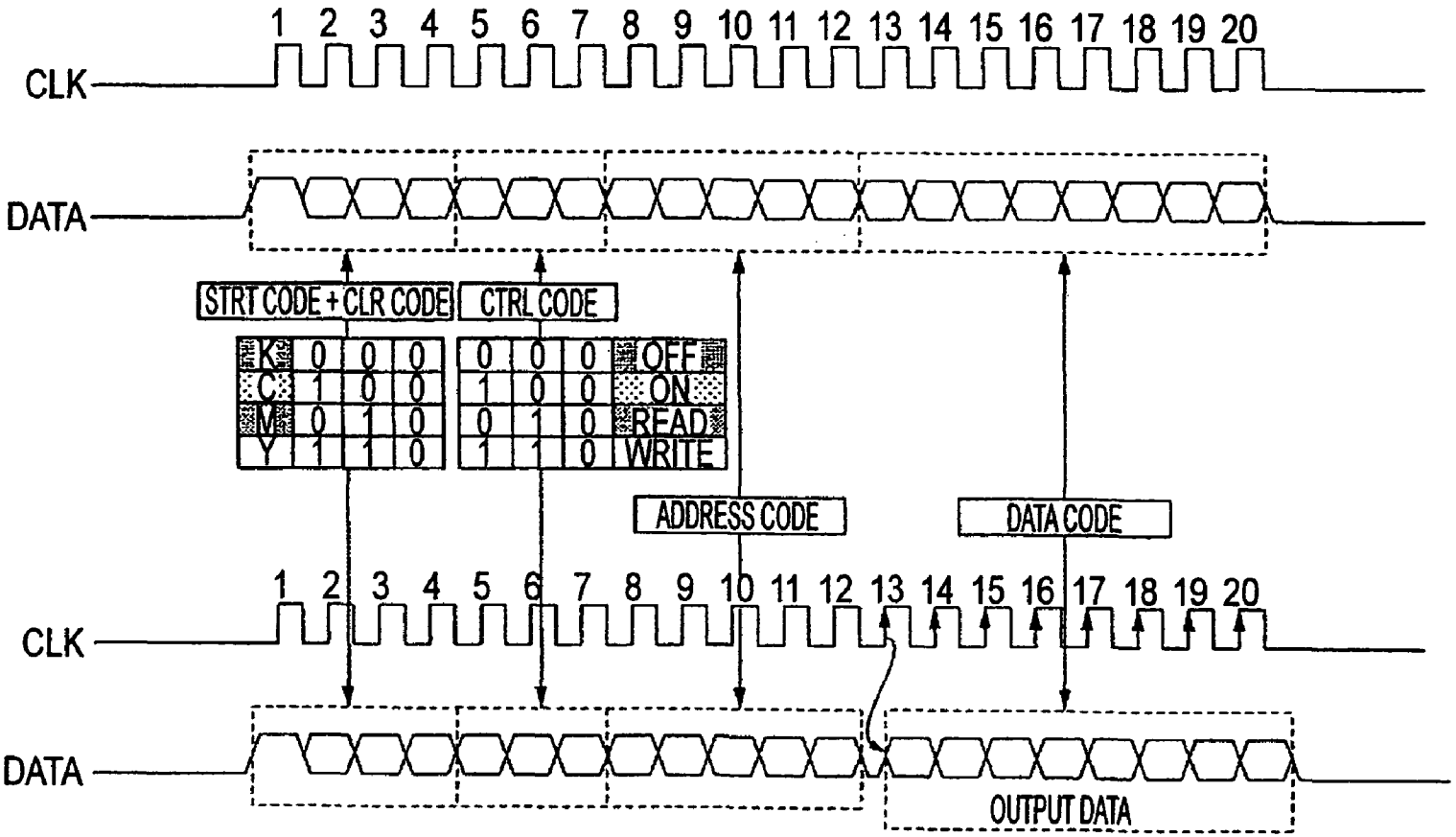
FIG. 34 is a timing chart illustrating the data writing and reading operations to and from a memory array of the substrate.

FIG. 34 is a timing chart illustrating the data writing and reading operations to and from the memory array 103B of the substrate.

Figure 35:
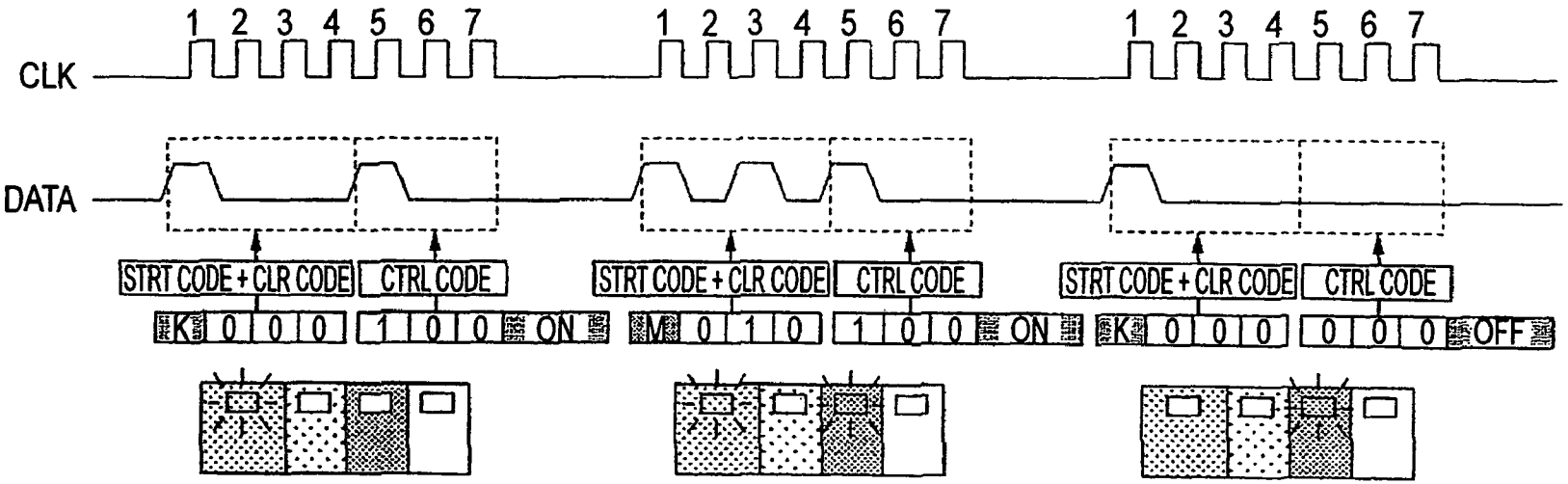
FIG. 35 is a timing chart illustrating actuation and deactuation of LED 101.

FIG. 35 is a timing chart illustrating actuation, deactuation of LED 101.

As shown in FIG. 34, in the writing in the memory array 103B, start code plus color information, control code, address code, data code, are supplied in the order named from the control circuit 300 in the main assembly side through the signal line DATA (FIG. 31) to the I/O control circuit 103A in the controller 103 of the ink container 1 in synchronism with the clock signal CLK. The start code signal in the start code plus color information indicates the beginning of the series of the data signals, and the color information signal is effective to identify the particular ink container which the series of data signal are related to. Here, the color of the ink includes not only the Y, M, C or the like color but also such ink having different densities.

As shown in the Figure, the color information has a code corresponding to each colors of the ink, K, C, M and Y. The I/O control circuit 103A compares the color information indicated by the code with the color information stored in the memory array 103B of the ink container per se. Only if they are the same, the subsequent data are taken in, and if not, the subsequent data are ignored. By doing so, even when the data signal is supplied commonly to all of the ink containers from the main assembly side through the common signal line DATA held in FIG. 31, the ink container to which the data are concerned can be correctly identified since the data include the color information, and therefore, the processing on the basis of the subsequent data, such as the writing, reading of the subsequent data, actuation, deactuation of the LED, can be effected only to the identified ink container (that is, only to the right ink container). As a result, (one) common data signal line is enough for all of the four ink containers to write the data in, to actuate the LED and to deactuate the LED, thus reducing the required number of the signal lines. As will be readily understood, (one) common data signal line is enough irrespective of the number of the ink containers.

As shown in FIG. 34, the control modes of this embodiment include OFF and ON codes for actuation and deactuation of the LED which will be described hereinafter, and READ and WRITE codes for reading out of the memory array and writing therein. In the writing operation, the WRITE code follows the color information code for identifying the ink container. The next code, i.e., the address code indicates an address in the memory array in which the data are to be written in, and the last code, i.e., the data code indicates the content of information to be written in.

The content indicated by the control code is not limited to the example described above, and, for example, control codes for verification command and/or continuous reading command may be added.

For the reading operation, the structure of the data signal is the same as in the case of the writing operation. The code of the start code plus color information is taken by the I/O control circuit 103A of all of the ink containers, similarly to the case of the writing operation, and the subsequent data signal are taken in only by the I/O control circuit 103A of the ink container having the same color information. What is different is that. The read data are outputted in synchronism with rising of the first clock (13th clock in FIG. 34) after the address is designated by the address code. Thus, the I/O control circuit 103A effects control to prevent interference of the read data with another input signal even though the data signal contacts of the ink containers are connected to the common (one) data signal line.

As shown in FIG. 35, with respect to the actuation (turning-on) and the deactuation (turning-off) of the LED 101, the data signal of the start code plus color information is first sent to the I/O control circuit 103A through the signal line DATA from the main assembly side, similarly to the foregoing. As described hereinbefore, the right ink container is identified on the basis of the color information, and the actuation and deactuation of the LED 101 by the control code fed subsequently, are effected only for the identified ink container. The control codes for the actuation and the deactuation, as described hereinbefore in conjunction with FIG. 34, include one of ON code and OFF code which are effective to actuate and deactuate the LED 101, respectively. Namely, when the control code indicates ON, the I/O control circuit 103A outputs an ON signal to the LED driver 103C, as described hereinbefore in conjunction with FIG. 33, the output state is continuously maintained thereafter. On the contrary, when the control code indicates OFF, the I/O control circuit 103A outputs an OFF signal to the LED driver 103C, and the output state is continuously maintained thereafter. The actual timing for the actuation or deactuation of the LED 101 is after 7th clock of the clock CLK for each of the data signals shown in FIG. 35.

In the example of this Figure, the black (K) ink container which the leftmost data signal designates is first identified, and then, the LED 101 of the black ink K container is switched on. Then, the color information of the second data signal indicates magenta ink M, and the control code indicates actuation, and therefore, the LED 101 of the ink M container is switched on while the LED 101 of the ink K container is kept in ON state. The control code of the third data signal means instruction of deactuation, and only the LED 101 of the ink K container is deactuated.

LED As will be understood from the foregoing description, the flickering control of the LED is accomplished by the control circuit 300 of the main assembly side sending repeated actuation and deactuation control codes alternately for the identified ink container. The cyclic period of the flickering can be determined by selecting the cyclic period of the alternating control codes.

Figure 36:
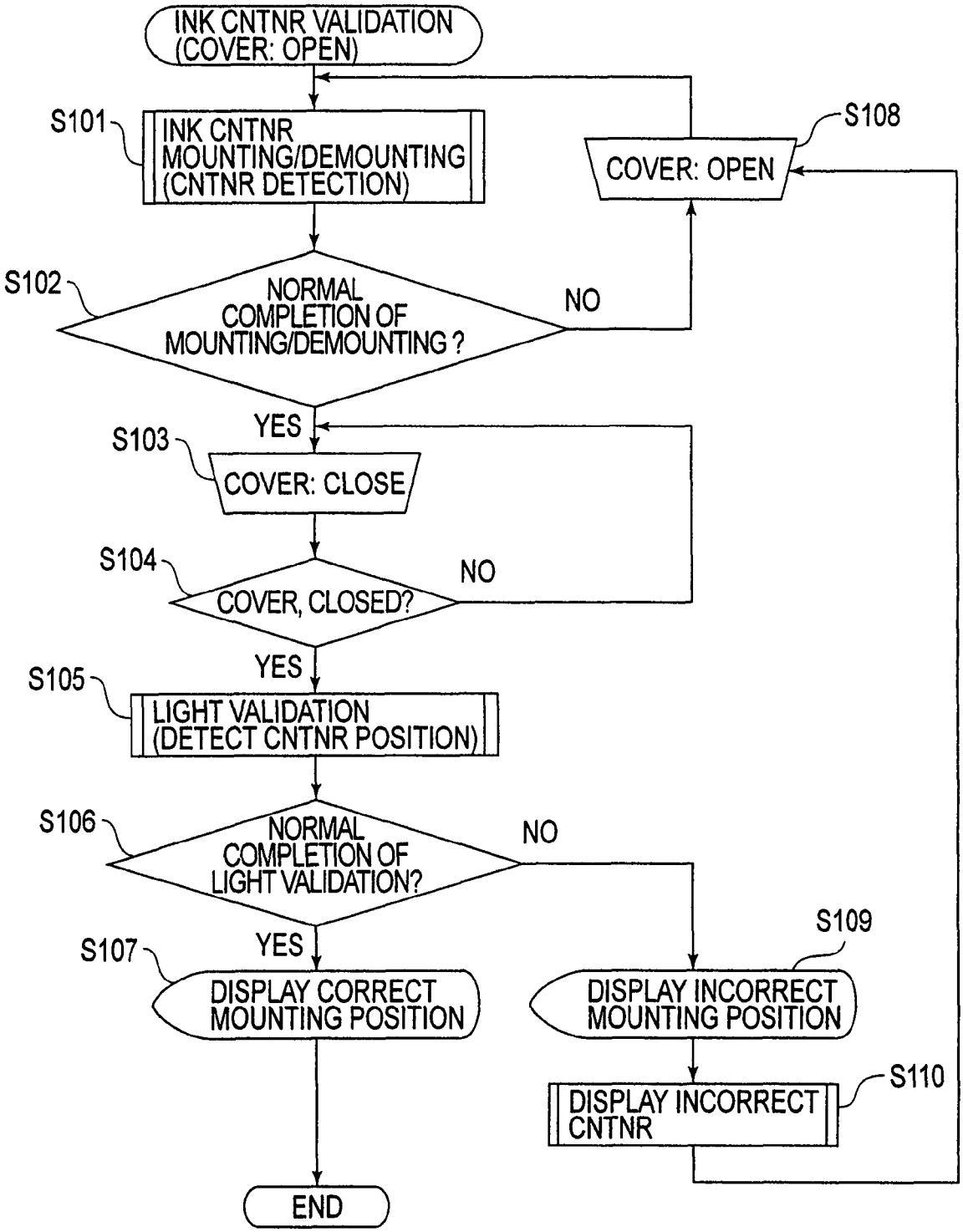
FIG. 36 is a flow chart illustrating a control process relating to mounting and demounting of the ink container according to an embodiment of the present invention.

5.3 Control Process (FIG. 36-FIG. 31):

FIG. 36 is a flow chart illustrating control processes relating the mounting and demounting of the ink container according to the embodiment of the present invention, and particularly shows the actuation and deactuation control for the LED 101 of each of the ink container 1 by the control circuit 300 provided in the main assembly side.

The process shown in FIG. 36 starts in response to the user opening the main assembly cover of the printer 201 which is detected by a predetermined sensor. When the process is started, the ink container is mounted or demounted by step S101.

Figure 37:
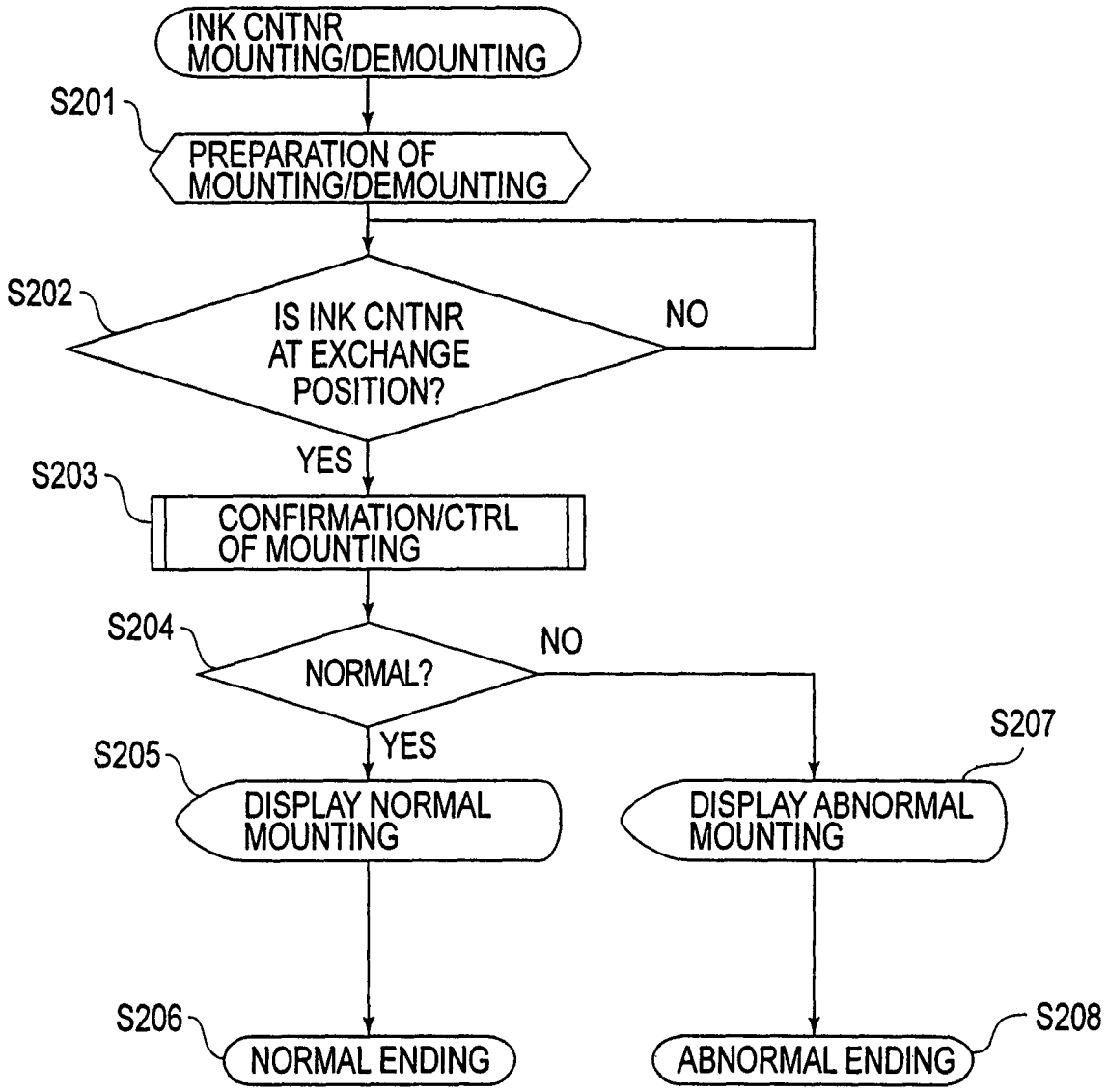
FIG. 37 is a flow chart of a mounting and demounting process of the ink container in FIG. 36.

FIG. 37 is a flow chart of a mounting and demounting process of the ink container. As shown in the Figure, in the mounting or demounting process, the carriage 205 moves at step S201, and the information of the state of ink container (individual information thereof) carried on the carriage 205 is obtained. The information of the state to be obtained here is an ink remaining amount or the like which is read out of the memory array 103B together with the number of the ink container. In step S202, the discrimination is made as to whether the carriage 205 reaches the ink container exchange position having been described in conjunction with FIG. 18 or not.

If the result of the discrimination is affirmative, step S203 is executed for ink container mounting confirmation control.

Figure 38:
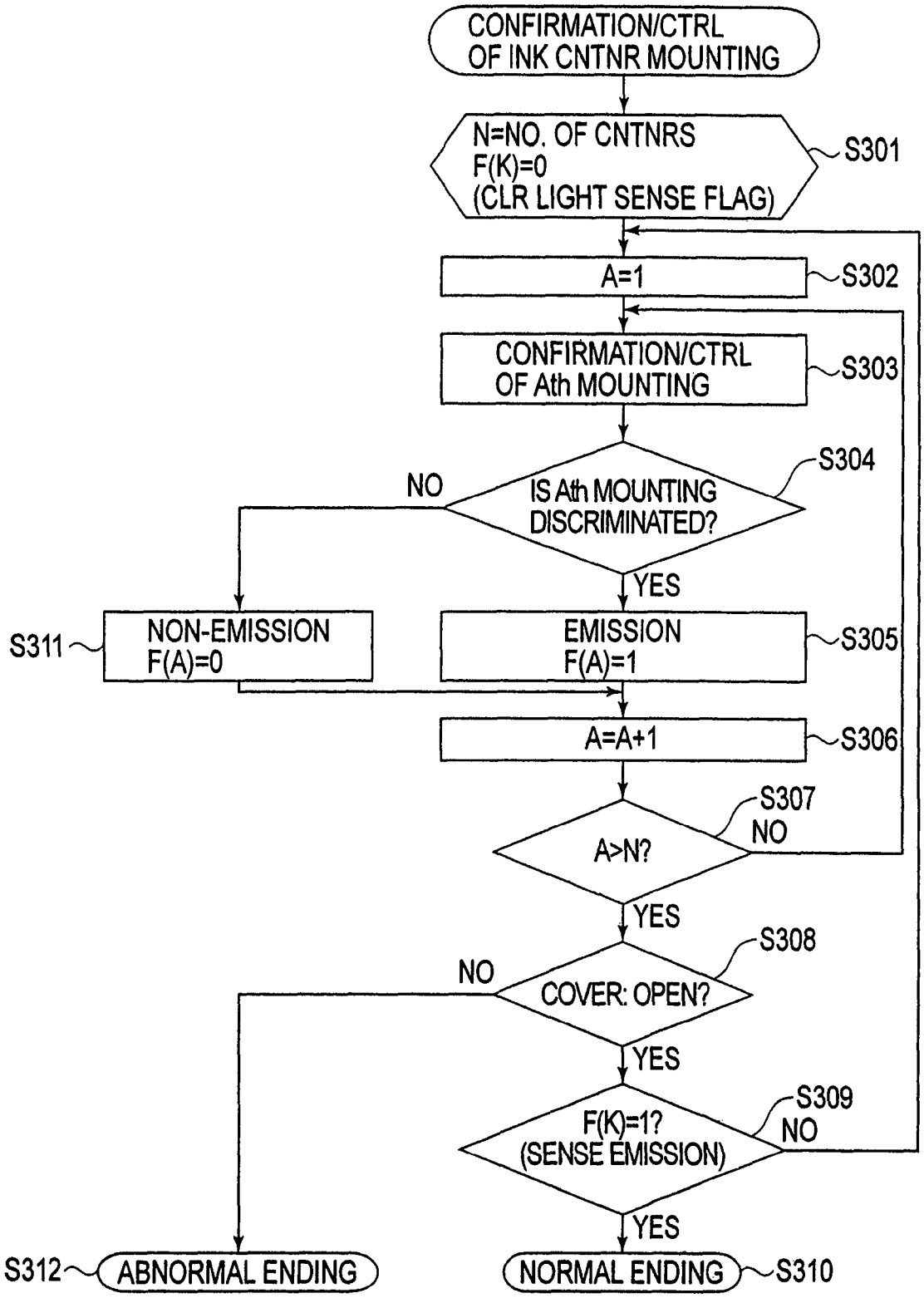
FIG. 38 is a flow chart showing in detail a mounting confirmation control in FIG. 37.

FIG. 38 is a flow chart showing in detail the mounting confirmation control. First, in step S301, a parameter N indicative of the number of the ink container carried on the carriage 205 is set, and a flag F (k) for confirmation of light emission of the LED correspondingly to the number of the ink container, is initialized. In this embodiment, N is set to 4 since the number of the ink containers is 4 (K, C, M, Y). Then, four flags F (k), k=1-4 are prepared, and they are all initialized to zero.

In step S302, a variable An of the flag relating to the order of mounting discrimination for the ink container is set to "1", and in step S303, the mounting confirmation control is effected for the Ath ink container. In this control, the contact 152 of the holder 150 and the contact 102 of the ink container are contacted with each other by the user mounting the ink container to the right position in the holder 150 of the recording head unit 105, by which the control circuit 300 of the main assembly side, as described hereinbefore, identifies the ink container by the color information (individual information for the ink container), and the color information stored in the memory array 103B of the identified container is sequentially read out. The color information for the identification is not used for the already read out one or ones. In this control process, the discrimination is also made as to whether or not the read color information is different from the color information already read out after the start of this process.

In step S304, if the color information have been able to read out, the color information has been different from the already read out piece or pieces of information, it is then discriminated that ink container of the color information is mounted as the A-th ink container. Otherwise, it is discriminated that A-th ink container is not mounted. Here, the "A-th" represents only the order of discrimination of the ink container, does not represent the order indicative of the mounted position of the ink container. A When the A-th ink container is discriminated as being correctly mounted, the flag F (A) (the flag satisfying k=An among the prepared flags flag F (k), k=1-4) is set to "1" in step S305, as described hereinbefore in conjunction with FIG. 35, and the LED 101 of the ink container 1 having the corresponding color information is switched on. When it is discriminated that ink container is not mounted, the flag F (A) is set to "0" in step S311.

Then, in step S306, the variable An is incremented by 1, and in step S307, the discrimination is made as to whether or not the variable An is larger than N set in the step S301 (in this embodiment, N=4). If the variable An is not more than N, the process subsequent to step S303 is repeated. If it is discriminated as being larger than N, the mounting confirmation control has been completed for all of four ink containers. Then, in step S308, the discrimination is made as to whether or not the main assembly cover 201 is in an open position on the basis of an output of the sensor. When the main assembly cover is in a closed state, an abnormality state is returned to the processing routine of FIG. 37 in step S312 since there is a possibility that user has closed the cover although one of some of the ink containers are not mounted or are not properly mounted. Then, this process operation is completed.

When, on the contrary, the main assembly cover 201 is discriminated as being open in the step S308, the discrimination is made as to whether or not all of the four flags F (k), k=1-4 are "1.", that is, whether the LEDs 101 are all switched on or not. If it is discriminated that at least one of the LEDs 101 is not switched on, the process subsequent to the step S302 is repeated. Until the user mount or correctly remount the ink container or ink containers of which the LEDs 101 are not switched on, the LED of the ink container or containers is switched on, and the process operation is repeated.

Figure 39:
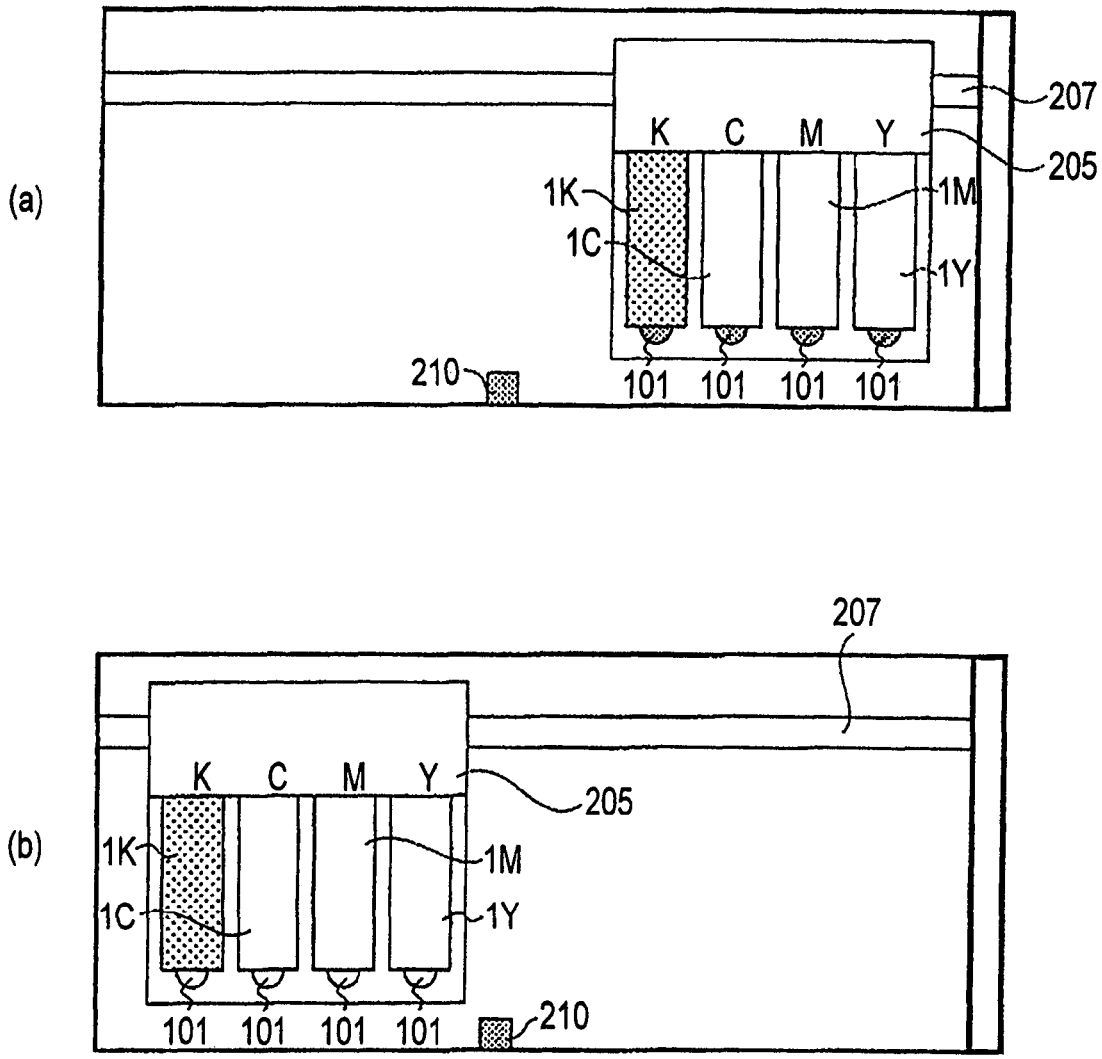
FIG. 39 shows a state (a) in which all of the ink containers are correctly mounted at correct positions, and therefore the LEDs are switched on, respectively, in the process of the control for the mounting and demounting of the ink containers, in which (b) shows movement of the carriage to a position for validation which is carried out using light (light validation), after the main assembly cover is closed subsequently to the LED lightening.

When all of the LEDs are discriminated as being switched on, a normal ending operation is carried out in step S310, and this process operation is completed. Then, the process returns to the processing routine shown in FIG. 37. FIG. 39 shows a state (a) in which all of the ink containers are correctly mounted at correct positions, and therefore, the LEDs are all switched on, respectively.

Referring back to FIG. 37, after the ink container mounting confirmation control (step S203) is executed in the above-described manner, the discrimination is made as to whether or not the control is normally completed, namely, whether or not the ink containers are properly mounted, in step S204. If the mountings are discriminated as being normal, the displaying device (FIG. 14 and FIG. 15) in the operating portion 213 is lighted green, for example, and in step S205, a normal ending is executed at step S206, and the operation returns to the example shown in FIG. 36. When the abnormality mounting is discriminated, the displaying device in the operating portion 213 is flickered orange, for example, in step S207, and the abnormality ending is carried out, and then, the operation returns the processing routine shown in FIG. 36. When the printer is connected with a host PC which controls the printer, the mounting abnormality display is also effected on the display of the PC simultaneously.

In FIG. 36, when the ink container seating process of step S101 is completed, the discrimination is made as to whether or not the mounting or demounting process is properly completed in step S102. If the abnormality is discriminated, the process operation waits for the user to open the main assembly cover 201, and in response to the opening of the cover 201, the process of the step S101 is started, so that process described in conjunction with FIG. 37 is repeated.

When the proper mounting or demounting process is discriminated in step S102, the process waits for the user to close the main assembly cover 201 in step S103, and the discrimination is made as to whether or not the cover 201 is closed or not in step S104. If the result of the discrimination is affirmative, the operation proceeds to light validation process of step S105. In this case, if the closing of the main assembly cover 201 is detected as shown by (b) in FIG. 39, the carriage 205 moves to the position for light validation, and the LEDs 101 of the ink containers are deactuated.

The light validation process is intended to discriminate whether or not the properly mounted ink containers are mounted at the correct positions, respectively. In this embodiment, the structures of the ink containers are not such that configurations thereof are made peculiar depending on the colors of the ink contained therein for the purpose of preventing the ink containers from being mounted at wrong positions. This is for the simplicity of manufacturing of the ink container bodies. Therefore, there is a possibility that ink containers are mounted at wrong positions. The light validation process is effective to detect such wrong mounting and to notify the user of the event. By this, the efficiency and low cost of the ink container manufacturing are accomplished since it is not required to make the configurations of the ink containers different from each other depending on the colors of the ink.

Figure 40:
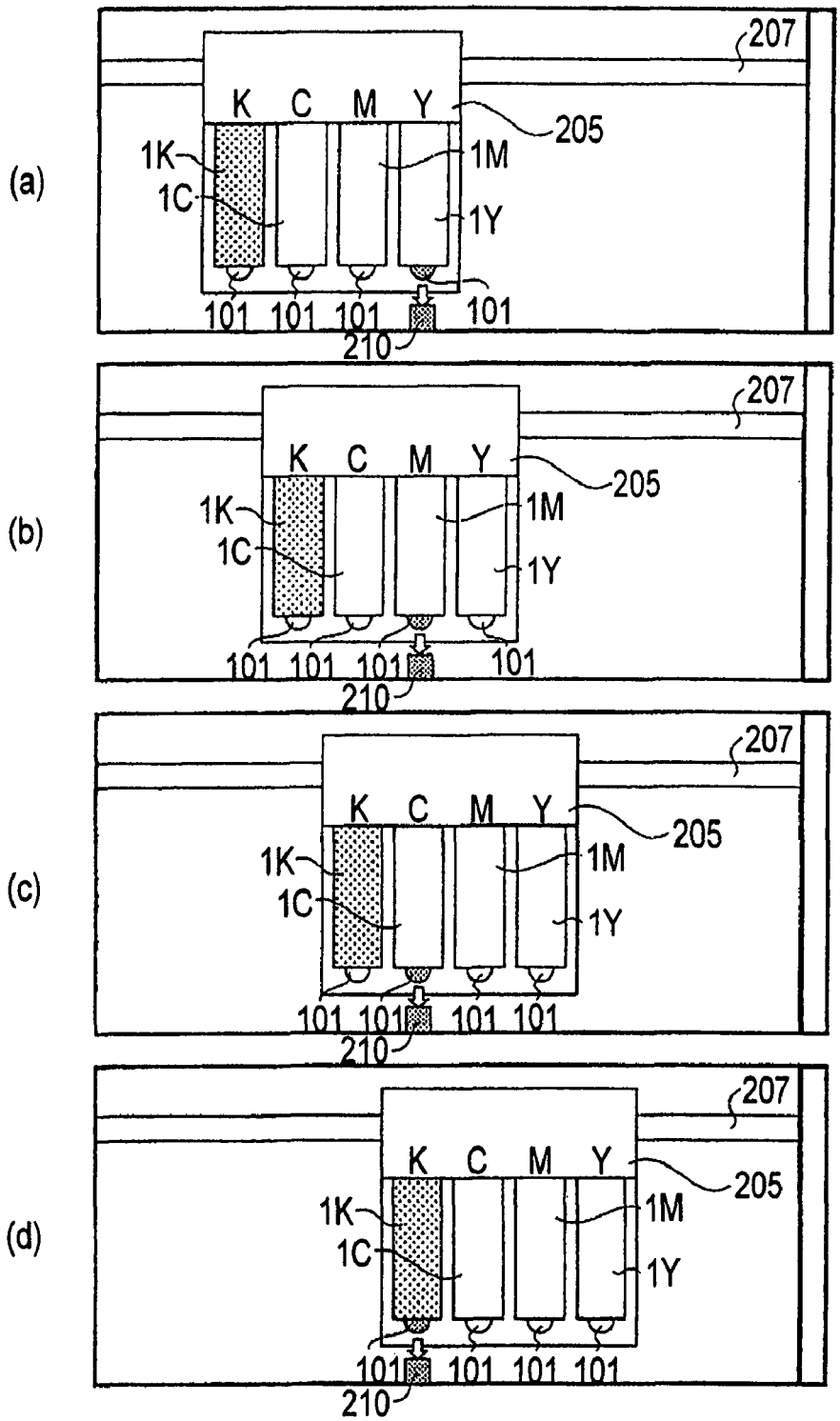
FIG. 40 illustrates the light validation process (a)-(d).

FIG. 40 illustrates the light validation process (a)-(d).

FIG. 30 also illustrates the light validation process (a)-(d).

As shown by (a) in FIG. 40, the movable carriage 205 first starts moving from the lefthand side to the righthand side in the Figure toward the first light receiving portion 210. When the ink container placed at the position for a yellow ink container comes opposed to the first light receiving portion 210, a signal for actuating the LED 101 of the yellow ink container is outputted in order to switch it on and to keep the on-state for a predetermined time duration, by the control having been described in conjunction with FIG. 35. When the ink container is placed at the correct position, the first light receiving portion 210 receives the light from the LED 101, so that control circuit 300 discriminates that ink container 1Y is mounted at the correct position.

While moving the carriage 205, as shown by (b) in FIG. 40, when the ink container placed at the position for a magenta ink container comes opposed to the first light receiving portion 210, a signal for actuating the LED 101 of the magenta ink container is outputted to switch it on, similarly. In the example shown in the Figure, the ink container 1M is mounted at the correct position, so that first light receiving portion 210 receives the light from the LED. As shown by (b)-(d) in FIG. 40, the light is emitted sequentially, while changing the position of discrimination. In this Figure, all of the ink containers are mounted at correct positions.

Figure 41:
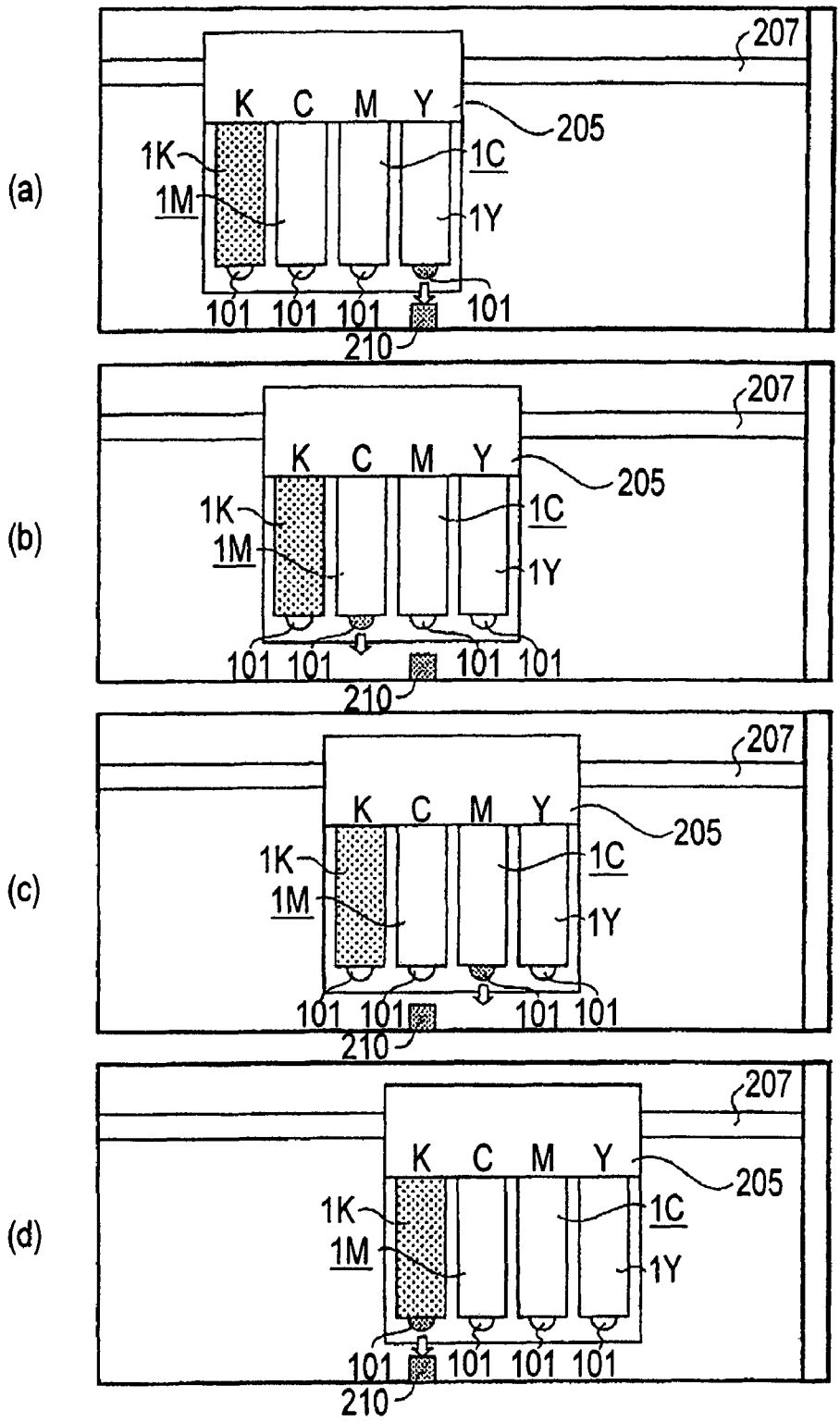
FIG. 41 also illustrates the light validation process (a)-(d).

On the contrary, if a cyan ink container 1C is erroneously mounted at a position for a magenta ink container 1M, as shown by (b) in FIG. 41, the LED 101 of the ink container 1C which is opposed to the first light receiving portion 210 is not actuated, but the ink container 1M mounted at another position is switched on. As a result, the first light receiving portion 210 does not receive the light at the predetermined timing, so that control circuit 300 discriminates that mounting position has an ink container other than the ink container 1M (right container). If a magenta ink container 1M is erroneously mounted at a position for a cyan ink container 1C, as shown by (c) in FIG. 41, the LED 101 of the ink container 1M which is opposed to the first light receiving portion 210 is not actuated, but the ink container 1C mounted at another position is switched on.

In this manner, the light validation process with the control circuit 300 described above is effective to identify the ink container or ink containers not mounted at the correct position. If the mounting position does not have the correct ink container mounted thereto, the color of the ink container erroneously mounted there can be identified by sequentially actuating the LEDs of the other three color ink containers.

In this embodiment, as described in conjunction with FIG. 31, the wiring lead in the recording device side is a common wiring lead (so-called bus wiring lead), the wiring in the apparatus side is simple. Conventionally, the position detection of the ink containers is not possible using common wiring lead. According to the present invention, the position detection of the ink containers with the recording device using said common wiring lead is made possible by the providing, in the ink container, an information holding portion for storing individual information of the ink container, a light emitting portion for emitting light to the light receiving portion in the recording device, and a controller for switching said emitting portion when a signal indicative of individual information supplied from the recording device is the same as the information stored in the information holding portion.

Figure 42:
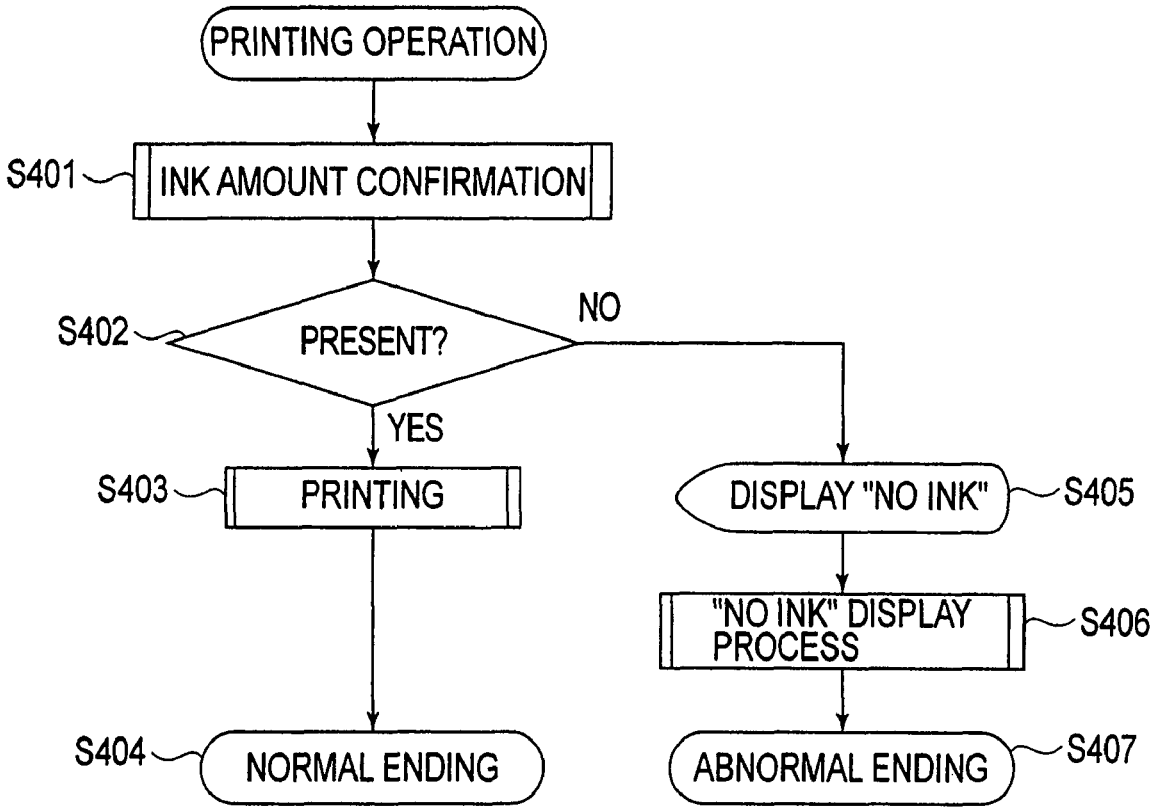
FIG. 42 is a flow chart illustrating a recording process according to the embodiment of the present invention.

FIG. 42 is a flow chart illustrating a recording process according to the embodiment of the present invention. In this process, the ink remaining amount is first checked in step S401. In this process, an amount of printing is determined from the printing data of the job for which the printing is going to be effected, and the comparison is made between the determined amount and the remaining amount of the ink container to check whether the remaining amount is sufficient or not (confirmation process). In this process, the ink remaining amount is the amount detected by the control circuit 300 on the basis of the counting.

In step S402, the discrimination is made as to whether the remaining ink amount is sufficient to the printing or not, on the basis of the confirmation process. If the ink amount is sufficient, the operation goes to the printing in step S403, and the displaying device of the operating portion 213 is lighted green at step S404 (normal ending). On the other hand, if the result of the discrimination at the step S402 indicates a shortage of the ink, the displaying device of the operating portion 213 is flickered orange in the step S405, and in step S406, the LED 101 of the ink container 1 containing the insufficient amount of the ink is flickered or switched on (abnormal ending). When the recording device is connected with a host PC which controls the recording device, the ink remaining amount may be displayed on the display of the PC, simultaneously.

Figure 43:
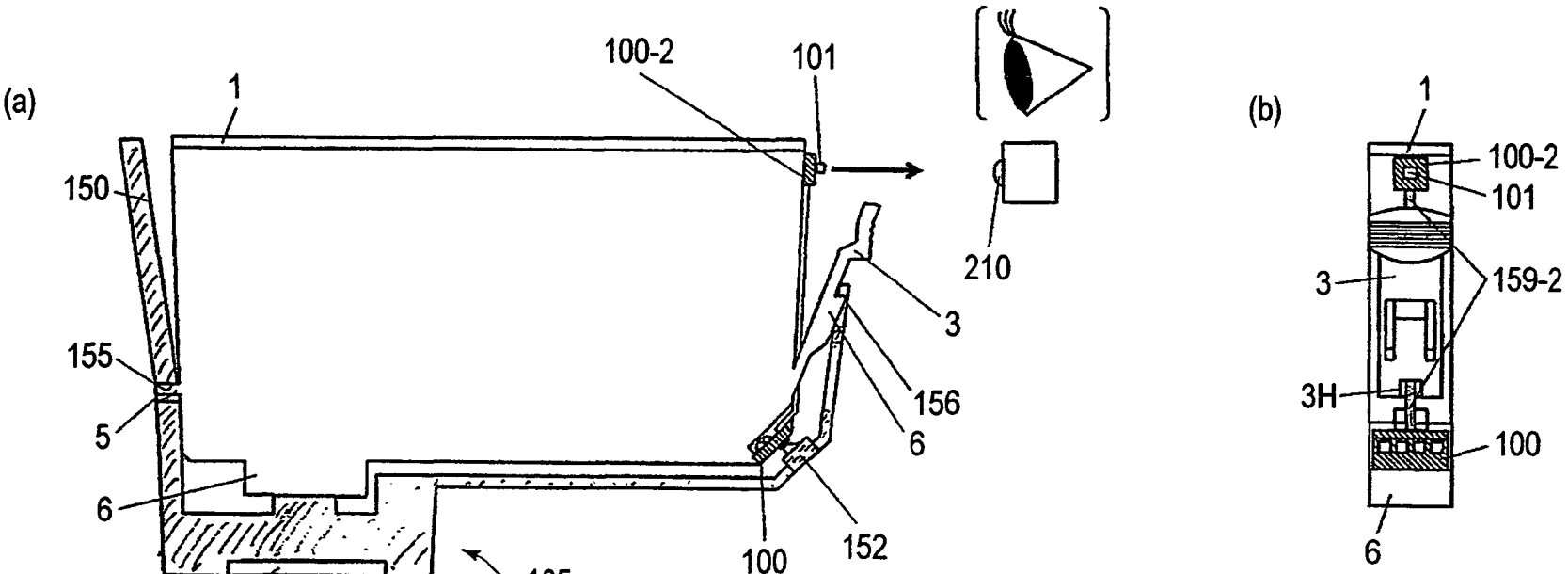
FIG. 43 is a schematic side view (a) and a schematic front view (b) of an ink container according to a further embodiment of the present invention.

FIG. 43 is a schematic side view (a) and a schematic front view (b) of an ink container according to a further embodiment of the present invention, wherein the first embodiment is modified by placing the substrate and the light emitting portion at different positions.

In this embodiment, substrates 100-2 each having a light emitting portion 101 such as a LED is provided on the top portion of ink container front side. Thus, in this embodiment, the emitting portion 101 functions also as the display portion of the foregoing embodiment. Similarly to the foregoing embodiment, the substrate 100 is provided on an inclined surface portion since doing so is preferable from the standpoint of satisfy connection with the carriage side connector 152, the protection from the ink, and the substrate 100 is connected with the substrate 100-2 or the light emitting portion 101 by wiring portion 159-2 so that electric signal can be transmitted therebetween. Designated by 3H is a hole formed in a base portion of a supporting member 3 to extend the wiring portion 159-2 along the ink container casing.

In this embodiment, when the light emitting portion 101 is actuated, the light is directed toward the front side. A light receiving portion 210 is disposed at a position for receiving the light which is directed to the right in the Figure adjacent an end of the scanning range of the carriage, and when the carriage faces such a position, the light emission of the light emitting portion 101 is controlled, so that recording device side can obtain the predetermined information relating to the ink container 1 from the content of the received light by the light receiving portion. When the carriage is at the center portion of the scanning range, for example, the light emitting portion 101 is controlled, by which the user is more easily able to see the state of lightening so that predetermined information relating to the ink container 1 can be recognized by the user.

Figure 44:
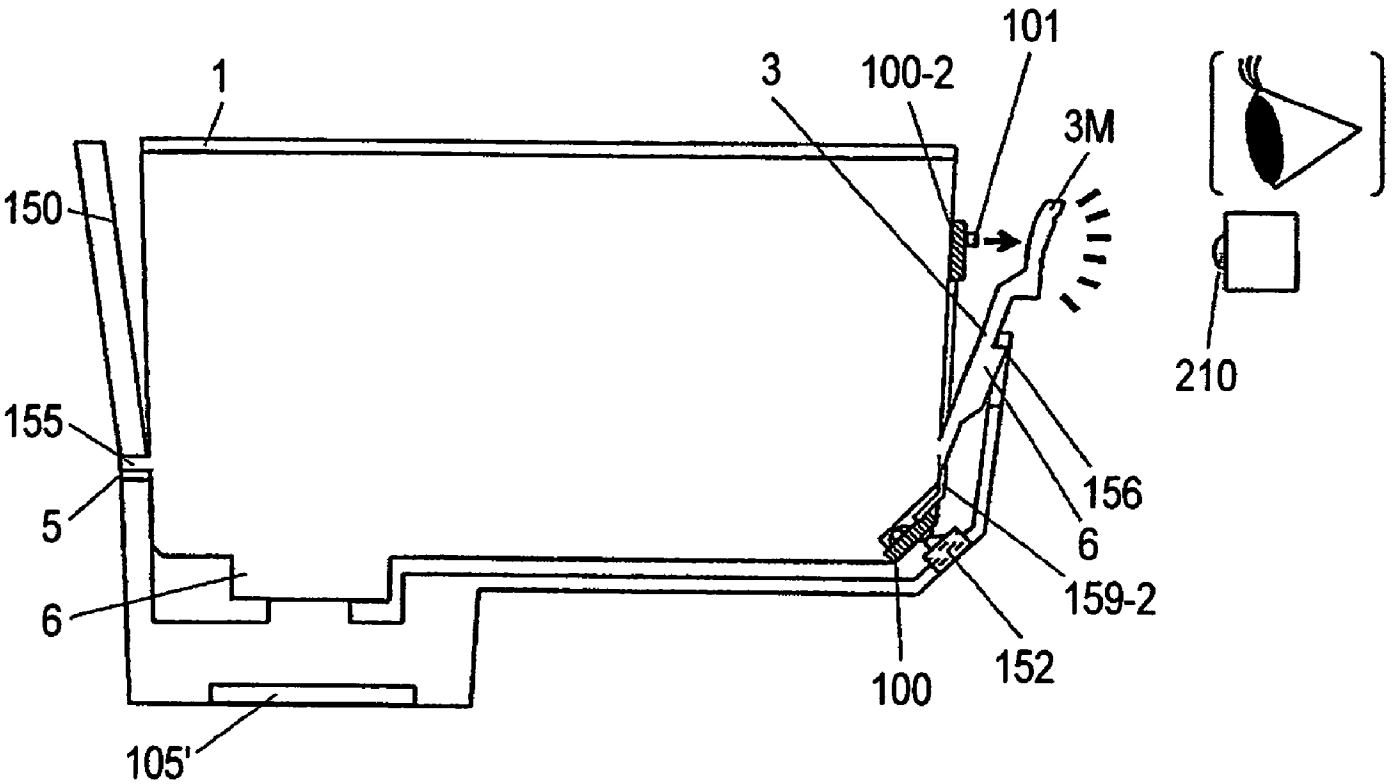
FIG. 44 is a schematic side view of a modified example of the structure of FIG. 43.

FIG. 44 is a schematic side view (a) and a schematic front view (b) of an ink container according to a modified embodiment of FIG. 43. In this embodiment, the light emitting portion 101 and the substrate 100-2 supporting it, are provided on a back side of the operating portion 3M at the ink container front side, the operating portion 3M being the portion manipulated by the user. The functions and advantageous effects of this embodiment are the same as the foregoing embodiments. When the carriage is placed at the center portion of the scanning range, for example, the light emitting portion 101 is actuated, and therefore, the operating portion 3M of the supporting member 3 is also illuminated, so that user can intuitively understand the required manipulation, for example, exchange of the ink container. The operating portion 3M may be provided with a portion for transmitting or scattering a proper amount of the light to facilitate recognition of the illuminated state of the operating portion 3M.

Figure 45:
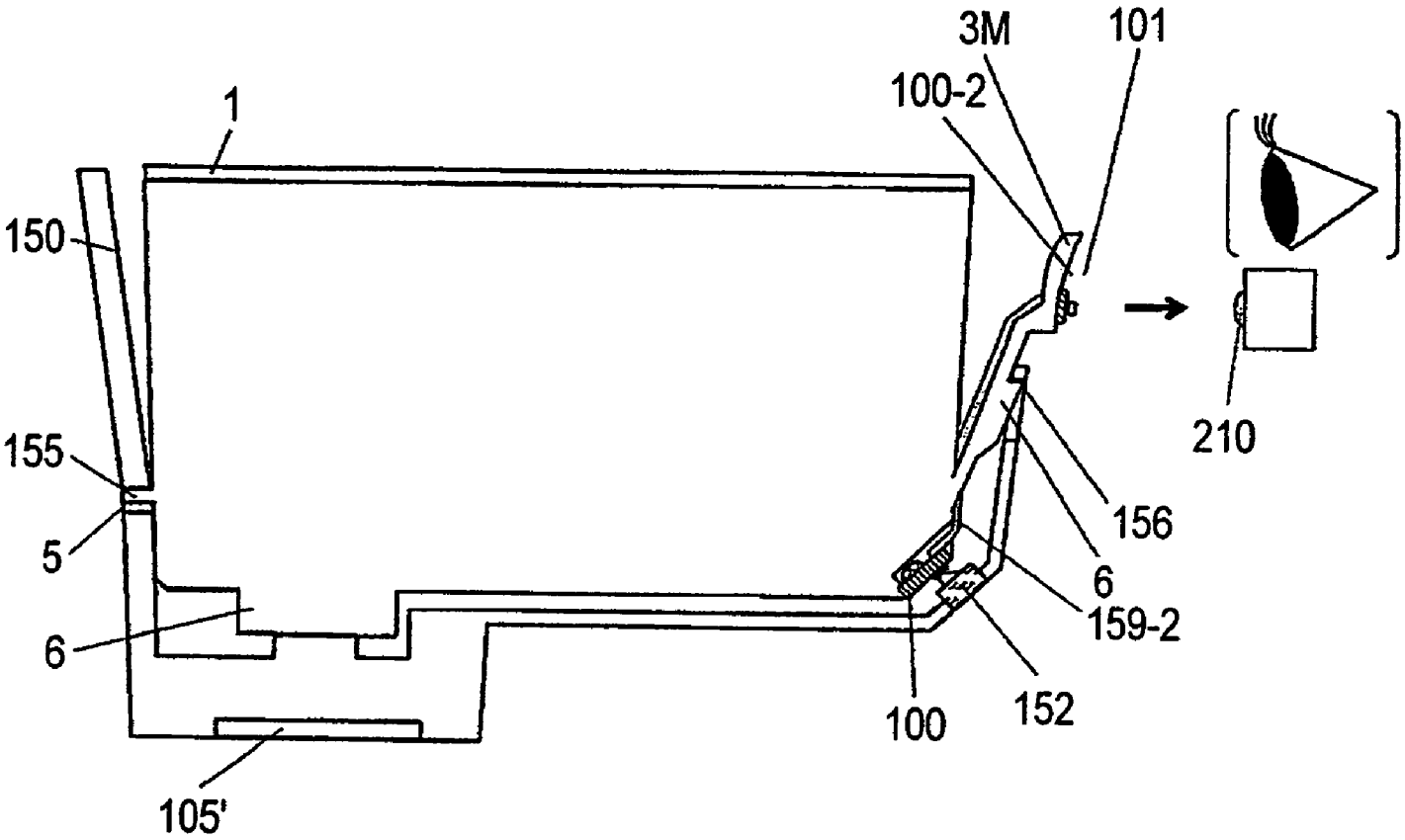
FIG. 45 is a schematic side view of a modified example of the structure of FIG. 43.
Figure 46:
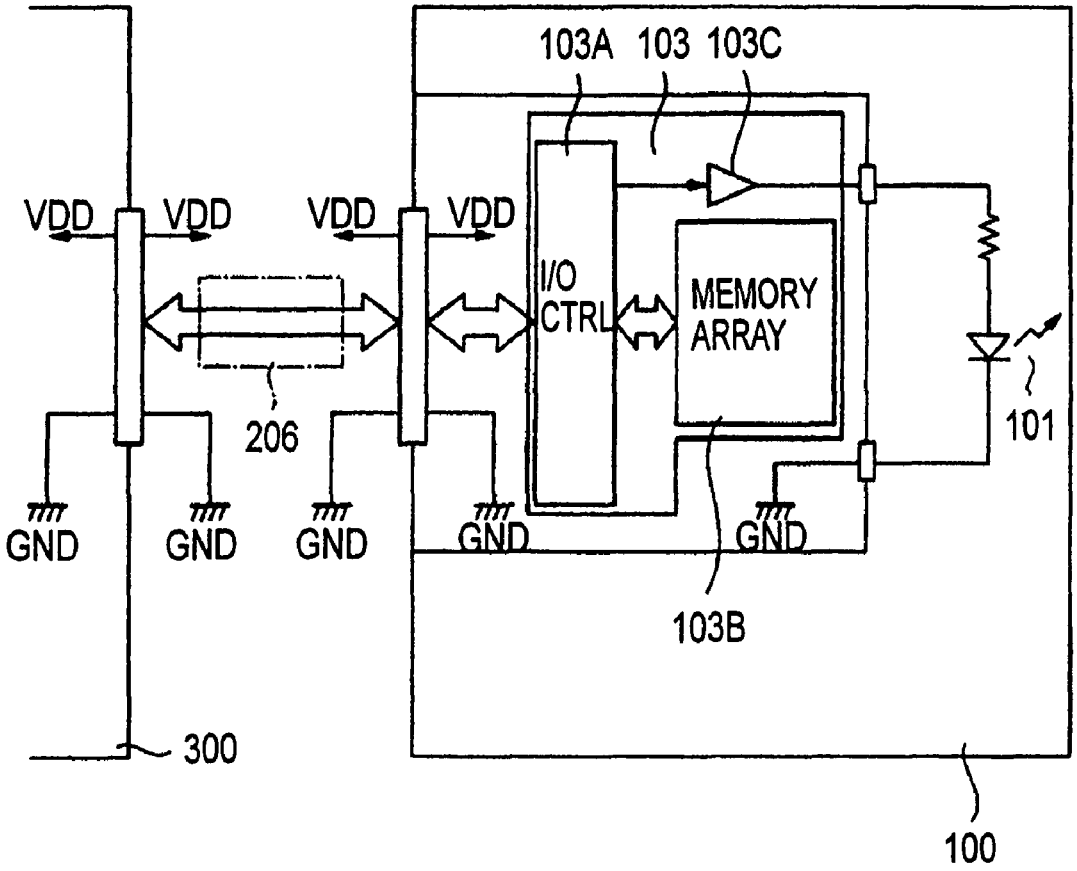
FIG. 46 is a circuit diagram of a substrate having a controller and the like, according to a further embodiment of the present invention.

FIG. 45 is a schematic side view of a modified example of the structure. In this embodiment, the substrate 100-2 having the light emitting portion 101 is disposed on a front side of the operating portion 3M of the supporting member 3. The substrate 100, the substrate 100-2 and the light emitting portion 101 are connected with each other through a hole 3H formed in the base portion of the supporting member 3 by a wiring portion 159-2 extending along the supporting member 3. According to this example, the same advantageous effects as with FIG. 44 can be provided.

In the structure shown in FIG. 43-FIG. 45, flexible print cable (FPC) may be used, by which the substrate 100, the wiring portion 159-2 and the substrate 100-2 may be one integral member.

With the structure of said FIG. 43-FIG. 45, the ink container can be mounted on the mounting portion of the recording device with a simple and easy structure, and the positioning is assured, as with Embodiment 1, and in addition, the disposition of the contact pad described above is effective to assure electrical connection establishment without deteriorating the good operativity of the ink container mounting. Additionally, the display portion for emitting light to outside is disposed on the top part of the front side of the ink container, namely, the side having th latch lever (FIG. 43-FIG. 45 wherein the emitting portion and display portion are common), by which the user visibility is improved. Therefore, structure of the present invention is effective to provide various improvement.

In the foregoing embodiment, the liquid supply system is so-called continuous supply type wherein an amount of the ink ejected out is substantially continuously supplied to the printing head with the use of an ink container separably mounted to the recording head which reciprocates in a main-scanning direction. However, the present invention is applicable to another liquid supply system, wherein the ink container is integrally fixed to the recording head. Even with such a system, if the mounting position is not correct, the recording head receives data for another color, or the order of different color ink ejections is different from the predetermined order with the result of deteriorated recording quality. When the ink container integral with the head is mounted to or demounted from the recording device, the ink leaked from the recording head might be deposited on the contact pad. This possibility should be taken into consideration.

FIG. 39 is a circuit diagram of a substrate having a controller and the like, according to a further embodiment of the present invention. As shown in this Figure, the controller 103 comprises an I/O control circuit (I/O-CTRL) 103A and a LED driver 103C.

The I/O control circuit 103A actuates the LED 101 in response to the control data supplied from the control circuit 300 provided in the main assembly side through the flexible cable 206.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

This embodiment is different from the first embodiment in that there is not provided a memory array 103B. Even if the information (color information, for example) is not stored in the memory array, the ink container can be identified, the LED 101 of the identified ink container can be actuated or deactuated.

Figure 47:
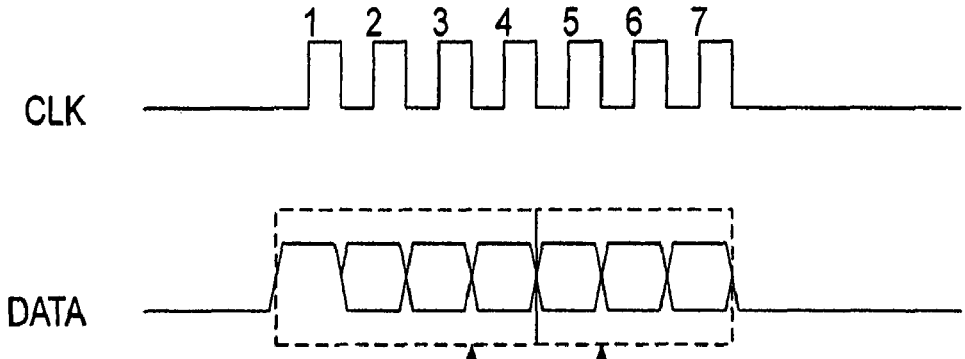
FIG. 47 is a timing chart of an operation in the structure of the embodiment.

Referring to FIG. 47, this will be described.

An I/O control circuit 103A of the controller 103 of the ink container 1 receives start code plus color information, control code is supplied with clock signal CLK, from the main assembly side control circuit 300 through a signal line DATA (FIG. 20). The I/O control circuit 103A includes a command discrimination portion 103D for recognizing a combination of the color information plus the control code as a command, for determining actuation or deactuation of the LED driver 103C. 1K The ink containers 1K, 1C, 1M and 1Y are provided with respective controllers 103 which have different command discrimination portions 103D, and the commands for controlling the ON and OFF of the LED, for the respective colors have the arrangements shown in FIG. 47. Thus, the respective command discrimination portions 103D have the respective individual information (color information) in this sense, and the information is compared with the color information of the inputted command, various operations are controlled. When, for example, the main assembly transmits together with the start code the color information plus control code 000100 indicative of K-ON for turning on the LED of the ink container 1K, only the command discrimination portion 103D of the ink container 1K accept it, so that only the LED of ink container 1K is switched on. In this embodiment, the controllers 103 have to have structures which are different depending on the colors, but are advantageous in that provision of the memory array 103B is not necessitated.

The command discrimination portion 103D, as shown in FIG. 40, may have a function of discriminating not only the commands indicative of turning-on and -off of a particular LED 101 but also a command ALL-ON or ALL-OFF indicative of turning-on and -off of the LEDs 101 of all of the ink containers, and/or a CALL command causing a particular color controller 103 to output a reply signal.

As a further alternative, the command including the color information and the control code sent from the main assembly side control circuit 300 to the ink container 1 may not be directly compared with the color information (individual information) in the ink container. In other words, the inputted command is converted or processed in the controller 103, and the value provided as a result of the conversion is compared with the predetermined value stored in the memory array 103B or the command discrimination portion 103D inner, and only when the result of the comparison corresponds to the predetermined relation, the LED is actuated or deactuated.

As a further alternative, the signal sent from the main assembly side is converted or processed in the controller 103, and the value stored in the memory array 103B or the command control portion 103D is also converted or processed in the controller 103. The converted ones are compared, and only when the result of the comparison corresponds to the predetermined relation, the LED is actuated or deactuated.

6. Others

In the foregoing embodiments, the description has been made with the ink containers containing yellow ink, magenta ink, cyan ink and black ink. However, the used color or color tone is not limited to these examples, and the number of the ink containers is not limited to those of the examples. In addition to such inks, special color ink such as light color ink, red ink, green ink, blue ink or the like is usable. With the increase of the number of the ink containers, the liability of the erroneous mounting of the ink container increases, and the visibility and/or mounting and demounting property is deteriorated by the increasing wiring lead and connecting portions, so that effectiveness of the present invention increases.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 435940/2003, 435942/2003, 306128/2004 and 329699/2004 filed Dec. 26, 2003, Dec. 26, 2003, Oct. 20, 2004 and Nov. 12, 2004, which is hereby incorporated by reference.

What is claimed is:

1. An ink container detachably mountable to a mounting portion of an ink jet printer including an apparatus contact provided in the mounting portion and a light receptor configured to obtain light reception information used for discriminating properness of position of the ink container mounted in the mounting portion, said ink container comprising:

a memory configured to store discrimination information of the ink container;

a container contact electrically connectable to the apparatus contact provided in the mounting portion;

a light emitting portion configured to emit light;

a controller configured to control light emission of the light emitting portion, based on individual information corresponding to the ink container, supplied through the container contact from the apparatus contact, and the discrimination information stored in the memory; and a light guide member having a light incident portion into which the light emitted from the light emitting portion is entered and a light emergence portion, the light guide member configured to guide the light entered from the light incident portion to the light emergence portion so as to cause the light receptor to receive the light emerged from the light emergence portion.

2. An ink container according to claim 1, further comprising:

a casing forming a chamber configured to contain ink;

an ink supply port configured to supply ink in the chamber to an ink jet head, wherein the ink supply port is provided in a first surface of the casing which is opposed to a second surface of the casing; and wherein the light emitting portion is provided at a neighborhood of the first surface, and wherein the light emergence portion is disposed at a position which is more remote from the first surface than the light incident portion and which is closer the second surface of the casing than the light incident portion.

3. An ink container according to claim 1, further comprising a substrate provided with the light emitting portion, the container contact, the memory and the controller.

4. An ink container according to claim 3, further comprising:

a casing forming a chamber configured to contain ink;

an ink supply port configured to supply ink in the chamber to an ink jet head, wherein the ink supply port is provided in a first surface of the casing which is opposed to a second surface of the casing; and a latch lever elastically deformable and having an engaging portion spaced from a third surface of the casing, the engaging portion engageable with a locking portion provided in the mounting portion wherein the substrate is provided adjacent the first and second surfaces and is located above the first surface, and wherein the light emergence portion is disposed at a position which is more remote from the first surface than the light incident portion and which is closer to the second surface of the casing than the light incident portion.

5. An ink container according to claim 1, wherein the controller (a) receives, through the container contact from the apparatus contact, control data including the individual information and a light emitting command code, and (b) controls the light emission of the light emitting portion based on the individual information included in the received control data and the discrimination information.

6. An ink container according to claim 5, wherein the controller causes the light emitting portion to emit the light when the individual information included in the received control data corresponds to the discrimination information.

7. An ink container according to claim 1, wherein the light emitted from the light emitting portion includes visible light.

8. An ink container according to claim 1, wherein the light emitting portion is an LED.

9. An ink container detachably mountable to a mounting portion of an ink jet printer, said ink container comprising:

a casing forming a chamber configured to contain ink;

an ink supply port provided in a first surface of the casing and configured to supply ink in the chamber to an ink jet head;

a memory configured to store discrimination information of the ink container;

a container contact electrically connectable to an apparatus contact provided in the mounting portion;

a light emitting portion;

a controller configured to (a) receive, from the apparatus contact through the container contact, control data including a driving command code for driving the light emitting portion and including individual information corresponding to the ink container, and (b) control driving of the light emitting portion, based on the discrimination information stored in the memory and the individual information included in the received control data;

a substrate provided at a neighborhood of the first surface and having the memory, the container contact, the light emitting portion and the controller; and a light guide member configured to receive light emitted from the light emitting portion driven by the controller and configured to guide the received light toward a second surface of the casing opposed to the first surface.

10. An ink container according to claim 9, wherein the controller drives the light emitting portion when the individual information included in the control data corresponds to the discrimination information.

11. An ink container according to claim 9, wherein the light emitted from the light emitting portion includes visible light.

12. An ink container according to claim 9, wherein the light emitting portion is an LED.

13. An ink container detachably mountable to a mounting portion of an ink jet printer, said ink container comprising:

a casing forming a chamber configured to contain ink;

an ink supply port provided in a first surface of the casing and configured to supply ink in the chamber to an ink jet head;

a memory configured to store discrimination information of the ink container;

a container contact electrically connectable to an apparatus contact provided in the mounting portion;

a light emitting portion provided at a neighborhood of the first surface;

a controller configured to control light emission of the light emitting portion, based on the discrimination information stored in the memory and individual information corresponding to the ink container supplied through the container contact from the apparatus contact; and a light guide member configured to receive light emitted from the light emitting portion and configured to guide the received light toward a second surface of the casing opposed to the first surface.

14. An ink container according to claim 13, wherein the light emitted from the light emitting portion includes visible light.

15. An ink container detachably mountable to a main assembly, having an inkjet head, of an ink jet printer, said ink container comprising:

a casing forming a chamber containing ink;

an ink supply port provided in a first surface of the casing and configured to supply ink in the chamber to the inkjet head;

a memory storing color information corresponding to a color of the ink in the chamber;

an electrical contact electrically connectable to the main assembly;

a light emitting portion;

a controller configured to (a) receive control data including color information from the main assembly through the electrical contact, and (b) control light emission of the light emitting portion based on the color information stored in the memory and the color information in the received control data when the received control data includes a light emitting command code; and a light guide member configured to receive light emitted from the light emitting portion and configured to guide the received light toward a second surface of the casing opposed to the first surface.

16. An ink container according to claim 15, wherein the light emitted from the light emitting portion includes visible light.

17. An ink container detachably mountable to a main assembly, having an inkjet head, of an ink jet printer, said ink container comprising:

a casing forming a chamber containing ink;

an ink supply port provided in a first surface of the casing and configured to supply ink in the chamber to the inkjet head;

a memory storing discrimination information of the ink container;

an electrical contact electrically connectable to the main assembly;

a light emitting portion;

a controller configured to (a) receive, from the main assembly through the electrical contact, light emitting control data including a light emitting command code, and (b) cause the light emitting portion to emit light when the received light emitting control data includes information corresponding to the discrimination information stored in the memory; and a light guide member configured to receive light emitted from the light emitting portion and configured to guide the received light toward a second surface of the casing opposed to the first surface.

18. An ink container according to claim 17, wherein the light emitted from the light emitting portion includes visible light.

19. An ink container detachably mountable to a mounting portion of an ink jet printer including an apparatus contact provided in the mounting portion and a light receptor configured to obtain light reception information used for discriminating properness of position of the ink container mounted in the mounting portion, said ink container comprising:

a memory storing discrimination information of the ink container;

a container contact electrically connectable to the apparatus contact provided in the mounting portion;

a light emitting portion;

a controller configured to (a) receive, from the apparatus contact through the electrical contact, light emitting control data including a light emitting code, and (b) cause the light emitting portion to emit light when the received light emitting control data includes information corresponding to the discrimination information stored in the memory; and a light guide member having a light incident portion into which the light emitted from the light emitting portion is entered and a light emergence portion, the light guide member configured to guide the light entered from the light incident portion to the light emergence portion so that the light emerged from the light emergence portion is capable of reaching the light receptor.

20. An ink container according to claim 19, wherein the light emitted from the light emitting portion includes visible light.

21. An ink container detachably mountable to a mounting portion of an ink jet printer having an ink jet head, said ink container comprising:

a casing defining an ink containing chamber;

a first engaging portion engageable with a first locking portion provided in the mounting portion, said first engaging portion being disposed on a first side of said casing;

a second engaging portion engageable with a second locking portion provided in the mounting portion;

a supporting member supporting said second engaging portion and disposed on a second side of said casing which is opposite said first side, said supporting member elastically deformable toward the second side;

a light emitting portion;

an electrical contact electrically connectable with an apparatus contact provided in the mounting portion and capable of receiving a signal for actuating said light emitting portion from the apparatus contact;

a display portion for directing the light emitted from said emitting portion to an outside of said ink container; and a supply port, provided in a third side of said casing, for supplying ink contained in the ink containing chamber to the ink jet head, wherein said electrical contact is disposed in a region of a corner portion between said second side and said third side, and wherein said display portion is disposed adjacent to an upper, in use, portion in said second side.

22. An ink container detachably mountable to a mounting portion of an ink jet printer having an ink jet head, said ink container comprising:

a casing defining an ink containing chamber;

a first engaging portion engageable with a first locking portion provided in the mounting portion, said first engaging portion being disposed on a first side of said casing;

a second engaging portion engageable with a second locking portion provided in the mounting portion;

a supporting member supporting said second engaging portion and disposed on a second side of said casing which is opposite said first side, said supporting member elastically deformable toward the second side;

a light emitting portion;

an electrical contact electrically connectable with an apparatus contact provided in the mounting portion;

an information storing portion storing individual information of said ink container;

a controller configured to control actuation of said light emitting portion based on the individual information stored in said information storing portion and information supplied through said electrical contact;

a display portion for directing the light emitted from said emitting portion to an outside of said ink container; and a supply port, provided in a third side of said casing, for supplying ink contained in the ink containing chamber to the ink jet head, wherein said electrical contact is disposed in a region of a corner portion between said second side and said third side, and wherein said display portion is disposed adjacent to an upper, in use, portion in said second side.

* * * * *